US009454879B2

(12) United States Patent
Pierer et al.

(10) Patent No.: US 9,454,879 B2
(45) Date of Patent: Sep. 27, 2016

(54) ENHANCEMENTS TO GAME COMPONENTS IN GAMING SYSTEMS

(71) Applicant: Spielo International Canada ULC, Moncton (CA)

(72) Inventors: Franz Pierer, Dobl (AT); Bethany Joy Trainor, Dieppe (CA); Edward Bowron, Shediac Bridge (CA); Khaled Adams, Moncton (CA)

(73) Assignee: IGT Canada Solutions ULC, Moncton (CA)

( * ) Notice: Subject to any disclaimer, the term of this patent is extended or adjusted under 35 U.S.C. 154(b) by 137 days.

(21) Appl. No.: 14/029,364

(22) Filed: Sep. 17, 2013

(65) Prior Publication Data

US 2014/0194183 A1 Jul. 10, 2014

Related U.S. Application Data

(63) Continuation-in-part of application No. 13/631,129, filed on Sep. 28, 2012, which is a continuation-in-part of application No. 13/622,267, filed on Sep. 18, 2012, now Pat. No. 8,715,060.

(60) Provisional application No. 61/746,707, filed on Dec. 28, 2012.

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3211* (2013.01)

(58) Field of Classification Search

CPC ..... G07F 17/34
USPC ..... 463/16–20
See application file for complete search history.

(56) References Cited

U.S. PATENT DOCUMENTS

| | | | |
|---|---|---|---|
| 6,607,441 | B1 | 8/2003 | Acres |
| 6,846,238 | B2 | 1/2005 | Wells |

(Continued)

FOREIGN PATENT DOCUMENTS

| | | | |
|---|---|---|---|
| CA | 2601560 | A1 | 10/2006 |
| CA | 2783122 | A1 | 1/2013 |

(Continued)

OTHER PUBLICATIONS

U.S. Appl. No. 13/631,129, Adams.

(Continued)

*Primary Examiner* — Ronald Laneau
*Assistant Examiner* — Ross Williams
(74) *Attorney, Agent, or Firm* — Myers Bigel & Sibley, P.A.

(57) ABSTRACT

A computer-implemented method for enhancing game components in a gaming system, the method comprising: displaying at least one of a row and a column of the game components along a plane on a display device in accordance with a set of game rules for a given game, each one of the game components having an original symbol associated thereto; selecting at least one of the game components for enhancement; expanding selected ones of the game components outside of the plane and associating at least one additional symbol to expanded selected ones of the game components; and integrating the at least one additional symbol into the given game.

20 Claims, 47 Drawing Sheets

(56) References Cited

U.S. PATENT DOCUMENTS

| | | | | |
|---|---|---|---|---|
| 7,252,591 | B2 * | 8/2007 | Van Asdale | 463/22 |
| 7,804,995 | B2 | 9/2010 | Lipton et al. | |
| 8,357,041 | B1 | 1/2013 | Saunders | |
| 8,366,538 | B1 | 2/2013 | Saunders et al. | |
| 8,371,930 | B1 | 2/2013 | Saunders et al. | |
| 8,414,380 | B2 | 4/2013 | Saunders et al. | |
| 8,715,060 | B2 | 5/2014 | Bowron | |
| 8,727,855 | B2 * | 5/2014 | Williams et al. | 463/16 |
| 2002/0122585 | A1 | 9/2002 | Swift et al. | |
| 2003/0032479 | A1 | 2/2003 | LeMay et al. | |
| 2003/0064805 | A1 | 4/2003 | Wells | |
| 2004/0218269 | A1 | 11/2004 | Divelbiss et al. | |
| 2005/0020278 | A1 | 1/2005 | Krumm et al. | |
| 2005/0117637 | A1 | 6/2005 | Routhier et al. | |
| 2005/0190180 | A1 | 9/2005 | Jin et al. | |
| 2006/0287060 | A1 | 12/2006 | Yoshimi | |
| 2007/0296859 | A1 | 12/2007 | Suzuki | |
| 2008/0020845 | A1 | 1/2008 | Low et al. | |
| 2008/0318684 | A1 | 12/2008 | Rofougaran | |
| 2010/0248809 | A1 | 9/2010 | Fitzsimons | |
| 2010/0267439 | A1 | 10/2010 | Englman et al. | |
| 2010/0298040 | A1 | 11/2010 | Joshi et al. | |
| 2011/0032329 | A1 | 2/2011 | Bauza et al. | |
| 2011/0045891 | A1 | 2/2011 | Ansari | |
| 2011/0298795 | A1 | 12/2011 | Van Der Heijden et al. | |
| 2012/0077564 | A1 | 3/2012 | Collette et al. | |
| 2012/0122547 | A1 | 5/2012 | Aoki et al. | |
| 2012/0165101 | A1 | 6/2012 | Krishnamoorthy et al. | |
| 2013/0019024 | A1 | 1/2013 | Sheth et al. | |
| 2013/0023325 | A1 * | 1/2013 | Saunders et al. | 463/20 |
| 2013/0093752 | A1 | 4/2013 | Yuan | |
| 2013/0178271 | A1 | 7/2013 | Aponte et al. | |
| 2013/0184070 | A1 | 7/2013 | Gadher et al. | |
| 2013/0184071 | A1 | 7/2013 | Gadher et al. | |
| 2013/0310140 | A1 | 11/2013 | Meinick | |
| 2014/0094268 | A1 | 4/2014 | Adams | |

FOREIGN PATENT DOCUMENTS

| | | | |
|---|---|---|---|
| CA | 2783272 | A1 | 1/2013 |
| CA | 2800295 | | 3/2014 |
| CA | 2800295 | A1 | 3/2014 |
| CA | 2827465 | | 3/2014 |
| CA | 2827465 | A1 | 3/2014 |
| EP | 2551832 | A2 | 1/2013 |
| WO | 2008118800 | A1 | 10/2008 |

OTHER PUBLICATIONS

U.S. Appl. No. 13/622,267, Bowron.

United States Patent and Trademark Office, Office Action dated Jun. 20, 2014, issued on U.S. Appl. No. 13/631,129.

United States Patent and Trademark Office, Office Action dated Aug. 25, 2014, issued on U.S. Appl. No. 13/631,129.

Patent Cooperation Treaty, Written Opinion and International Search Report dated Oct. 30, 2013, issued on PCT Application No. PCT/CA2013/000636.

* cited by examiner

ENHANCEMENTS TO GAME COMPONENTS IN GAMING SYSTEMS

TECHNICAL FIELD

Embodiments described herein relate to the field of electronic gaming systems, such as on-line gaming and gaming systems in casinos.

INTRODUCTION

Various video gaming systems or machines are known. These may consist of slot machines, online gaming systems (that enable users to play games using computer devices, whether desktop computers, laptops, tablet computers or smart phones), computer programs for use on a computer device (including desktop computer, laptops, tablet computers of smart phones), or gaming consoles that are connectable to a display such as a television or computer screen.

Video gaming machines may be configured to enable users to play a variety of different types of games. One type of game displays a plurality of moving arrangements of gaming elements (such as reels, and symbols on reels), and one or more winning combinations are displayed using a pattern of gaming elements in an arrangement of cells (or an "array"), where each cell may include a gaming element, and where gaming elements may define winning combinations (or a "winning pattern").

Games that are based on winning patterns may be referred to as "pattern games" in this disclosure.

One example of a pattern game is a game that includes spinning reels, where a user wagers on one or more lines, activates the game, and the spinning reels are stopped to show one or more patterns in an array. The game rules may define one or more winning patterns of gaming elements, and these winning patterns may be associated with credits, points or the equivalent.

Gaming systems or machines of this type are popular, however, there is a need to compete for the attention of users, and therefore it is necessary to innovate by launching new, engaging game features.

SUMMARY

There is described a method for providing enhancements to game components in a gaming system.

In accordance with a first aspect, there is provided a computer-implemented method for enhancing game components in a gaming system, the method comprising: displaying at least one of a row and a column of the game components along a plane on a display device in accordance with a set of game rules for a given game, each one of the game components having an original symbol associated thereto; selecting at least one of the game components for enhancement; expanding selected ones of the game components outside of the plane and associating at least one additional symbol to expanded selected ones of the game components; and integrating the at least one additional symbol into the given game.

In accordance with some embodiments, the game component selected for three dimensional enhancement may be modified or varied to provide a variant three dimensional enhancement that may not be limited to a three dimensional version of the game component.

In accordance with some embodiments, expanding selected ones of the game components may comprise stacking the at least one additional symbol with the original symbol along an axis coming out of the display device.

In accordance with some embodiments, stacking the at least one additional symbol with the original symbol may comprise stacking the at least one additional symbol behind the original symbol.

In accordance with some embodiments, stacking the at least one additional symbol with the original symbol may comprise stacking the at least one additional symbol on top of the original symbol.

In accordance with some embodiments, the method may further involve stacking multiple additional symbols with the original symbol to provide a three dimensional enhancement. For example, the additional symbols may be wild symbols, as described herein. The additional symbols may impact payout of winning patterns involving the additional symbols as described herein.

In accordance with some embodiments, expanding selected ones of the game components may comprise exploding the selected ones of the game components into multiple symbols outside of the plane arranged in a predetermined configuration.

In accordance with some embodiments, expanding selected ones of the game components may comprise providing a cube with the original symbol on a first surface of the cube and the at least one additional symbol on a second surface of the cube.

In accordance with some embodiments, selecting at least one of the game components for enhancement may comprise selecting a plurality of game components, and expanding selected ones comprises generating a multi-faceted gaming surface in three-dimensions.

In accordance with some embodiments, the method may further comprise running multiple instances of the given game in parallel on different surfaces of the multi-faceted gaming surface.

In accordance with some embodiments, the method may further comprise associating the at least one additional symbol with a secondary prize via a secondary game playable in parallel to the given game.

In accordance with some embodiments, associating the at least one additional symbol with a secondary prize via a secondary game may comprise allowing the at least one additional symbol to be displaced on the display device via a user interface.

In accordance with some embodiments, stacking the at least one additional symbol with the original symbol may comprise stacking different ones of the game components to varying depths.

In accordance with some embodiments, expanding selected ones of the game components may comprise providing the at least one additional symbol at least one of parallel, perpendicular, and at an angle with the original symbol.

In accordance with some embodiments, the given game is a base game, and the method may further comprise: determining that a trigger event occurs to launch a bonus game; providing a plurality of bonus game selections; receiving a selected bonus game from the plurality of bonus game selections; launching the selected bonus game.

In accordance with some embodiments, the bonus game may include three dimensional enhancements by stacking at least one additional symbol on an original symbol of the bonus game, wherein the original symbol is not used for a payout in a current round of the bonus game, wherein the stacked at least one additional symbol impacts payout of additional rounds of the bonus game.

In accordance with some embodiments, the method may further comprise: determining that a prize event occurs; providing a plurality of prize game selections using a three dimensional enhancement; determining a selected prize from the plurality of prize selections after the remaining prizes from the plurality of prize selections are eliminated.

In accordance with some embodiments, the method may further comprise: displaying, using a gaming device, a succession of main games, each main game comprising displaying random selections of symbols in a matrix of symbol positions, wherein there are certain winning combinations of symbols across a plurality of symbol positions; displaying a secondary game concurrently with the succession of main games, where the secondary game carries over from one main game to the next main game, wherein the secondary game comprises: providing a visual indicator at a symbol position when a symbol at that symbol position is involved in a winning combination of symbols at the end of a main game; carrying over all visual indicators from one main game to the next main game; and determining when all symbol positions in the matrix have had a symbol involved in a winning combination, as indicated by each symbol position displaying a visual indicator, and, if so, initiating a bonus game; wherein the expanded selected ones of the game components and the at least one additional symbol are part of at least one of the main game, the secondary game, and the bonus game to display a variant game with a three dimensional enhancement.

In accordance with some embodiments, the visual indicator may add an image to a symbol position when a symbol at that symbol position is involved in a winning combination of symbols at the end of the main game.

In accordance with some embodiments, the visual indicator may subtract an image from a symbol position when a symbol at that symbol position is involved in a winning combination of symbols at the end of the main game.

In accordance with some embodiments, the visual indicator may change an image at a symbol position when a symbol at that symbol position is involved in a winning combination of symbols at the end of the main game.

In accordance with some embodiments, the visual indicator may be a tile that appears behind a symbol, where the tile is extinguished when a symbol at that symbol position is involved in a winning combination of symbols at the end of the main game.

In accordance with some embodiments, there may be multiple layers of visual indicators and the bonus game is initiated when all visual indicators in all the layers indicate that all symbol positions in the matrix have had a symbol involved in a winning combination.

In accordance with some embodiments, the visual indicators may be reset after the bonus game.

In accordance with some embodiments, a player may make a plurality of different bets prior to each main game, the secondary game further comprising: associating different bet amounts with different visual indicators; using only the visual indicators at the symbol positions during a main game associated with the particular bet amount for that main game; saving in a memory a status of the visual indicators associated with a previous bet amount when the player changes the bet amount for a new main game; and playing the secondary game with the set of visual indicators associated with the bet amount for the new main game.

In accordance with some embodiments, the method may further comprising: selecting on a random basis a first set of chance elements, that determine a first gaming outcome; retrieving one or more rules for generating and displaying video gaming output based on the first set of chance elements, the video gaming output including a first set of gaming elements organized in a first array; displaying the first set of gaming elements; selecting on a random basis a second set of chance elements that determine a second gaming outcome; retrieving one or more rules for generating and displaying video gaming output based on the second set of chance elements as a second set of gaming elements that produce winning enhancements, the second set of gaming elements being organized in a second array; and displaying winning enhancements in way that simulates the second set of gaming elements interacting physically with the first set of gaming elements, wherein the winning enhancements are displayed as part of the three dimensional enhancements involving the expanded selected ones of the game components and the at least one additional symbol.

In accordance with some embodiments, the second array may consist of a grid overlay relative to the first array.

In accordance with some embodiments, the second set of gaming elements interact with the first set of gaming elements via the grid overlay.

In accordance with some embodiments, the method may further comprise simulating that the second set of gaming elements modifies the first gaming outcomes depending on the physical interactions between the first set of gaming elements and the second set of gaming elements so as to produce optionally a second gaming outcome based on the winning enhancements.

In another aspect, embodiments described herein may provide a gaming device for enhancing game components in a gaming system comprising: a display screen with three dimensional capabilities; and at least one processor coupled to at least one memory storing one or more sequences of instructions which, when executed by one or more processors, causes the one or more processors to: display, on the display screen, at least one of a row and a column of the game components along a plane on a display device in accordance with a set of game rules for a given game, each one of the game components having an original symbol associated thereto; select at least one of the game components for three dimensional enhancement; expand selected ones of the game components outside of the plane and associating at least one additional symbol to expanded selected ones of the game components; and integrate the at least one additional symbol into the given game.

In a further aspect, embodiments described herein may provide a computer-readable storage medium storing one or more sequences of instructions which, when executed by one or more processors, causes the one or more processors to perform a method for enhancing game components in a gaming system, the method comprising: displaying at least one of a row and a column of the game components along a plane on a display device in accordance with a set of game rules for a given game, each one of the game components having an original symbol associated thereto; selecting at least one of the game components for three dimensional enhancement; expanding selected ones of the game components outside of the plane and associating at least one additional symbol to expanded selected ones of the game components; and integrating the at least one additional symbol into the given game.

Features of the method described herein may be used in various combinations, and may also be used for the system and computer-readable storage medium in various combinations.

In this specification, the term "game component" or game element is intended to mean any individual element which when grouped with other elements will form a layout for a game. For example, in card games such as poker, blackjack, and gin rummy, the game components may be the cards that form the player's hand and/or the dealer's hand, and cards that are drawn to further advance the game. In a traditional Bingo game, the game components may be the numbers printed on a 5×5 matrix which the players must match against drawn numbers. The drawn numbers may also be game components. In a spinning reel game, each reel may be made up of one or more game components. Each game component may be represented by a symbol of a given image, number, shape, color, theme, etc. Like symbols are of a same image, number, shape, color, theme, etc. Other embodiments for game components will be readily understood by those skilled in the art.

BRIEF DESCRIPTION OF THE DRAWINGS

Further features and advantages of the present invention will become apparent from the following detailed description, taken in combination with the appended drawings, in which:

FIGS. 16-21 illustrate the progression of the secondary game over a number of main games;

It will be noted that throughout the appended drawings, like features are identified by like reference numerals.

DETAILED DESCRIPTION OF EMBODIMENTS

The gaming enhancements described herein may be carried out using any type of computer, including portable devices, such as smart phones, that can access a gaming site or a portal (which may access a plurality of gaming sites) via the internet or other communication path (e.g., a LAN or WAN). Embodiments described herein can also be carried out using an electronic gaming machine (EGM) in a casino. Examples of EGM are described with respect to FIGS. 1A to 1C.

Figure 1A:
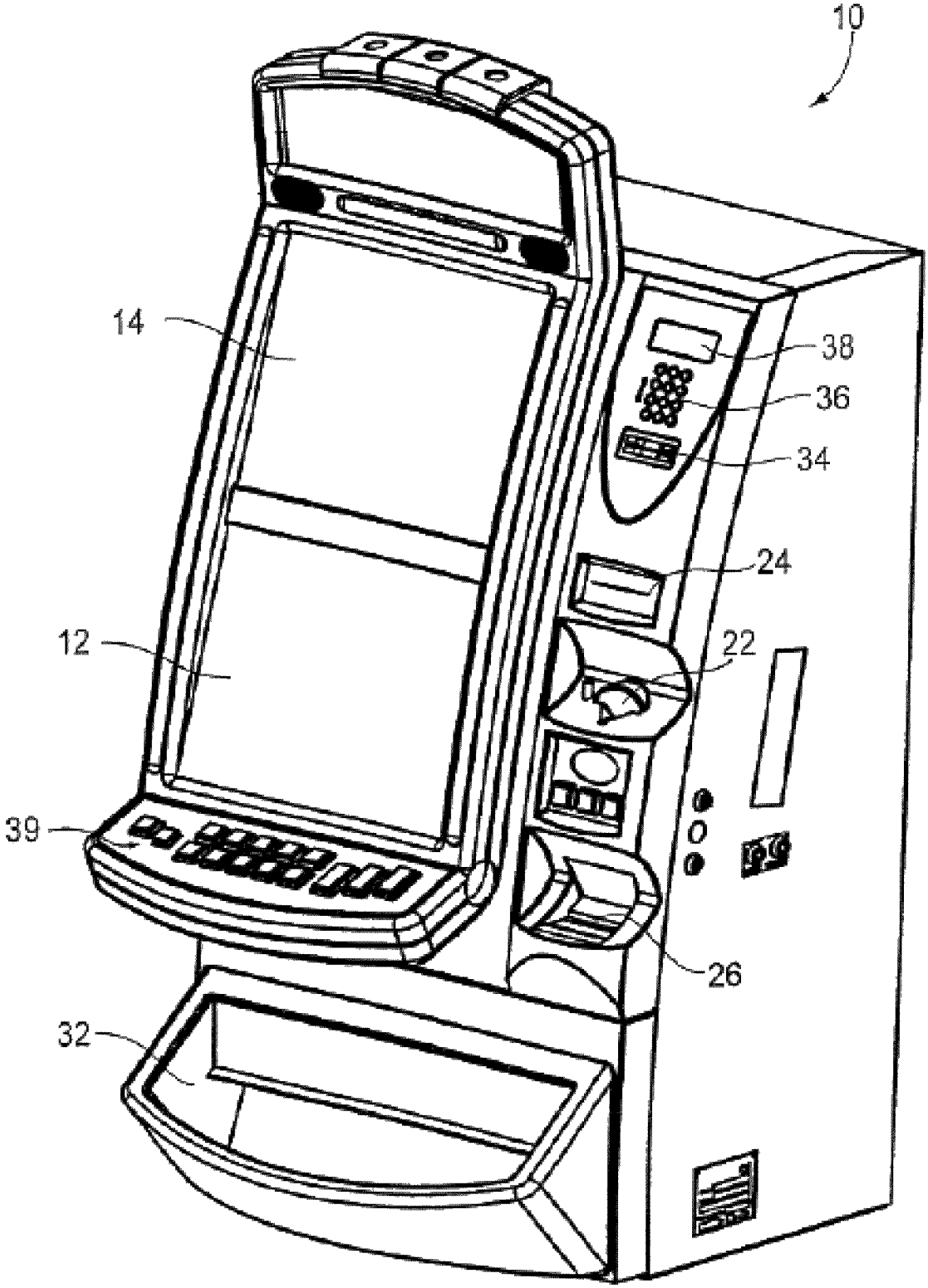
FIGS. 1A, 1B, 1C are a perspective view of electronic gaming machines for implementing the gaming enhancements, in accordance with some embodiments.

FIG. 1A is a perspective view of an EGM 10 where the three-dimensional enhancements to game components may be provided. EGM 10 includes a display 12 that may be a thin film transistor (TFT) display, a liquid crystal display (LCD), a cathode ray tube (CRT), and LED display, an OLED display, autostereoscopic three dimensional, or any other type of display. A second display 14 provides game data or other information in addition to display 12. Display 14 may provide static information, such as an advertisement for the game, the rules of the game, pay tables, pay lines, or other information, or may even display the main game or a bonus game along with display 12. Alternatively, the area for display 14 may be a display glass for conveying information about the game. The Display 12 may also include a camera.

Display 12 or 14 may have a touch screen lamination that includes a transparent grid of conductors. Touching the screen changes the capacitance between the conductors, and thereby the X-Y location of the touch may be determined. The processor associates this X-Y location with a function to be performed. Such touch screens are well known in the field of slot machines, and a detailed description of them is not required. There may be an upper and lower multi-touch screen in accordance with some embodiments.

A coin slot 22 may accept coins or tokens in one or more denominations to generate credits within EGM 10 for playing games. An input slot 24 for an optical reader and printer receives machine readable printed tickets and outputs printed tickets for use in cashless gaming.

A coin tray 32 may receive coins or tokens from a hopper upon a win or upon the player cashing out. However, the gaming machine 10 may be a gaming terminal that does not pay in cash but only issues a printed ticket for cashing in elsewhere. Alternatively, a stored value card may be loaded with credits based on a win, or may enable the assignment of credits to an account associated with a computer system, which may be a computer network connected computer.

A card reader slot 34 may accept any of various types of cards, such as smart cards, magnetic strip cards, or other types of cards conveying machine readable information. The card reader reads the inserted card for player and credit information for cashless gaming. The card reader may read a magnetic code on a conventional player tracking card, where the code uniquely identifies the player to the host system. The code is cross-referenced by the host system to any data related to the player, and such data may affect the games offered to the player by the gaming terminal. The card reader may also include an optical reader and printer for reading and printing coded barcodes and other information on a paper ticket. A card may also include credentials that enable the host system to access one or more accounts associated with a user. The account may be debited based on wagers by a user and credited based on a win.

A keypad 36 may accept player input, such as a personal identification number (PIN) or any other player information. A display 38 above keypad 36 displays a menu for instructions and other information and provides visual feedback of the keys pressed. The keypad 36 may be a input device such as a touchscreen, or dynamic digital button panel, in accordance with some embodiments.

Player control buttons 39 may include any buttons or other controllers needed for the play of the particular game or games offered by EGM 10 including, for example, a bet button, a repeat bet button, a spin reels (or play) button, a maximum bet button, a cash-out button, a display pay lines button, a display payout tables button, select icon buttons, and any other suitable button. Buttons 39 may be replaced by a touch screen with virtual buttons.

The EGM 10 may also include hardware configured to provide optical motion tracking. The optical motion tracking may include a body and head controller.

Figure 1B:
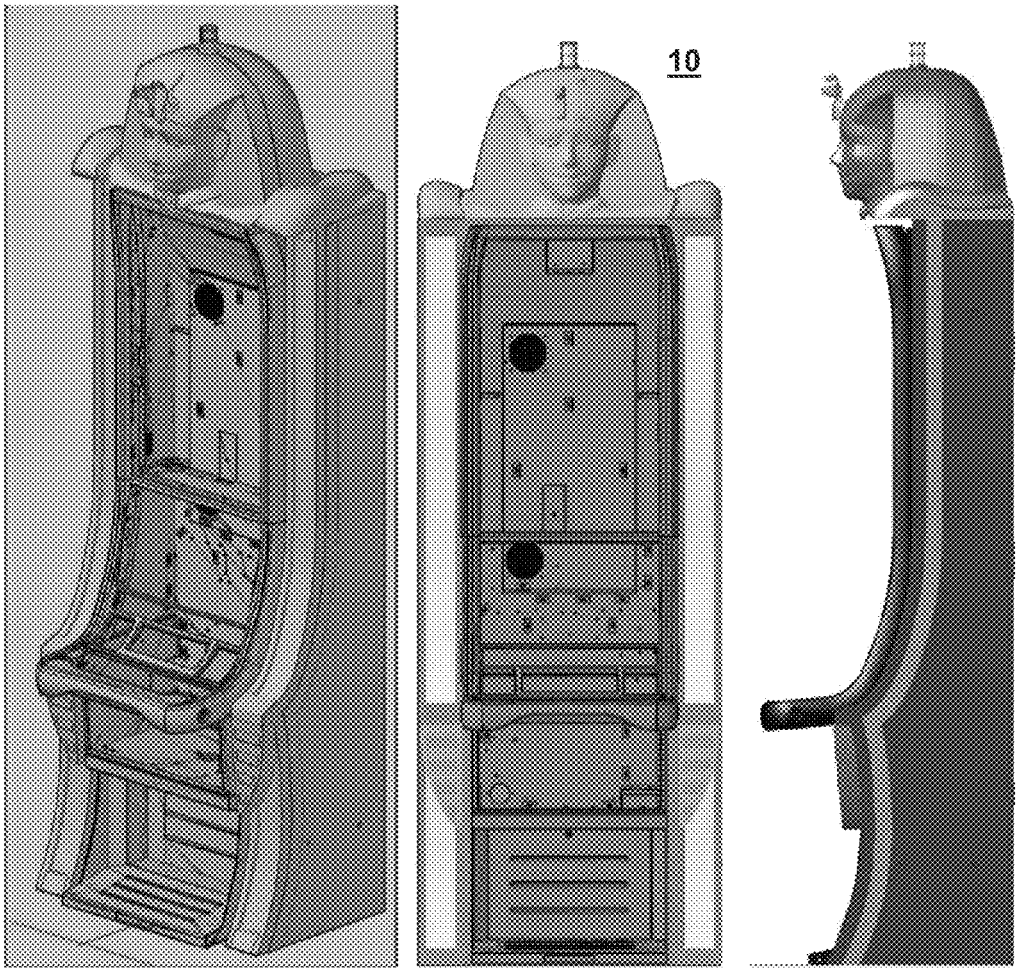
Figure 1C:
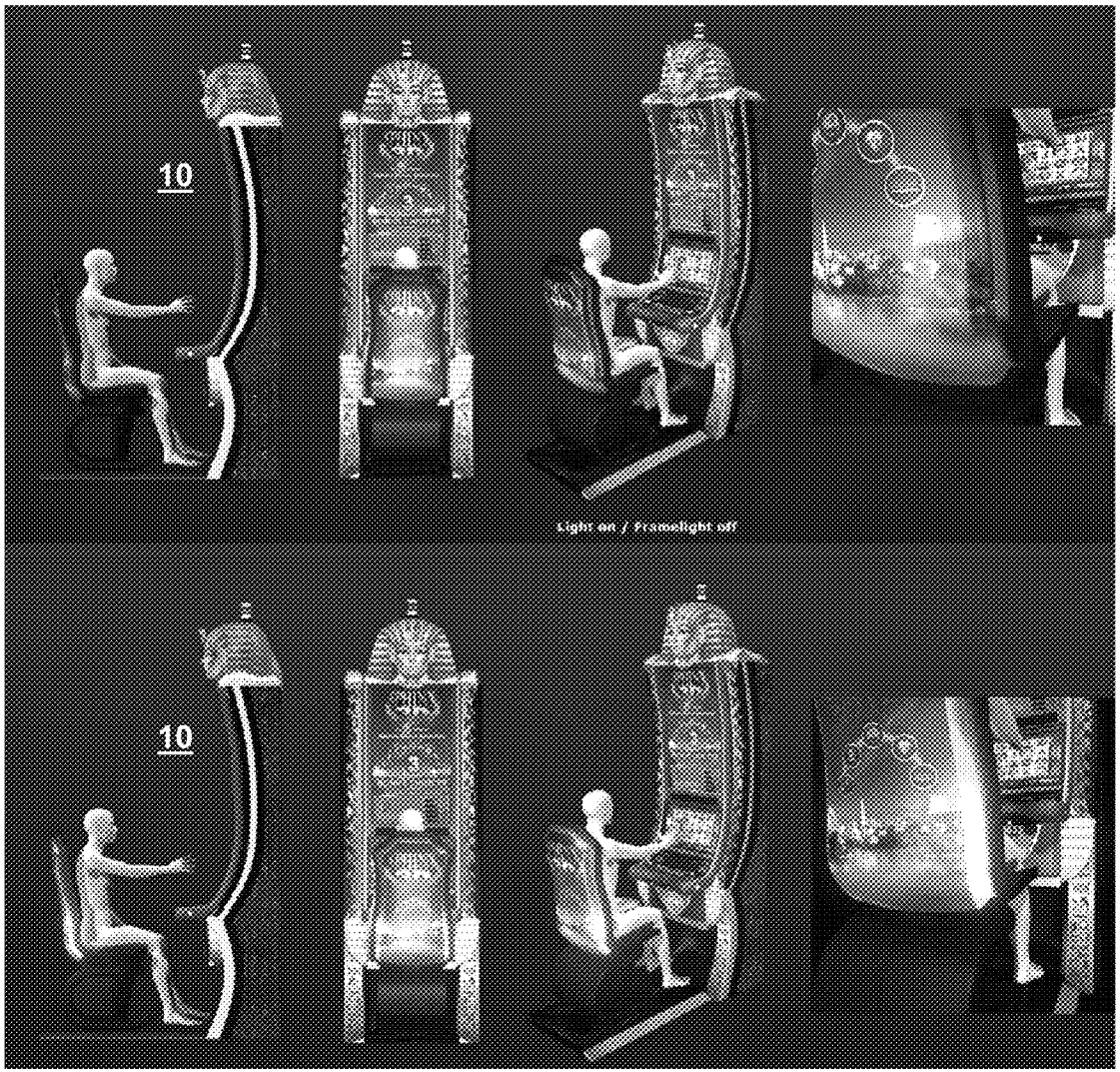

FIGS. 1B and 1C illustrates different perspective views of an EGM 10 where the three dimensional enhancements to game components may be provided according to some embodiments. The three dimensional enhancements may be provided dynamically as dynamic game content. As described, as an illustrative example, the EGM 10 may include a display with multi-touch and auto stereoscopic three-dimensional functionality, including a camera. The EGM 10 may also include several effects and frame lights. The three dimensional enhancements may be three dimensional variants of gaming components. For example, the three dimensional variants may not be limited to a three dimensional version of the gaming components.

The EGM 10 may include an output device such as one or more speakers. The speakers may be located in various locations on the EGM 10 such as in a lower portion or upper portion. The EGM 10 may have a chair or seat portion and the speakers may be included in the seat portion to create a surround sound effect for the player. The seat portion may allow for easy upper body and head movement during play. Functions may be controllable via an on screen game menu. The EGM 10 is configurable to provide full control over all built-in functionality (lights, frame lights, sounds, and so on).

Figure 1D:
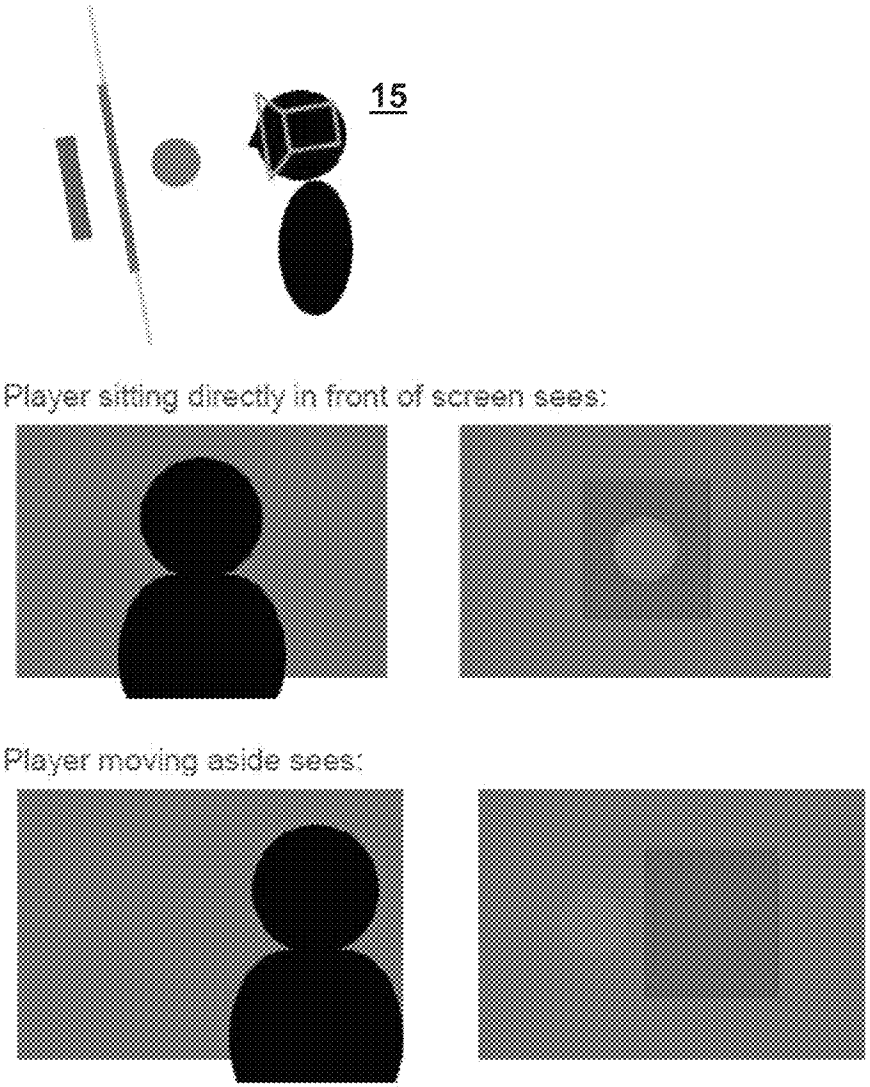
FIG. 1D illustrates an electronic gaming machine with a camera for implementing the gaming enhancements, in accordance with some embodiments.

The EGM 10 may include a camera. FIG. 1D illustrates a camera 15 according to some example embodiments. The camera 15 may be used for motion tracking, for x, y and z coordinates. A viewing object of the game (shown as a circle in front of the base screen) may be illustrated as a three-dimensional enhancement coming towards the player. Another viewing object of the game (shown as a rectangle behind the base screen) may be illustrated as a three-dimensional enhancement moving away from the player. The players head position may be used as a view guide for the viewing camera during a three-dimensional enhancement. A player sitting directly in front of display 12 may see a different view than a player moving aside. The camera 15 may also be used to detect occupancy of the machine.

Figure 1E:
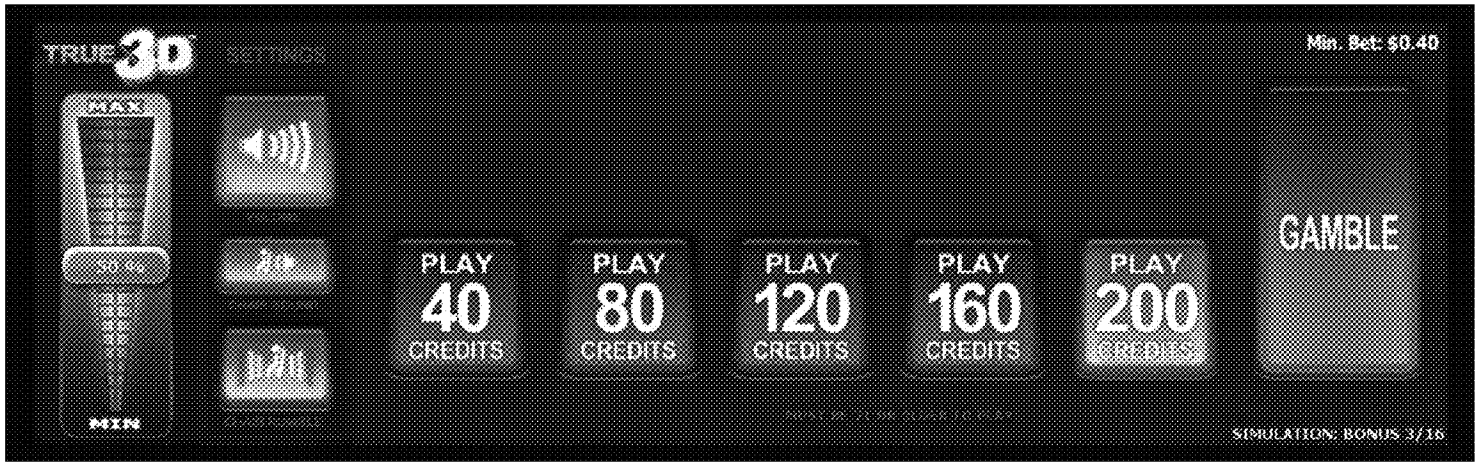
FIGS. 1E, 1F, 1G, and 1H illustrate example displays for the digital button panel of an electronic gaming machine for implementing the gaming enhancements, in accordance with some embodiments.
Figure 1F:
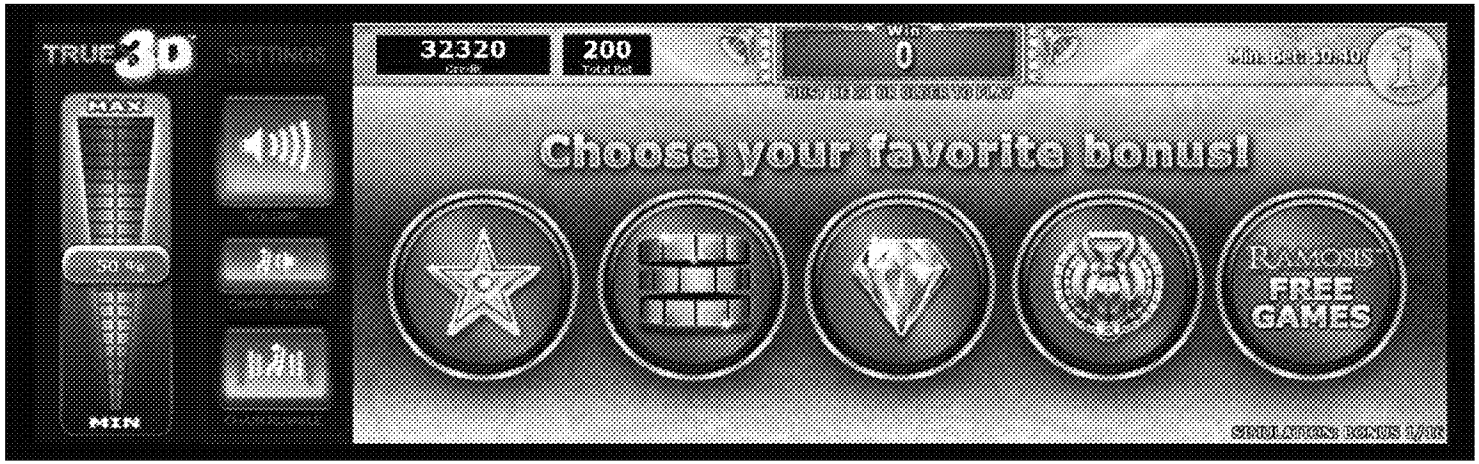
Figure 1G:
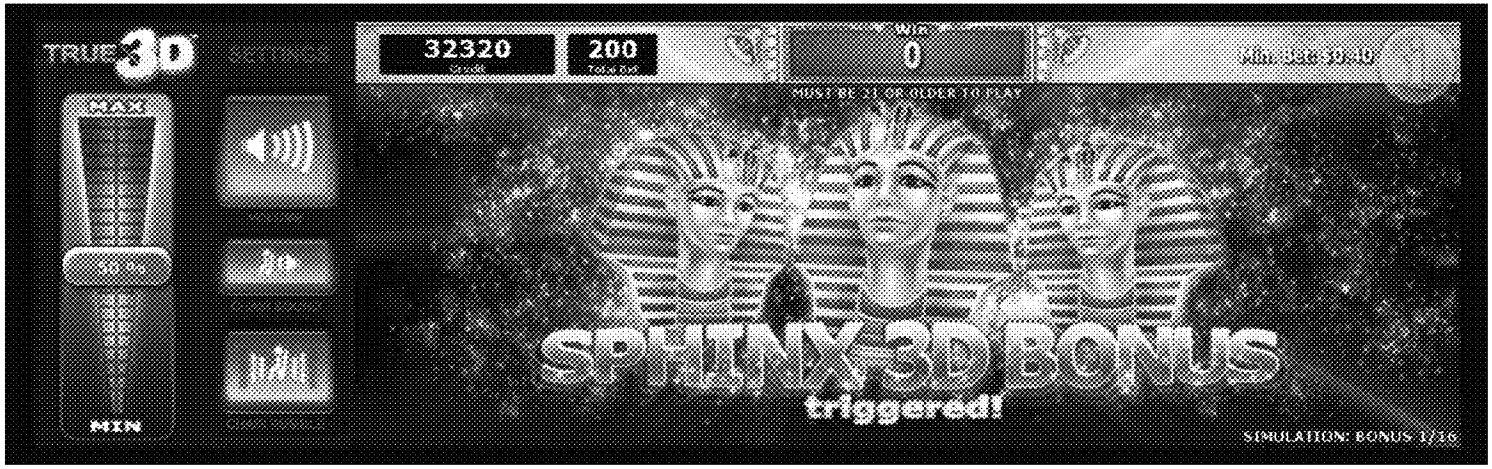
Figure 1H:
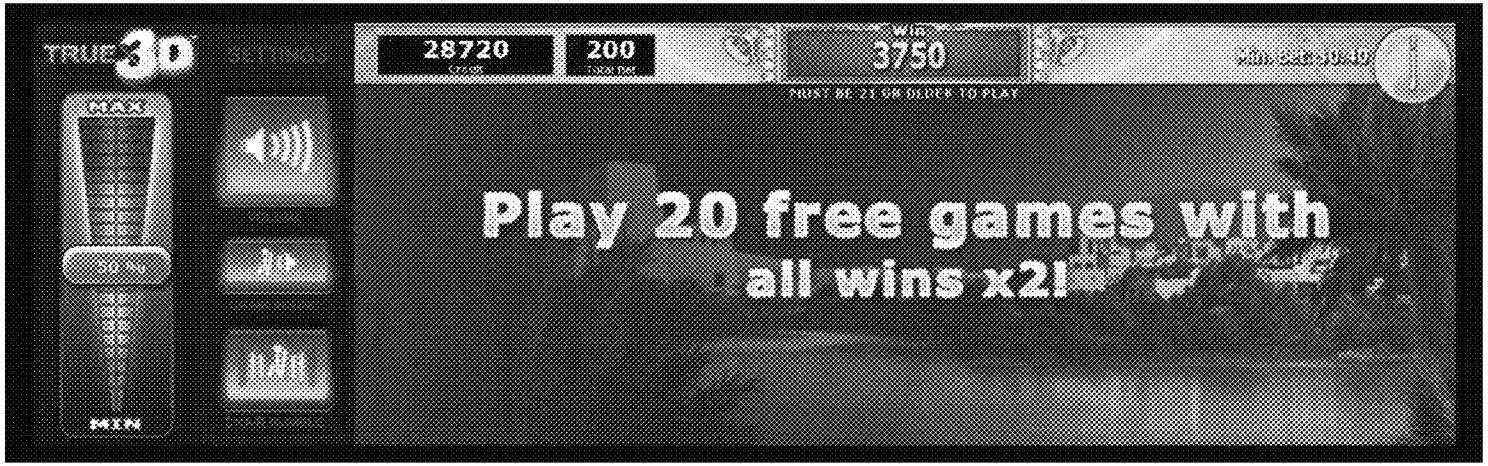

The EGM 10 may also include a digital button panel. The digital button panel may including various elements such as for example, a touch display, animated buttons, frame light, and so on. The digital button panel may have different states, such as for example, standard play containing bet steps, bonus with feature layouts, point of sale, and so on. FIGS. 1E, 1F, 1G, and 1H illustrate example displays for the digital button panel. The digital button panel may include a slider bar for adjusting the three-dimensional panel. The digital button panel may include buttons for adjusting sounds and effects. The digital button panel may include buttons for betting and selecting bonus games. The digital button panel may include a game status display. The digital button panel may include animation. FIG. 1E illustrates the digital button panel for standard game play. FIG. 1F illustrates the digital button panel for selecting a bonus game. FIG. 1G illustrates the digital button panel for camera flight. FIG. 1H illustrates the digital button panel for bonus game play. The buttons of the digital button panel may include a number of different states, such as pressable but not activated, pressed and active, inactive (not pressable), certain response or information animation, and so on. The EGM 10 may also include physical buttons.

The EGM 10 may include frame and effect lights. The lights may be synchronized with enhancements of the game. The EGM 10 may be configured to control color and brightness of lights. Additional custom animations (color cycle, blinking, etc.) may also be configured by the EGM 10. The customer animations may be triggered by certain gaming events.

Figure 2A:
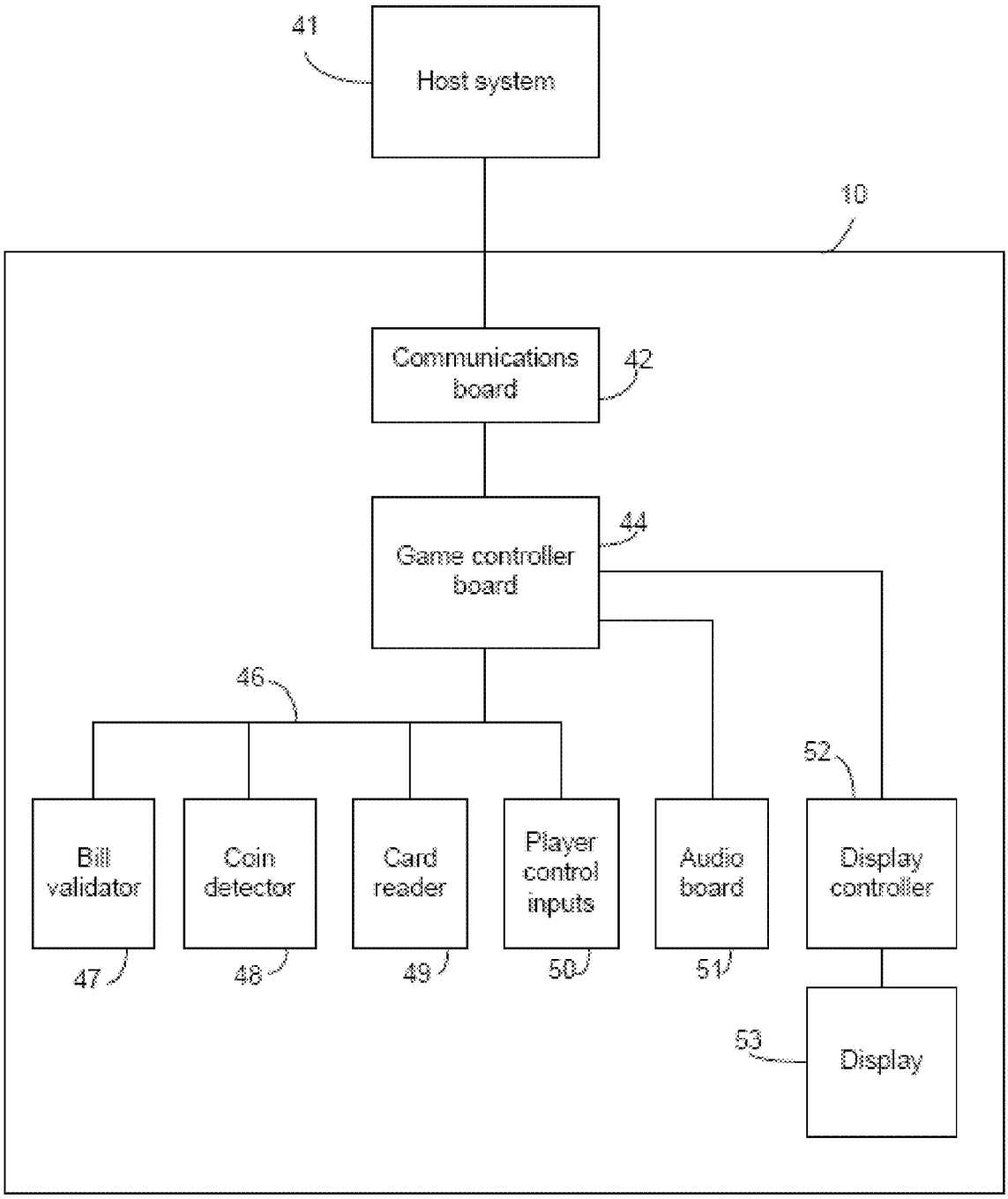
FIG. 2*a* is a block diagram of an electronic gaming machine linked to a casino host system, in accordance with one embodiment.
Figure 2B:
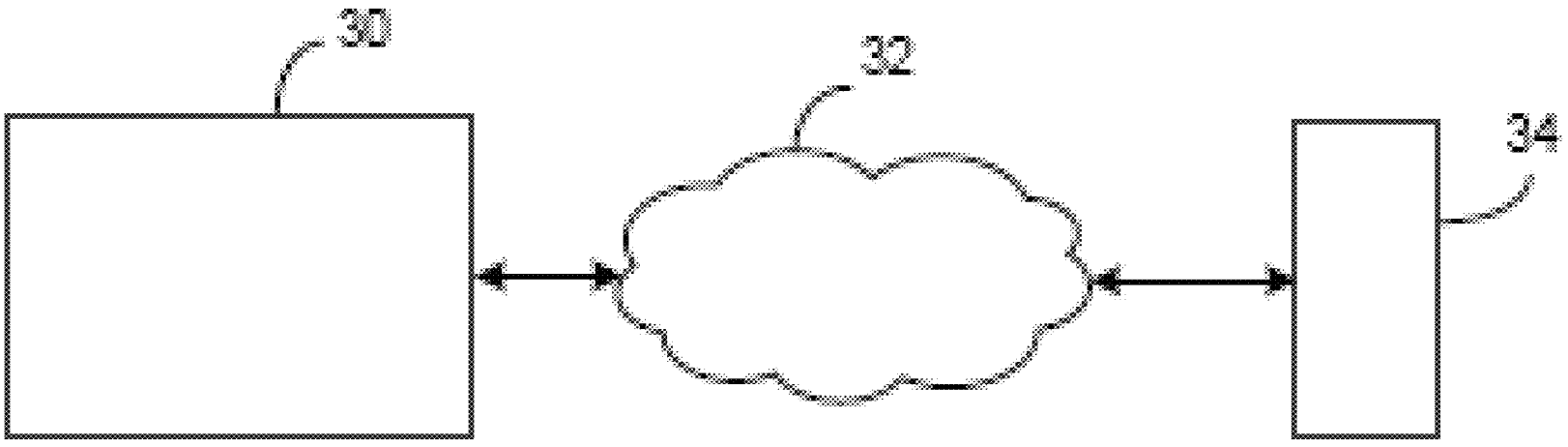
FIG. 2*b* is an exemplary online implementation of a computer system and online gaming system.

FIG. 2*a* is a block diagram of EGM 10 linked to the casino's host system 41. The EGM 10 may use conventional hardware. FIG. 2*b* illustrates a possible online implementation of a computer system and online gaming in accordance with the present gaming enhancements. For example, a server computer 34 may be configured to enable online gaming in accordance with the present invention. One or more users may use a computer 30 that is configured to connect to the Internet 32, and via the Internet 32 to the server computer 34 in order to access the functionality described in this disclosure.

A communications board 42 may contain conventional circuitry for coupling the EGM 10 to a local area network (LAN) or other type of network using any suitable protocol, such as the G2S protocols. Internet protocols are typically used for such communication under the G2S standard, incorporated herein by reference. The communications board 42 transmits using a wireless transmitter, or it may be directly connected to a network running throughout the casino floor. The communications board 42 basically sets up a communication link with a master controller and buffers data between the network and the game controller board 44. The communications board 42 may also communicate with a network server, such as in accordance with the G2S standard, for exchanging information to carry out embodiments described herein.

The game controller board 44 contains memory and a processor for carrying out programs stored in the memory and for providing the information requested by the network. The game controller board 44 primarily carries out the game routines.

Peripheral devices/boards communicate with the game controller board 44 via a bus 46 using, for example, an RS-232 interface. Such peripherals may include a bill validator 47, a coin detector 48, a smart card reader or other type of credit card reader 49, and player control inputs 50 (such as buttons or a touch screen).

The game controller board 44 also controls one or more devices that produce the game output including audio and video output associated with a particular game that is presented to the user. For example, audio board 51 converts coded signals into analog signals for driving speakers. A display controller 52, which typically requires a high data transfer rate, converts coded signals to pixel signals for the display 53. Display controller 52 and audio board 51 may be directly connected to parallel ports on the game controller board 44. The electronics on the various boards may be combined onto a single board.

Figure 3:
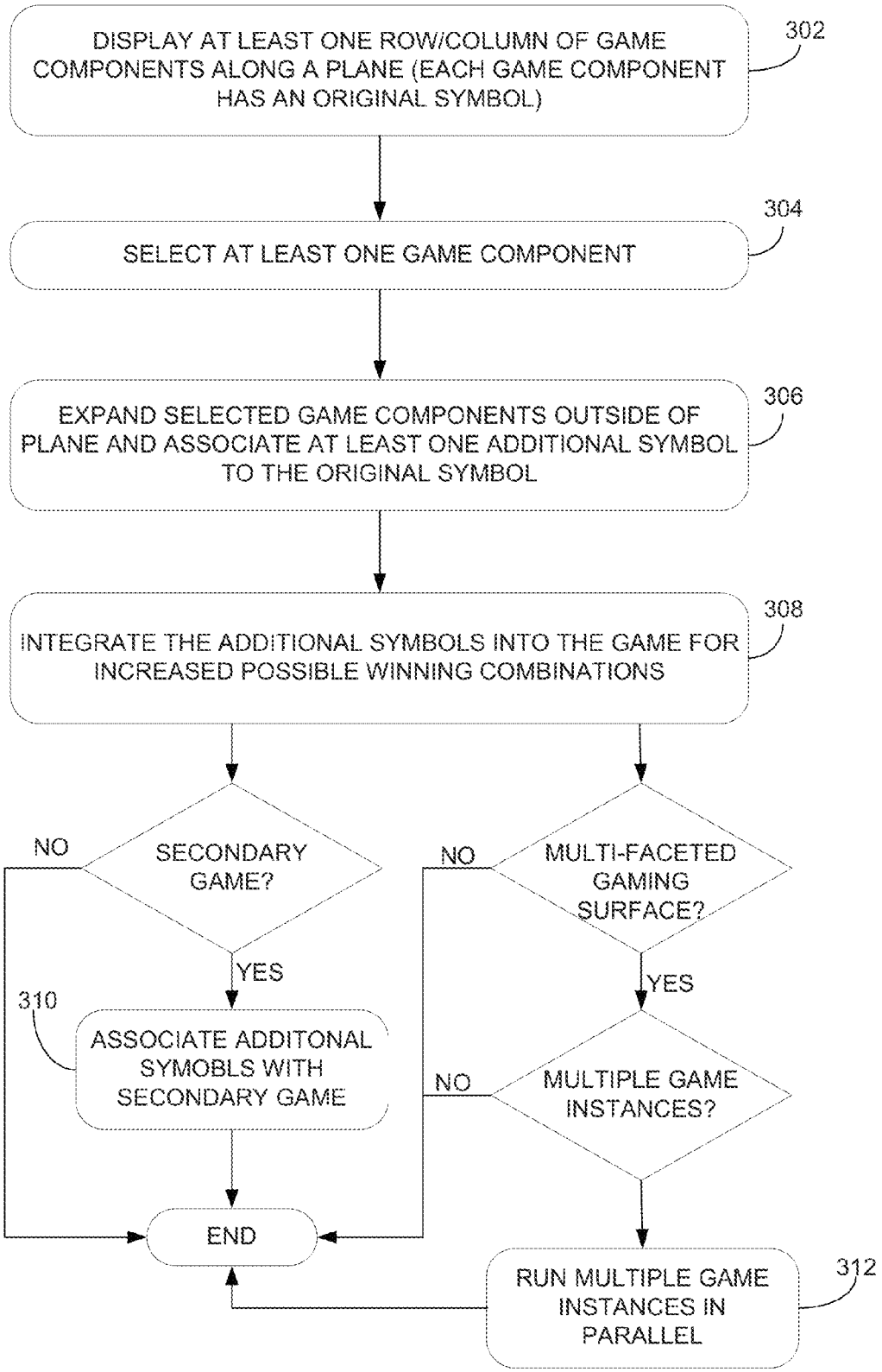
FIG. 3 is a flowchart of an exemplary computer-implemented method for the game component enhancements.

FIG. 3 is a flowchart illustrating an exemplary embodiment for a computer-implemented method for enhancing game components in a gaming system such as that illustrated in FIGS. 1, 2*a*, and 2*b*. In a first step 302, at least one row and/or column of game components are displayed on a display device, such as display devices 12, 14, along a plane, referred to herein as the gaming plane, in accordance with a known configuration for a given game. The row/column may be made up of two or more game components, depending on the game being played. Each game component has a given symbol associated thereto, which will be referred to herein as an original symbol as it represents the game component before any enhancements are provided. At least one game component is selected for enhancement 304 from the plurality of game components displayed. Each selected game component is enhanced by expanding it outside of the gaming plane in which the original symbol was displayed, and at least one additional symbol is associated to the original symbol 306 to form the enhanced game component. The additional symbols are integrated into the game for increased possible winning combinations 308, as will be described in more detail below. In some embodiments, a secondary game is provided in addition to the primary or given game and the additional symbol may be associated with the secondary game 310 in accordance with different gaming strategies and/or configurations.

The enhanced gaming components may be displayed as a three dimensional variant of the original symbol. For example, three dimensional enhancement of the enhanced gaming component may not be limited to a three dimensional version of the gaming component.

In some embodiments, expansion of the selected game components outside of the gaming plane results in a multi-faceting gaming surface. The multi-faceted gaming surface allows multiple gaming instances to be run in parallel 312, if desired. Alternatively, a single gaming instance may be run on the multi-faceted gaming surface.

Figure 4A:
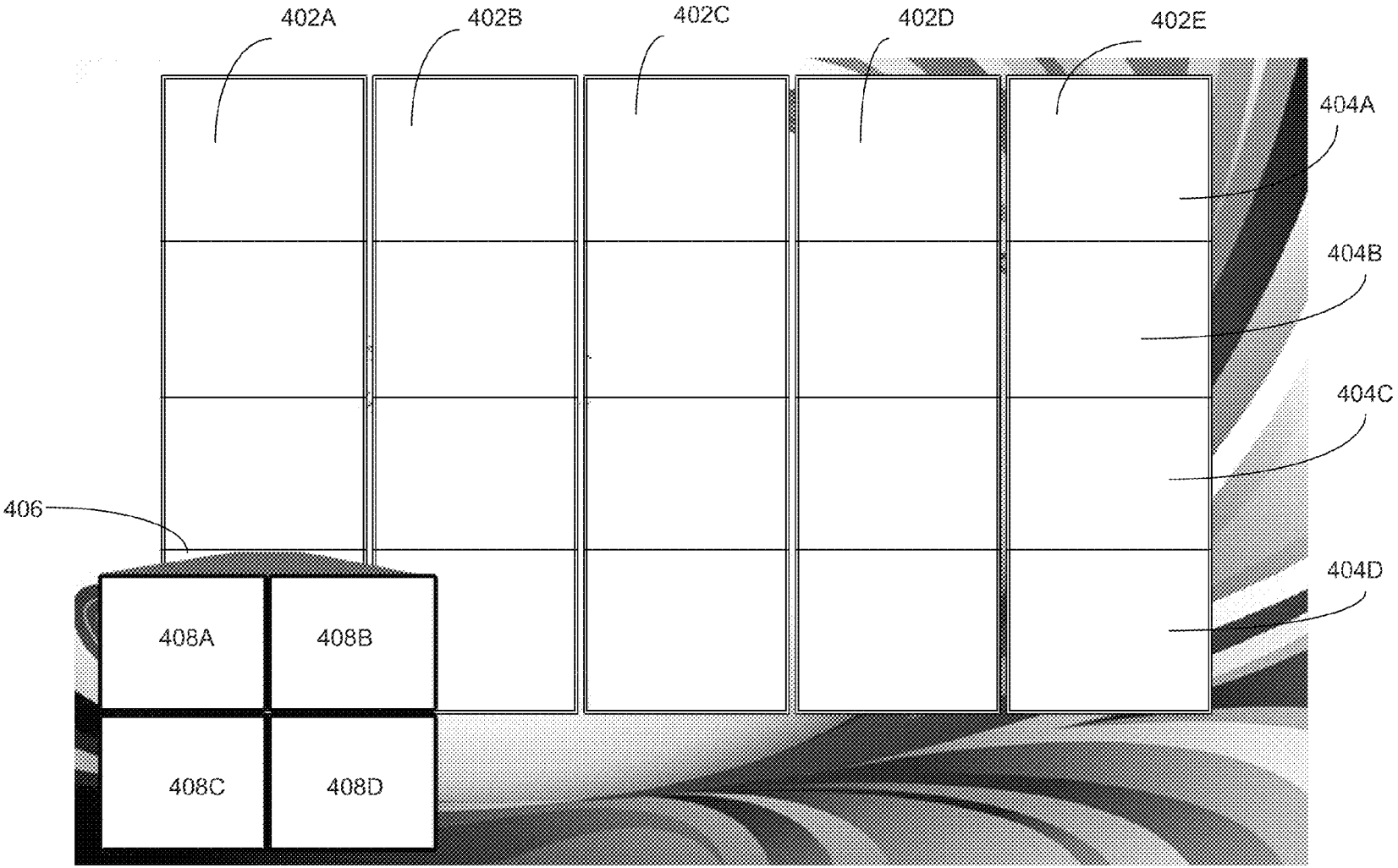
FIG. 4*a* illustrates an exemplary enhancement of a gaming component using an exploded matrix configuration.

FIG. 4*a* is an exemplary embodiment for an enhancement to a gaming component. In this example, a grid of five columns 402*a*, 402*b*, 402*c*, 402*d*, 402*e* and four rows 404*a*, 404*b*, 404*c*, 404*d* is displayed, resulting in 5×4=20 gaming components, illustrated as blank cells. An original symbol (not shown) may be associated with each one of the 20 gaming components in each blank cell. At least one gaming component 406 is selected for enhancement. Gaming component 406 is expanded outside of the gaming plane, formed by columns 402*a*-402*e* and rows 404*a*-404*d*, into a different plane, formed by a 2×2 grid of new cells 408*a*, 408*b*, 408*c*, 408*d*. Additional symbols are provided in new cells 408*a*, 408*b*, 408*c*, 408*d* and integrated into the original game. While the enhancement 410 in this example is illustrated as a 2×2 matrix, it should be understood that the matrix may be n×m and shall be limited in size only by the capabilities of the display screen and/or the ability to incorporate the enhancement 410 into the original game.

In one exemplary embodiment, the configuration of FIG. 4*a* may be a spinning reel game. A win may be obtained whenever matching symbols are aligned vertically, horizontally, or diagonally. Using the gaming component enhancement 410, anyone of the symbols provided in cells 408*a*-408*d* may be matched with neighboring symbols to form a winning combination, thus increasing the odds of winning. In another exemplary embodiment, the configuration of FIG. 4*a* may be a bingo card. Similarly, anyone of the symbols provided in cells 408*a*-408*d* may be used to form a complete row or column and result in a winning combination, thus increasing the odds of winning. Other possibilities for the matrix-type gaming enhancement will be readily understood by those skilled in the art.

Figure 4B:
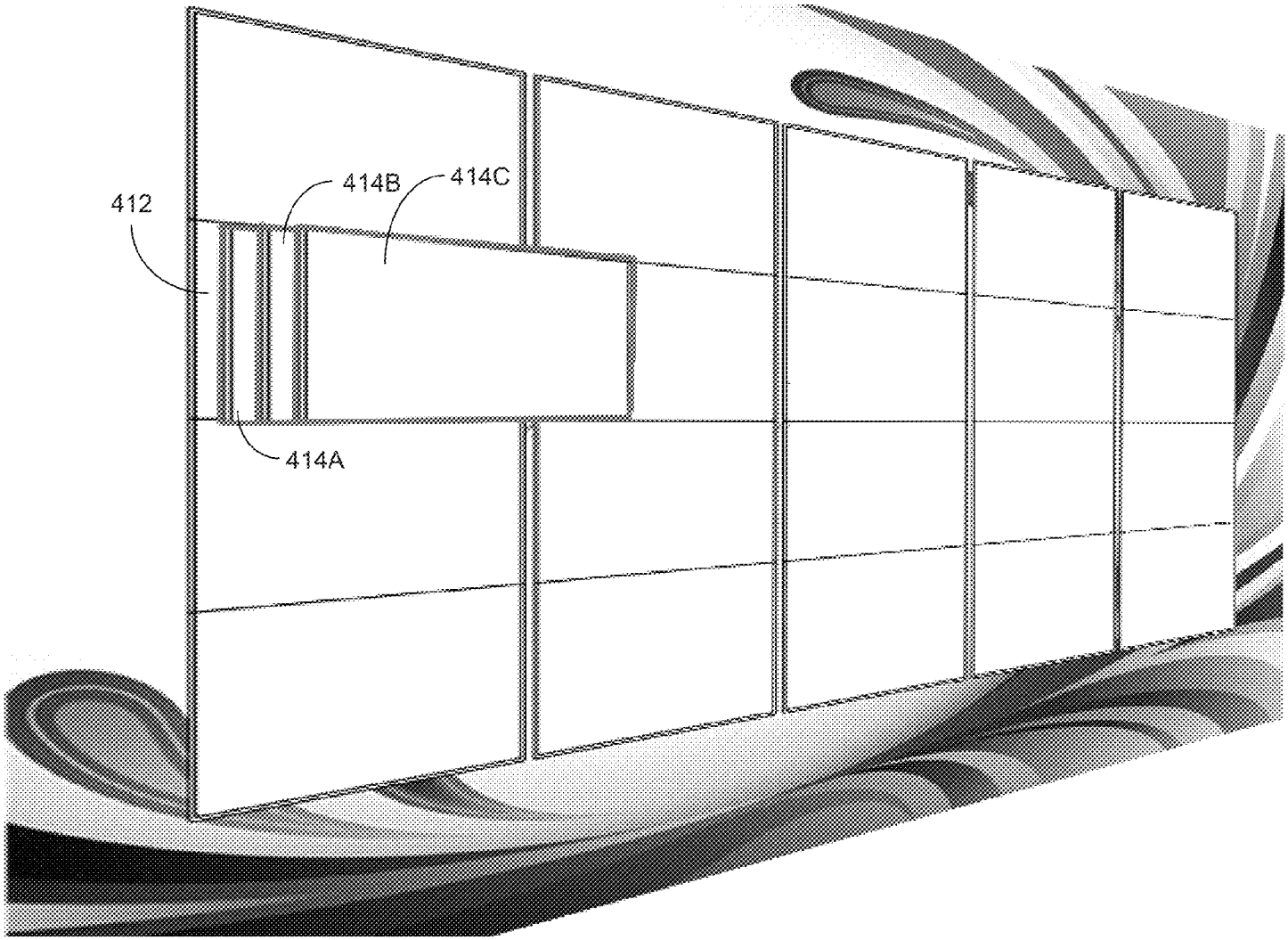
FIG. 4*b* illustrates an exemplary enhancement of a gaming component using stacking of symbols above the gaming plane.
Figure 4C:
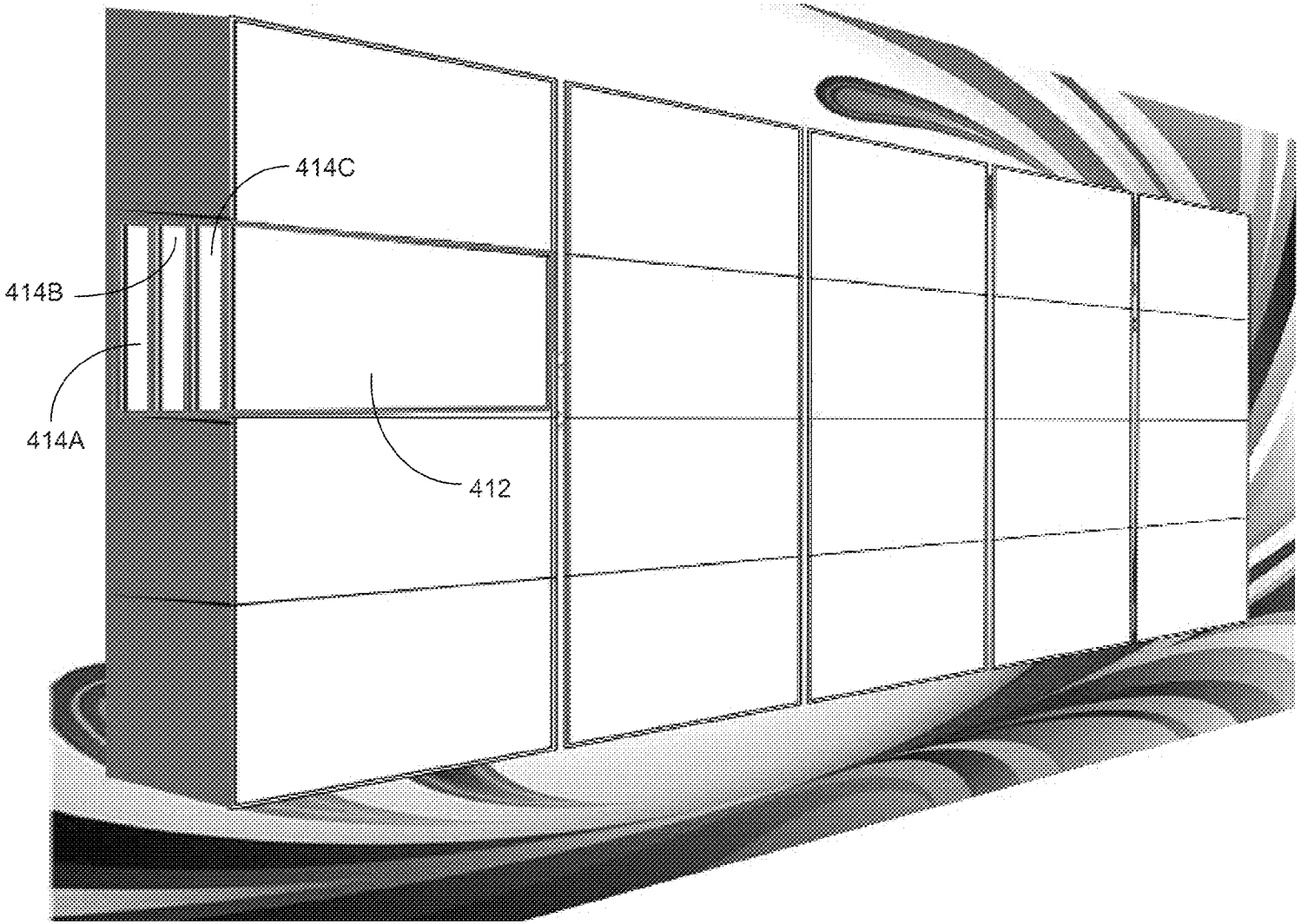
FIG. 4*c* illustrates an exemplary enhancement of a gaming component using stacking of symbols behind the gaming plane.

FIG. 4*b* is another exemplary embodiment for an enhancement to a gaming component. In this example, a selected gaming component 412 is expanded outside of the gaming plane by stacking new cells 414*a*, 414*b*, 414*c* on top of the original symbol. Alternatively, the new cells 414*a*, 414*b*, 414*c* may be stacked behind the original symbol, as illustrated in FIG. 4*c*. In either scenario, various embodiments are possible to integrate the additional symbols provided on cells 414*a*, 414*b*, 414*c* into the original game. For example, in a spinning reel game, anyone of the symbols in cells 414*a*, 414*b*, 414*c* may be used to form a winning combination with neighboring cells. Alternatively, only the top, or visible, symbol may be matched with neighboring cells and as the game progresses, hidden symbols may be discovered and used to further advance the game. In another embodiment, various events in the game, such as a particular winning combination or reaching a threshold of points, may allow the player to see and/or use the additional hidden symbols in addition to the top or visible symbol to form winning combinations. Other scenarios are also possible. In addition, the number of stacked symbols may be more or less than three, as desired.

Figure 4D:
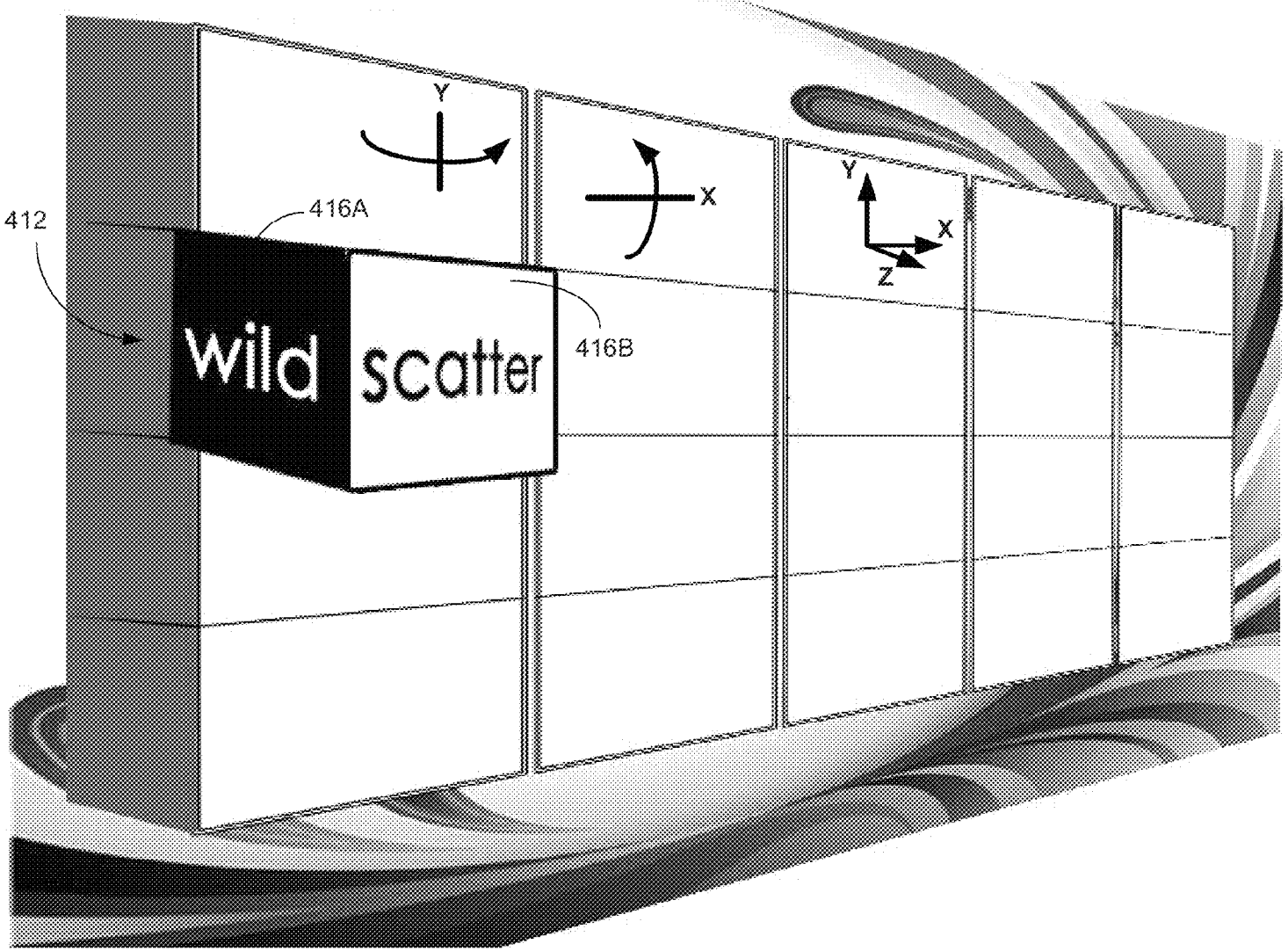
FIG. 4*d* illustrates an exemplary enhancement of a gaming component using a three-dimensional game component.

FIG. 4*d* is an exemplary embodiment for an enhancement to a gaming component whereby expanding the gaming component creates a three-dimensional structure. The single facet gaming component 412 becomes a multi-facet gaming component. Additional symbols may be provided on one or more of the facets of the three-dimensional structure, such as 416*a* and 416*b*. The additional symbols may be used in various ways. For example, in a spinning reel game, as each game component is spun in a single direction, such as about the x axis, the enhanced gaming component may be spun about multiple axes, such as the y axis and/or the x axis, thus resulting in more possibilities for the spinning gaming component. Alternatively, various events in the game, such as a particular winning combination or reaching a threshold of points, may allow the player to freely rotate the multi-faceted gaming component in a desired direction, such that the symbol on the facet that is rotated to the front may be used for a winning combination. The symbols on the facets other than the front may be displayed to the player or hidden from view. Various events in the game may allow hidden facets to be selectively shown to the player. Other scenarios are also possible. While the multi-faceted three-dimensional structure in this example is shown to be a cube, other geometrical shapes are also possible, such as a cylinder, an octagon, and many others.

Figure 5A:
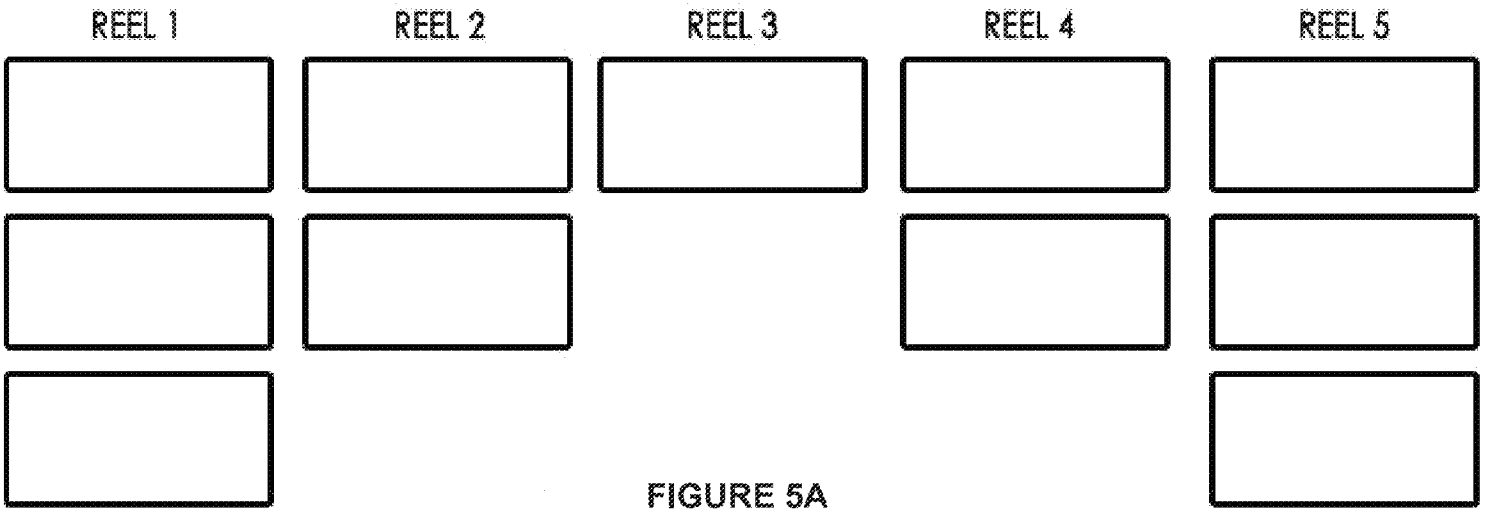
FIGS. 5*a* and 5*b* are top down views of exemplary spinning reels with mirrored configurations using reel stacking.
Figure 5B:
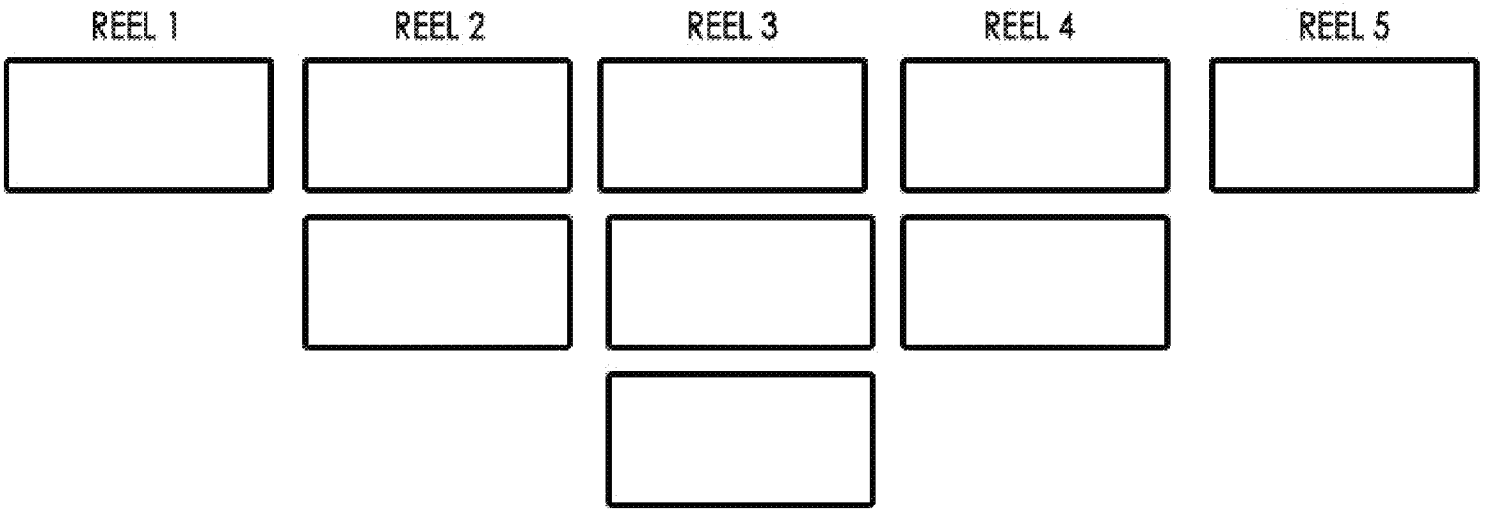

The examples illustrated in FIGS. 4*a*-4*d* show a single gaming component as enhanced. In some embodiments, multiple gaming components on the gaming plane are enhanced, thus creating various effects and three dimensional variants. For example, FIGS. 5*a* and 5*b* illustrate the use of stacking to create a mirrored effect on spinning reels. As viewed from the top down, FIG. 5*a* shows the stacking of reels 1 and 5 three symbols deep, reels 2 and 4 two symbols deep, and reel 3 having a single symbol. FIG. 5*b* shows the stacking of reel 3 three symbols deep, reels 2 and 4 two symbols deep, and reels 1 and 5 a single symbol deep. Various other configurations may be provided using stacked symbols to obtain mirrored or asymmetrical designs. Stacking of symbols may be more or less than three symbols, having the stacks above or below the original symbol. A combination of above and below an original symbol may be used on a same gaming plane.

Figure 6B:
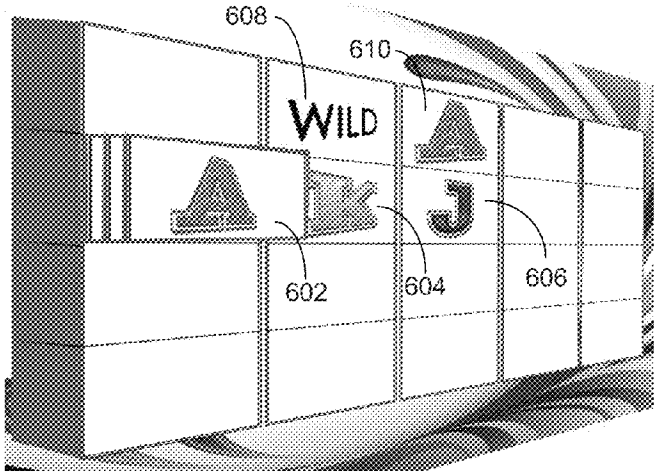
FIGS. 6*a*, 6*b*, 6*c* are an exemplary illustration of cascading of symbols using a stacking concept.
Figure 6A:
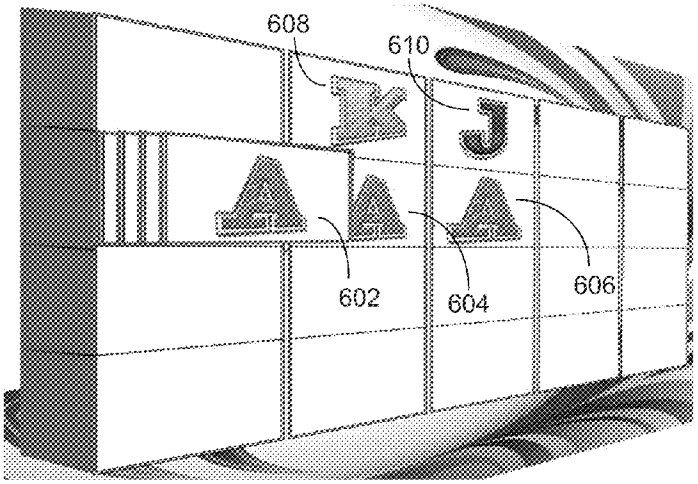

FIGS. 6*a*-6*b* illustrate an exemplary embodiment for game play using the gaming component enhancements, and more particularly the stacking of reels in reel spinning games. In FIG. 6*a*, an Ace on top of reel 602 has four ace symbols stacked under the top Ace symbol (hidden from view). On reels 604 and 606 there are also Ace symbols. These three Ace symbols line up on an active wagered pay pattern to then create an award to the player. The three symbols (top Ace from the stack on reel 602+Ace on Reel 604+Ace on Reel 606) may then remove themselves from the game screen altogether, causing the second stacked Ace on reel 602 to be shown, and a K and J from above reels 604 and 606 respectfully to fall down into the position where the aces on reels 604 and 606 used to be. This is displayed in FIG. 6*b*. The previous positions of the K and J are then filled with new symbols moving down and into the vacant cells. These happen to be a 'wild' and an 'ace' by way of illustrative example.

Figure 6C:
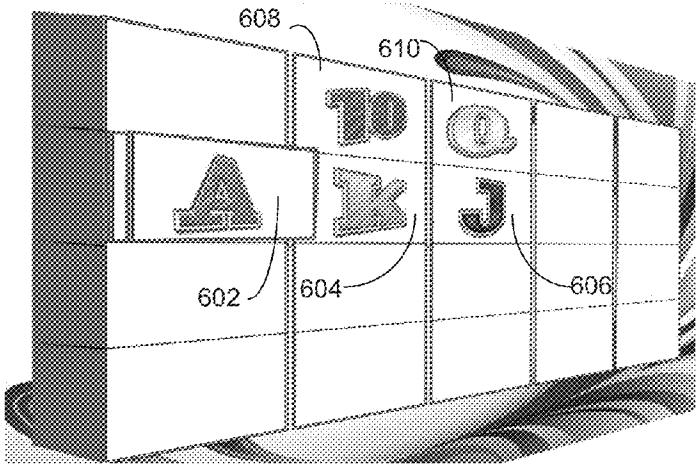

The screen may then be analyzed a second time to see if there are any new winning patterns available after all of the movement and replenishment that happened after the first set of Aces were removed. Since the Ace on reel 602, the Wild on reel 608, and the Ace on reel 610 create another winning pattern, these three symbols are then removed from the game screen. FIG. 6*c* shows the Ace from reel 602 removed from the stack of Aces to leave two in the pile (as two others were used in previous win patterns) and the 10 and the Q on reels 608 and 610 have populated the spots where the Wild and Ace were from the previous win pattern.

Thus, the stacking concept may have a stack of symbols that are either (a) all the same symbol as shown in this example with the stack of Aces on reel 602 or (b) offer a variety of symbols stacked on the position. Instead of a full stack of Aces only on reel 602, it could have been a stack of Ace, K, Q, J, 10, etc, in that position (not shown). The stack doesn't have to have same symbol only characteristics or even consecutive symbol characteristics. The stacked symbols may be a random set of symbols. Removing or eliminating symbols from the stack based on winning patterns that involve the stack may lead to other winning patterns. In the embodiment illustrated, the game screen replenishes to allow for the chance at consecutive wins happening, depending on new symbols that replenish the screen.

Figure 7:
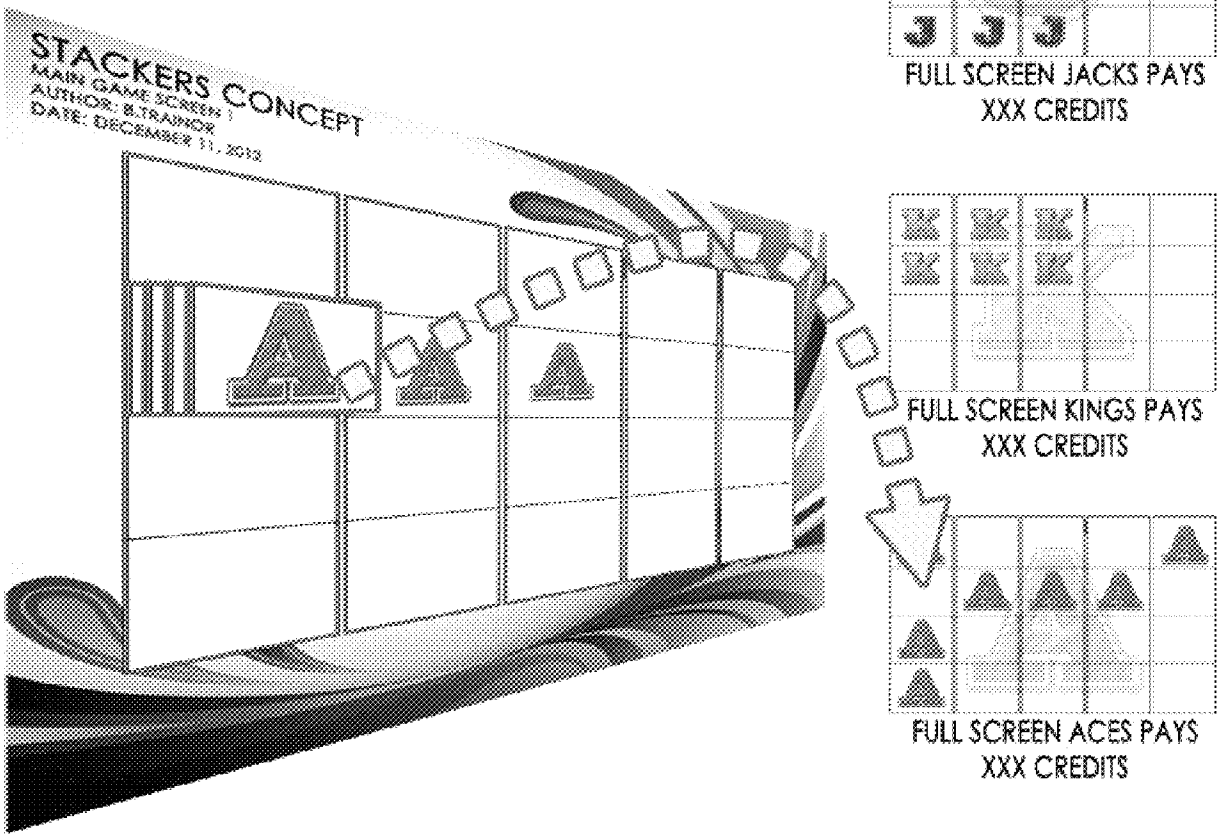
FIG. 7 is an exemplary illustration of associating additional symbols with a secondary game.

FIG. 7 illustrates an exemplary embodiment for using the stacked symbols for the purposes of a secondary game. In this example, the player may interact with the additional symbols and displace them onto one or more secondary game screens. For example, collecting symbols such as Aces, Kings and Jacks may provide additional credits when a given number of these symbols are collected. Alternatively, the symbols may be displaced onto the secondary game screens automatically, without player interaction. Other manners of integrating the additional symbols into a secondary game may be used. The secondary game may be used to trigger a bonus game, for example. The secondary game may also include three dimensional enhancements.

Figure 8A:
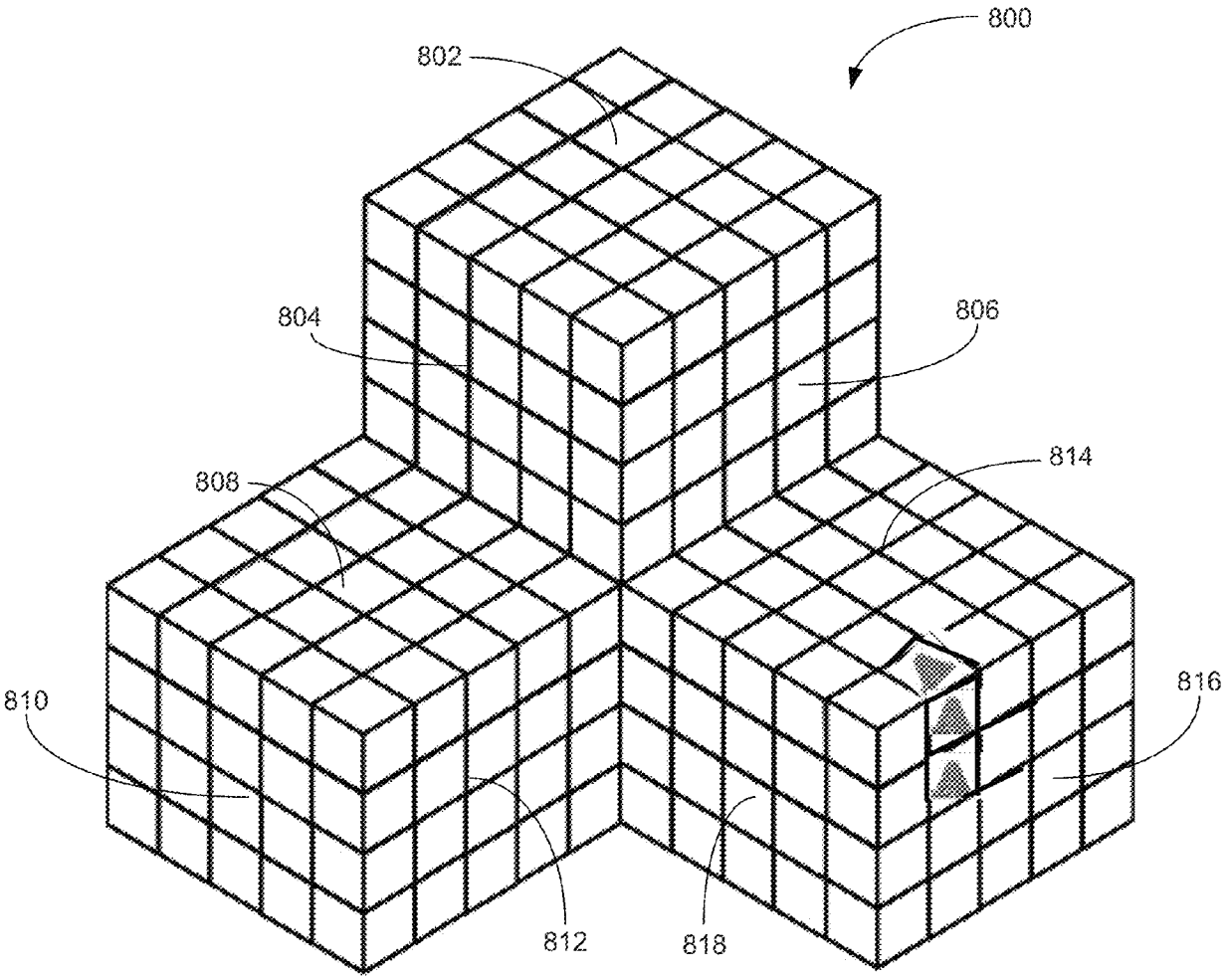
FIG. 8*a* is an exemplary embodiment of a three-dimensional multi-faceted gaming surface.

As indicated above, enhancing the game components may lead to the creation of three-dimensional structures. In addition to three-dimensional game components as illustrated in FIG. 4*d*, the entire gaming surface may be transformed into a multi-faceted structure. FIG. 8*a* is an exemplary embodiment of such an enhancement. The three-dimensional structure 800 comprises nine different surfaces 802, 804, 806, 808, 810, 812, 814, 816, and 818. Each surface may be used as an individual and separate playing surface, thus allowing multiple gaming instances to be run simultaneously. Alternatively, the surfaces may all be used as part of a same gaming instance, with winning patterns overlapping from one surface to another via neighboring cells. For example, one Ace on surface 814 and two Aces on surface 816 may form a winning pattern.

Figure 8B:
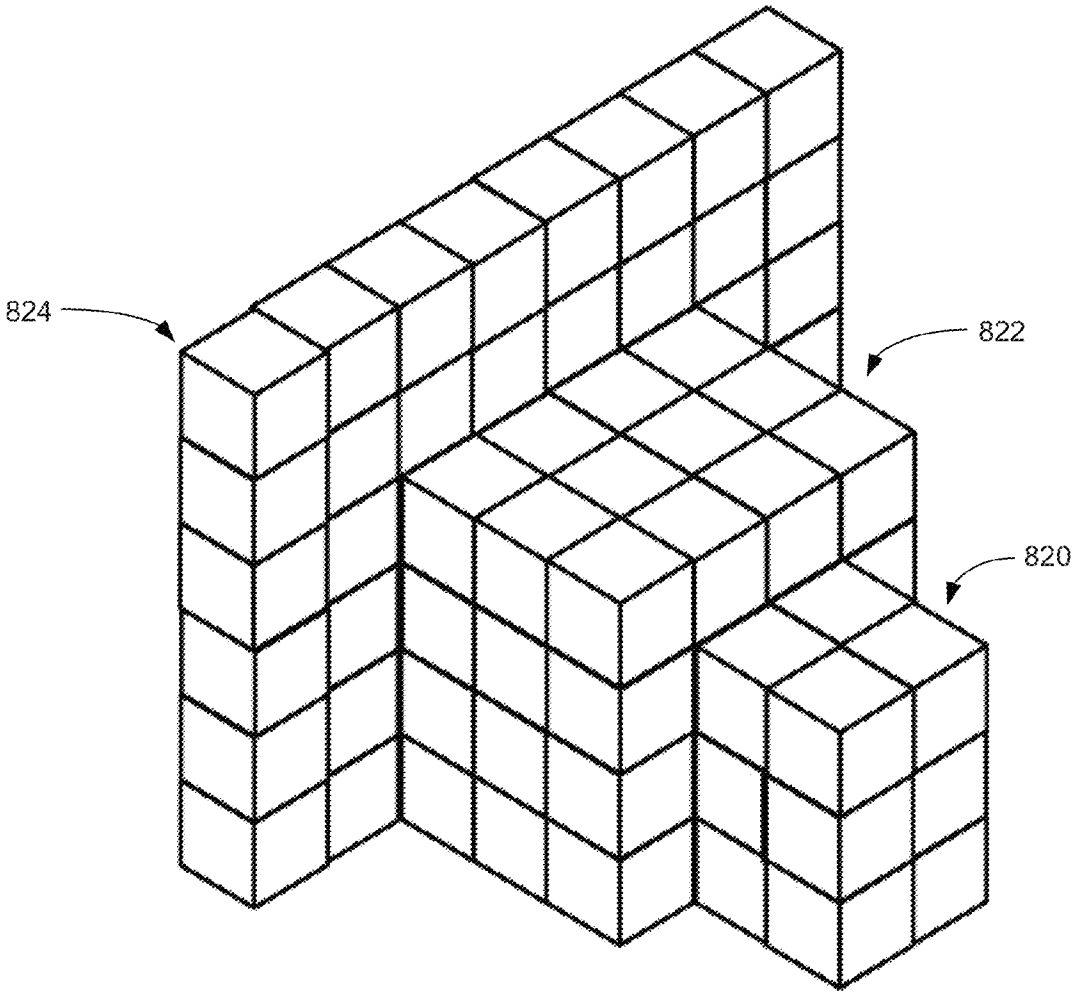
FIG. 8*b* is an exemplary embodiment of a three-dimensional layered gaming surface.

Other configurations for the gaming area are also possible, as illustrated in FIG. 8*b*. In this example, multiple layers 820, 822, 824 are provided to a gaming surface. In one exemplary embodiment, once the player has a group of symbols that are all 'like' symbols, they may be removed off of the game board. Once the first layer 820 of the game board has been removed, the next layer 822, which may be a different size and/or shape, is then available to play on. For example, the layers may go from a 5×3 to a 5×4 to a 5×5. Other sizes and shapes for the stacked layers may also be used.

Figure 8C:
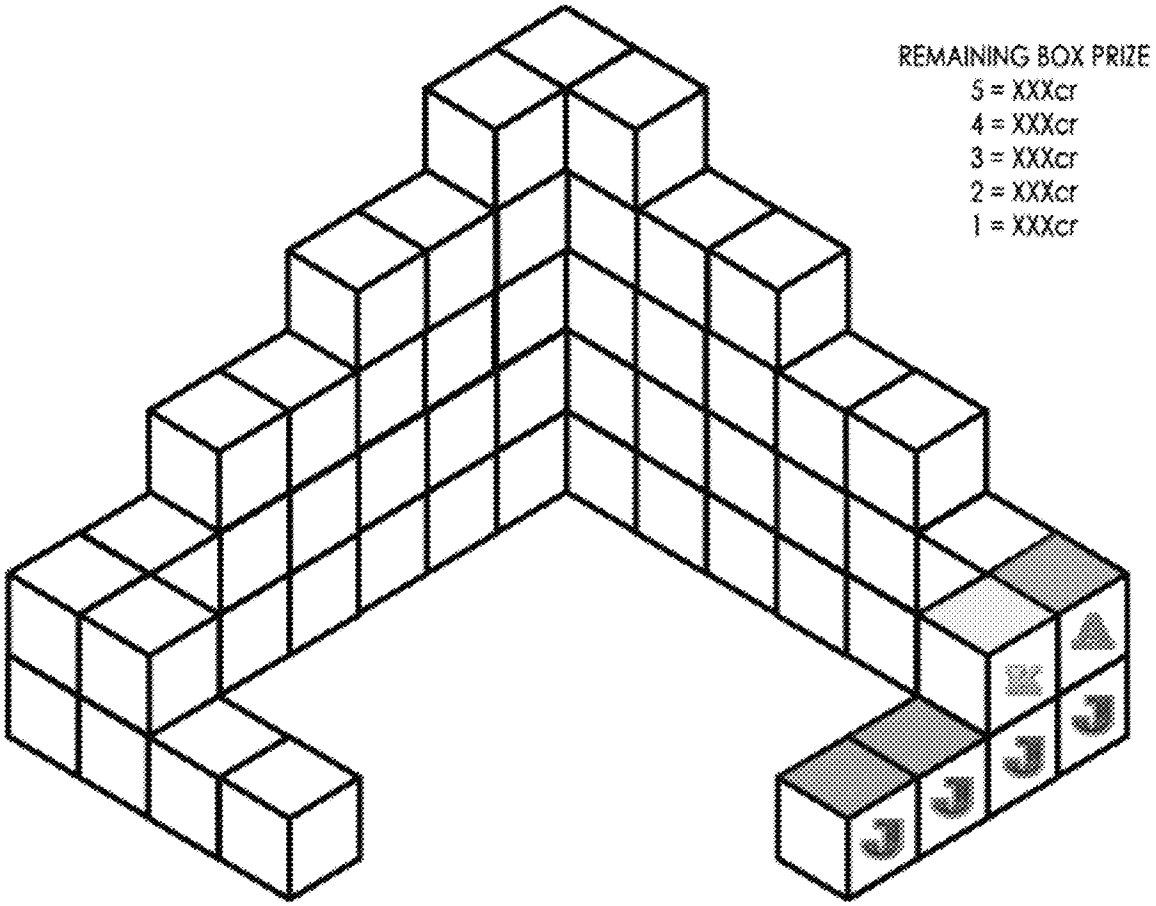
FIG. 8*c* is an exemplary embodiment of a three-dimensional gaming surface with matching symbols.

FIG. 8*c* is yet another exemplary embodiment for a three-dimensional, multi-faceted structure when enhancing game components. As shown, the structure is not specific to standard 5×3 or 5×4 video reel presentations of a slot-type game. It can be applied to any type of game matrix. The win patterns and pay categories do not have to have actual physical and traditional lines and patterns as seen in a 5×3 or 5×4 video reel matrix. Grouping of like symbols may create various pay categories, as long as like symbols are touching each other on one of the facets. A game mechanic like symbol elimination may be applied, where the player is hoping to have groups of the like symbols disappearing off of the game screen and depending on the number of symbols left, there could be a prize associated. For example, if five symbols are left, the prize may be 25 credits but if there was a single symbol left, the player would be paid 1000 credits.

While illustrated in the block diagrams as groups of discrete components communicating with each other via distinct data signal connections, the present embodiments may be provided by a combination of hardware and software components, with some components being implemented by a given function or operation of a hardware or software system, and many of the data paths illustrated being implemented by data communication within a computer application or operating system. The structure illustrated is thus provided for efficiency of teaching the present embodiment. The hardware components are configured to provide practical applications of innovative computerized gaming features. The hardware components are configured to provide physical transformations by, for example, transforming the display on gaming screen with three dimensional enhancements.

The concept of enhanced game components may be applied to known game mechanics in multiple ways. For example, Wild cards may be placed one on top of each other to create a depth showing multiple wilds in one spot resulting in awarding of the same line multiple times. Wilds may have a multiplier attached to each of the layers in the depth, for example, the front one is worth lx, the second level is worth 2×, the third level is worth 3×, etc. Surrounding Wilds may be used by offering a layer above a regular reel set that would allow for wilds to be created when reels stop (i.e. any symbol landing would have the opportunity to become wild). This allows for depth to the surrounding wilds. For games that may have a match functionality, it would allow for chunks of wilds and symbols to pay. In some embodiments, Wilds may stay in place until it is awarded. This would allow for the wild to grow in size allowing for either: multiplier attached to the wild; additional wilds stacking up and growing on the spot; or physically growing outwards on the Z axis onscreen.

Scatters may be used in a stacked configuration as well. Scatters may be placed on top of each other to create a depth showing multiple scatters in one spot, resulting in an award for a collective number of scatters. Scatters may also have a multiplier attached to each of the layers in the depth, for example, the front one is worth lx, the second level is worth 2×, the third level is worth 3×, etc.

The third dimension provided by the enhanced game components may act as a portal or hole into the game (e.g. base game, secondary game, bonus game), given access to a bonus round or an additional win category. Symbols may appear with multiple layers and players may collect symbols and place them one on top of another in a single space. Three-dimensional stacks may be formed by allowing for symbols to be stacked not just on the vertical but also in the third (z) axis, allowing for depth to the normally viewed stacked symbol.

The game component enhancements allow for chunks of symbols that are spanning the vertical space of the reel to also have a back expansion area that causes a 'block' effect. It allows for chunks of symbols that are spanning the horizontal space of the reel to also have a back expansion area that causes a 'block' effect. It may also allow for depth on certain reels to create a new pattern of the physical game grid dimension.

Triggers may be modified using the game component enhancements. Such triggers may include, for example, consecutive triggers (on or outside of a reel), scatter, and trigger tiles. Triggers may lead to various events, such as additional credits, additional payouts, secondary games, bonus rounds, etc. Trigger tiles may be placed on any reel shape/dimension as desired, as a triggering mechanism. Multiple layers could be applied to this triggering mechanism as well. Pay ways may also be modified, as the enhancements allow for multiple games to be played in the same space. Shapes of lines wins may be collected to create a full screen pattern of extra prizes. Different layers with different line sets may be played all at once.

The game enhancements may be applied to multiple environments, such as Keno, 3D game grids, Player User Interfaces (PUI), Greenball (as described in U.S. application Ser. No. 13/631,129, the contents of which are hereby incorporated by reference), and many others. For Keno, multiple balls may be placed on a same number. One screen may be provided with layered effects. For 3D game grids, a 'cube' effect may be created, where the player can interact with the cube to 'spin' it to reveal an additional bonus prize. The enhancement offers a position to expand outwards to create a multiple symbol container. It also offers multi-levels, different matrices, games that become available during bonus rounds as special features activate the exterior, or multiple games to be wagered upon. Multi-facet game boards (i.e. with a matrix on different angles) are also possible.

Bonus types are also enhanced via the game component enhancements. For example, multiple free games may be played in a layered style. This allows for symbols that land one in front of another that match to create some sort of super win/super symbol that spans in depth and possibly in height, if synchronized reels are used. In a picking screen for picking a prize, the player may grab and drag the 3D object and reposition it on the screen. Progressive posts may get physically larger and expand outwards to show the player that they are getting closer to being awarded, and/or larger in value.

The user interfaces, computer implemented methods, and computer system components described may be used in connection with a variety of different games that are pattern games or that include pattern game components.

Various functions or features described in this disclosure may be implemented as part of different gaming systems. For example: (A) The winning enhancements may be implemented as part of a game to system (G2S) system or three dimensional game system. (B) As previously stated, the user interfaces, computer implemented methods, and computer system components described herein may be used by an EGM. (C) In the event the game is a lottery game, the game computer may be an in-store gaming system or a gaming kiosk. For lottery games including the enhancements to the game components, the host system may be controlled by a government agency.

As described herein, a third dimension may be provided by the enhanced game components. Three dimensional enhancements may be provided as a primary game (or base game), secondary game or a bonus game in some embodiments. Motion tracking data for the player received via camera may be used to update and modify the three dimensional enhancements, for example. Head and body movements of the player may control aspects of the game.

In some example embodiments, the number of bonus choices may be proportional to the size of the bet, or average bet. The number of features may also be proportional to the size of the bet, or average bet.

Three dimensional enhancements may be provided as dynamic content, where bonus selection and other gaming features will display differently from one trigger to the next. The three dimensional enhancements provide variety in primary and bonus game types to appeal to a broad player demographic.

A bonus game may include progressive levels and may be of a different game type than the primary game, including new symbols and rules. There may also be hidden features within the game.

The game may be a tile based game where different lines shapes of corresponding tiles provide may be associated with different winning amounts for the game.

Three dimensional enhancements may be used for various game features. For example, there may be a three dimensional enhancement for a trigger symbol, a base game, a tension spin, a large or medium win, a bonus game, a bonus game choice entry, help functionality, introduction to game, and so on.

An example flow for a game with three dimensional enhancements may include a base game with bonus or hidden features. There may be a trigger within the base game to launch a bonus selection game level where the player can select a bonus game from multiple choices. There may be a short description for each bonus game. The amount of bet or average bet within the base game may be proportional to the number of bonus game choices. For example, a higher bet may increase the number of bonus games to select from. The bonus games may be different types of games. The base game may also be a different type of game.

Figure 9:
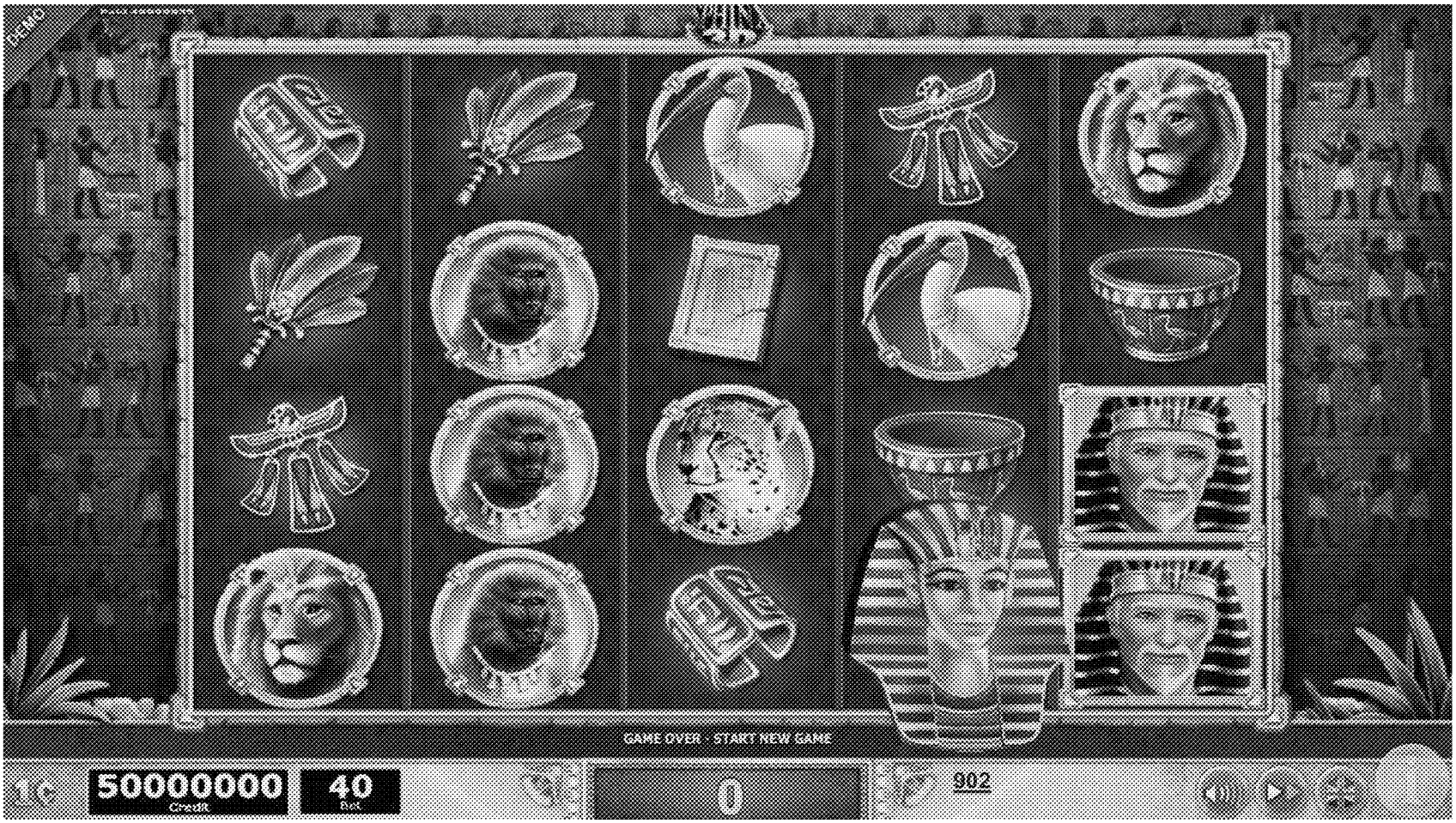
FIG. 9 is an exemplary embodiment of a three-dimensional enhancement on a gaming surface.

FIG. 9 is an exemplary embodiment of a three-dimensional enhancement on a gaming surface. The game may be a base game. In this example, the game may be a grid of five columns and four rows resulting in 20 gaming components, illustrated as cells, where each cell is associated with a symbol. A gaming component 902 may be shown with a three-dimensional enhancement and expanded in the z direction of the xy gaming plane. The grid may be the end result of a reel spin game where different lines of symbols result in different winning combinations. After the reel spin game stops winning line combinations are determined and the players credits may increase according to the win amount allocated, if any. A gaming component 902 may animate in three-dimensions to trigger a bonus. The enhanced gaming component 902 may have an increased win value or may increase the winning value of a line combination.

Figure 10:
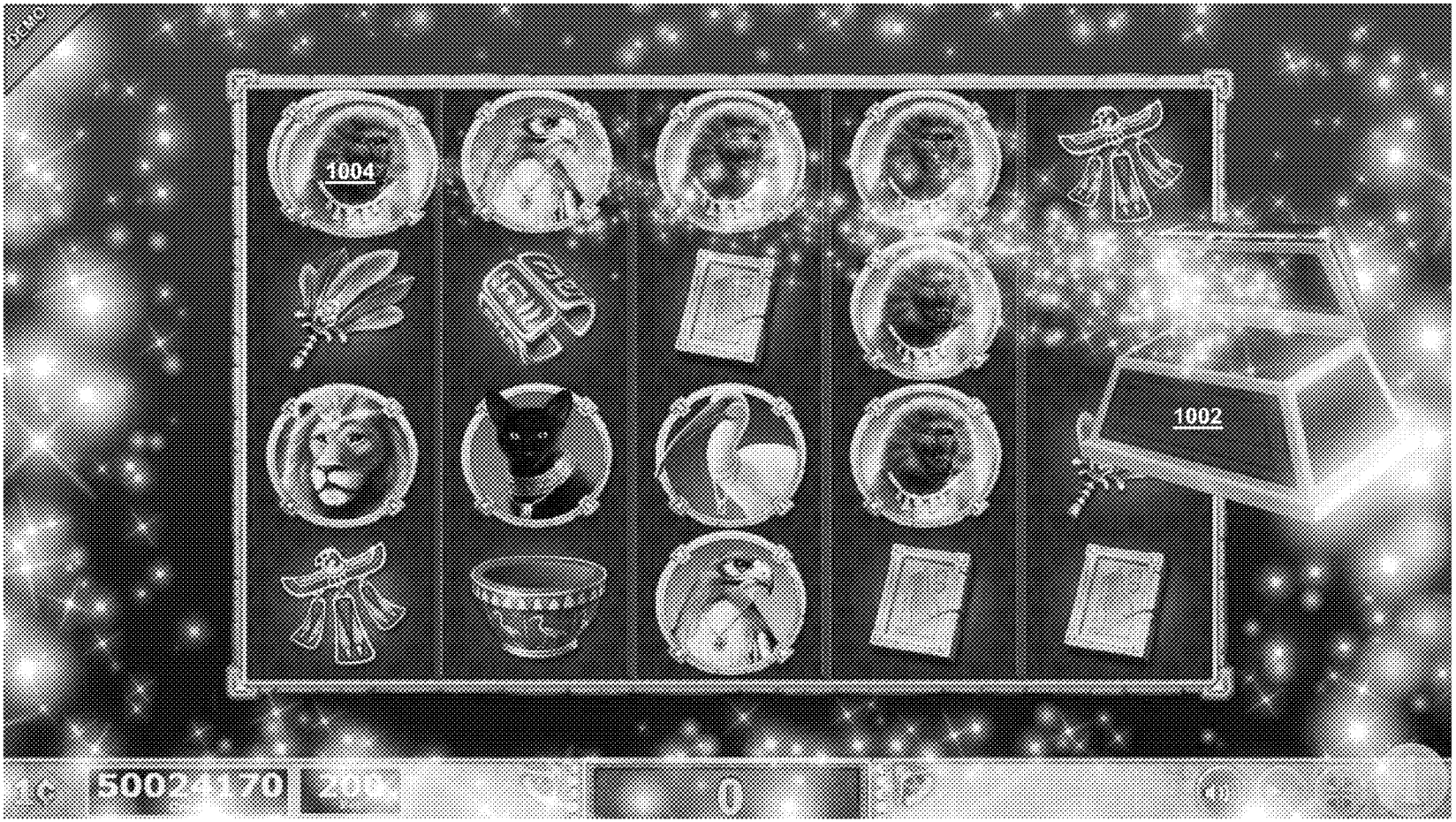
FIG. 10 is an exemplary embodiment of a three-dimensional enhancement on a gaming surface.

FIG. 10 is an exemplary embodiment of a three-dimensional enhancement on a gaming surface. In this example, a game component 1002 shown in the grid may trigger a bonus feature. The bonus feature may trigger additional gaming components 1004 from being stacked on top of other displayed gaming components, or an animation. This may impact payout such as an increase of the win amount of the gaming component. The three-dimensional enhancement may be a variant of the original game or symbol and is not limited to a three dimensional version of the symbol.

Figure 26:
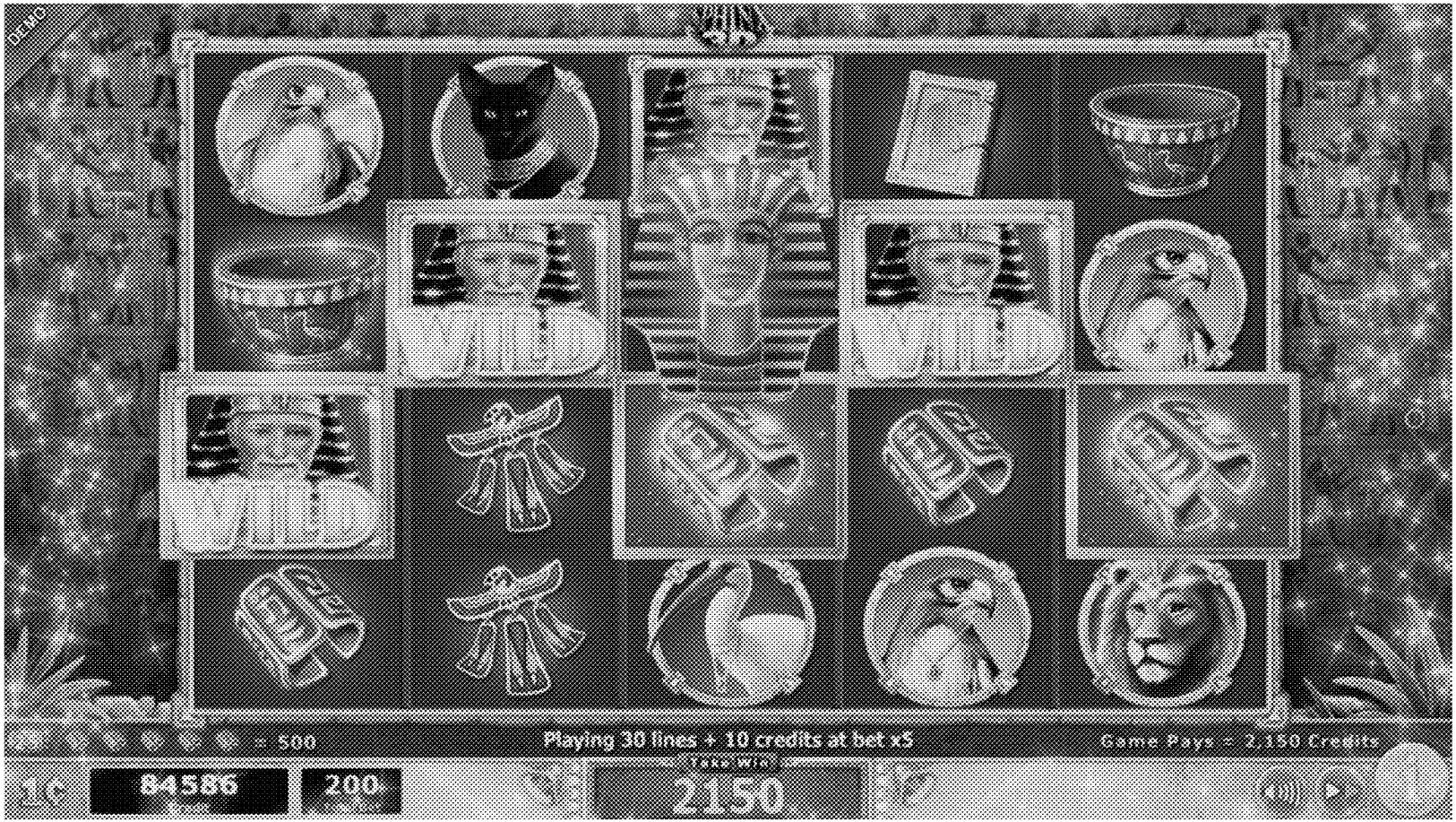
FIG. 26 illustrates an example base game shown as a reel type game.
Figure 27A:
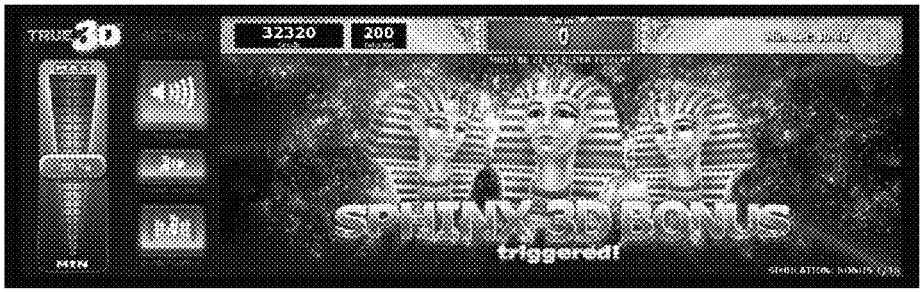
FIGS. 27*a* to 27*e* illustrate example bonus trigger screens.
Figure 27B:
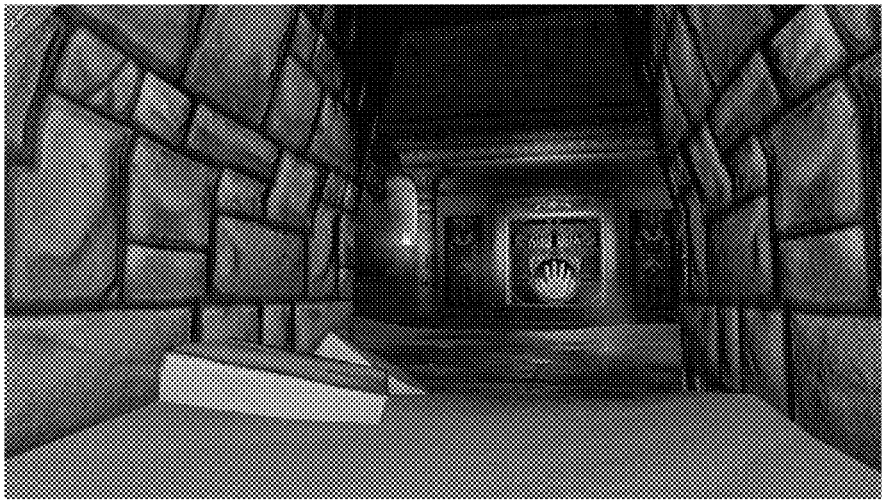
Figure 27C:
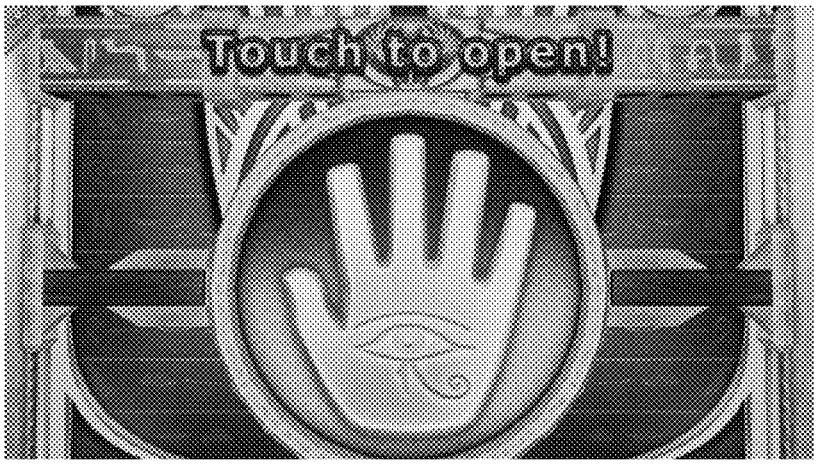
Figure 27D:
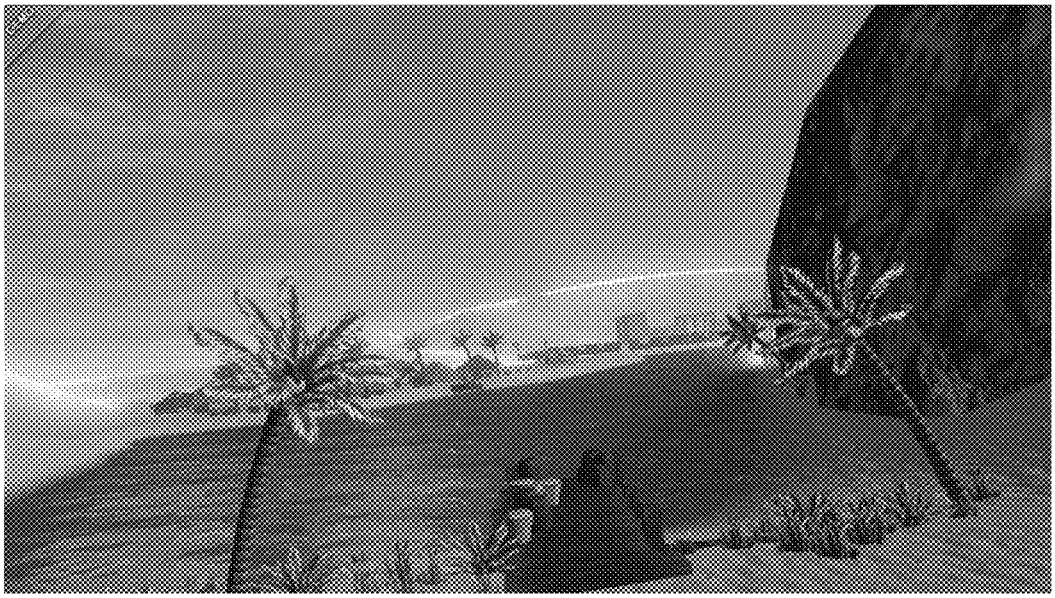
Figure 27E:
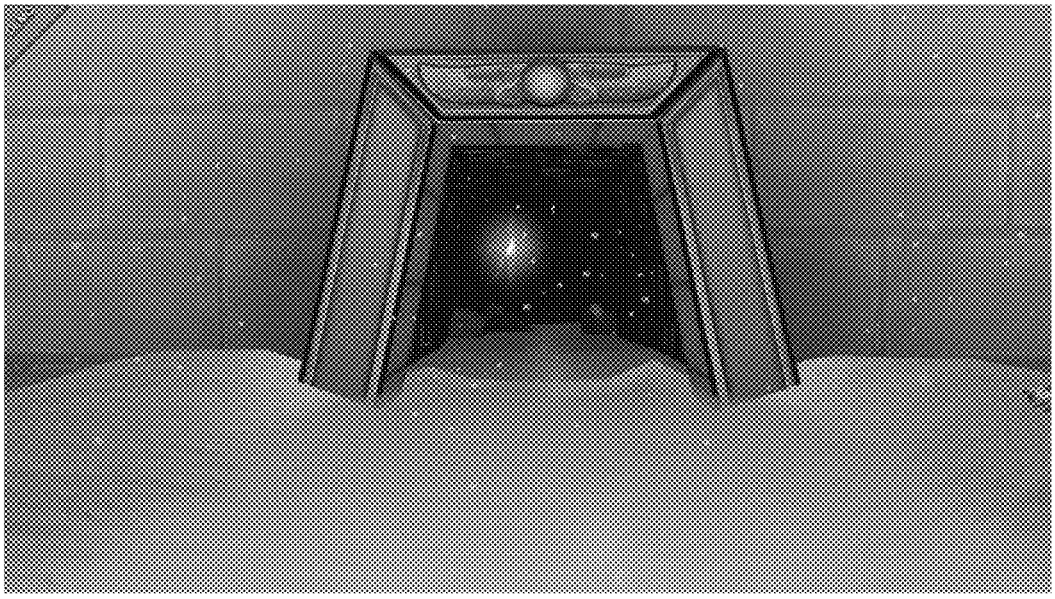
Figure 28A:
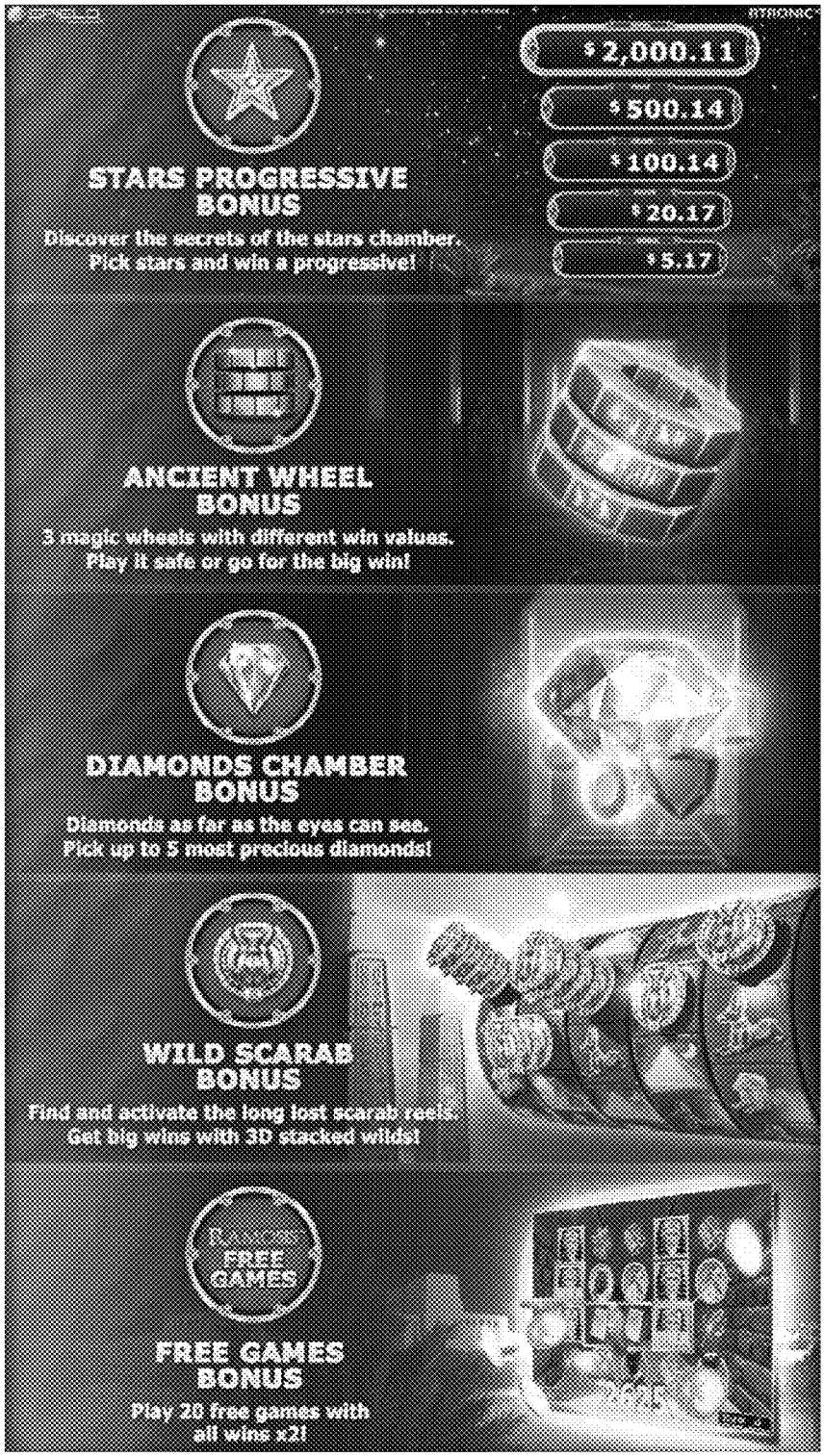
FIGS. 28*a* to 28*d* illustrate example bonus selection screens.
Figure 28B:
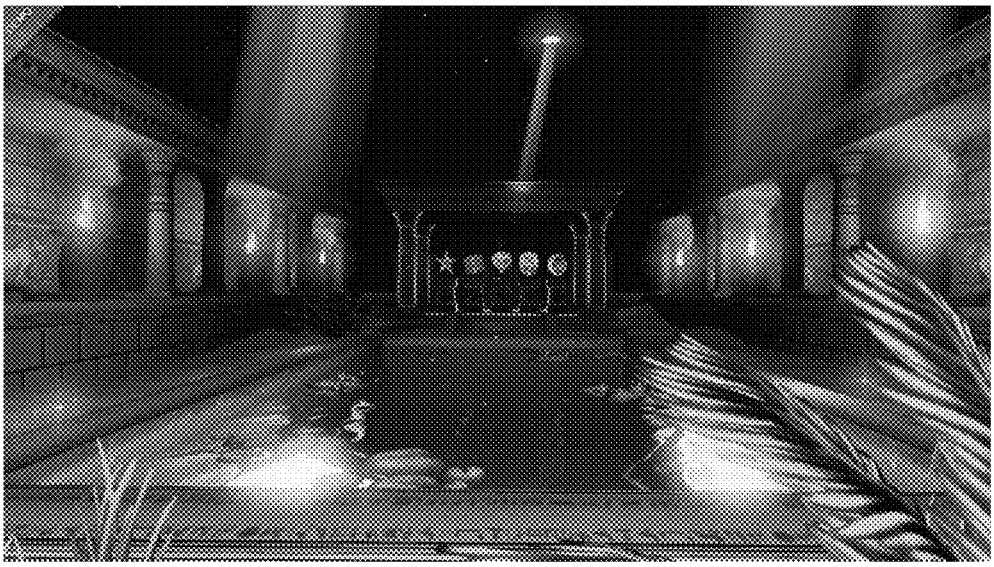
Figure 28C:
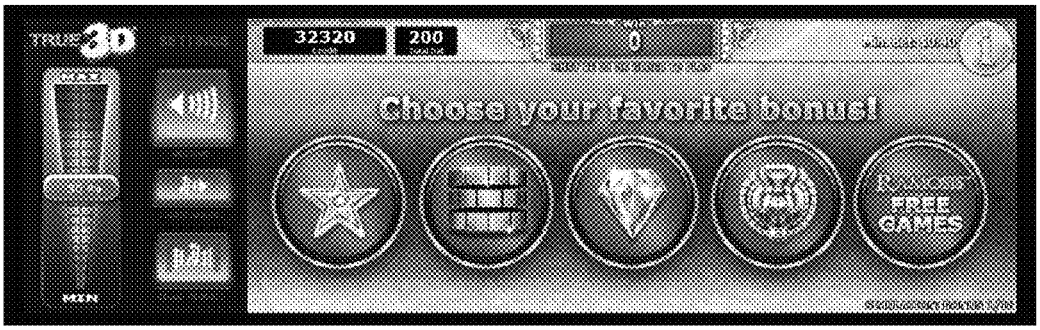
Figure 28D:
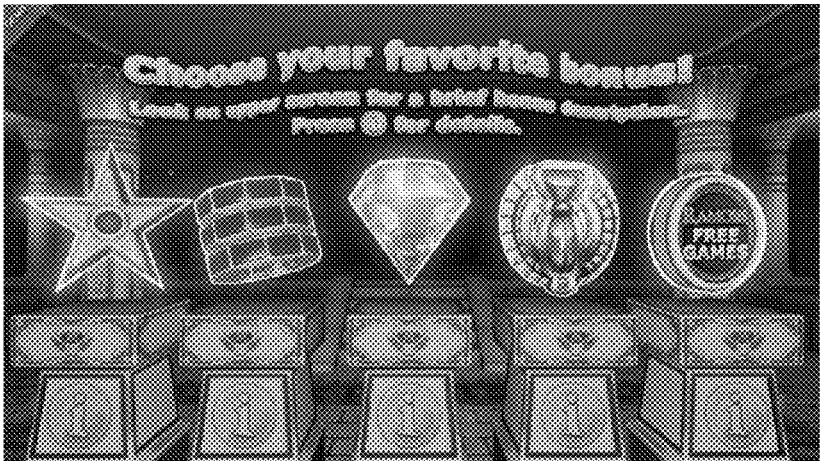

An example base game is shown in FIG. 26 as an example reel type game. As shown, gaming components of a winning line may be represented using a three-dimensional enhancement. The three-dimensional enhancement may be a variant on the original gaming component.

The base game may include hidden bonus features that may be triggered by gaming events or player movements detected by camera. For example, the gaming machine may detect player movement (e.g. closer inspection by player of a gaming component detected by upper body and head movement). The hidden bonus feature may or may not impact payout. For example, the hidden bonus feature may be a visual three-dimensional enhancement. The hidden bonus features may also be triggered by moving images across gaming surface. If a player touches a moving image this may trigger a hidden bonus feature.

A three-dimensional enhancement may be flight scenario where it appears that a player is flying from one playing surface to a new playing surface.

FIGS. 27*a* to 27*e* illustrate example bonus trigger screens, including transition screens between the base game screen and the bonus game screen or bonus selection screen.

A base game event may trigger display of a bonus selection screen. The player may select a bonus game from multiple selections. FIGS. 28*a*-28*d* illustrate example bonus selection screens. Each bonus option may be shown with a three-dimensional enhancement. The bonus choices may be dynamically generated based on player history, gaming venue, and so on. The content may dynamically change so that a player views a different bonus selection screen each time.

A bonus game may be a grid game, similar to the base game example, where some or all gaming components are shown with three-dimensional enhancements.

Figure 29A:
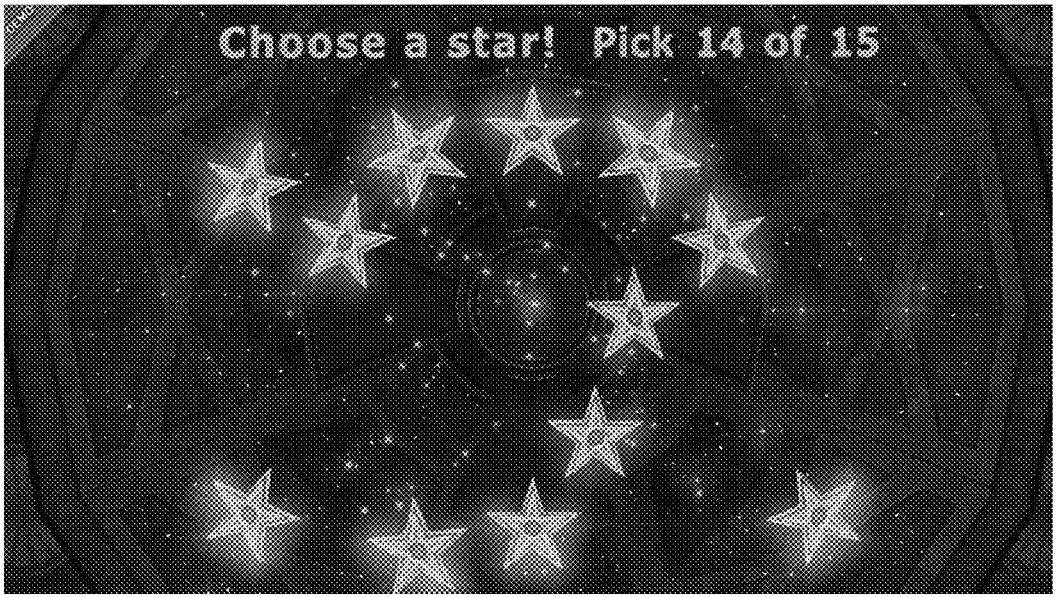
FIGS. 29*a* and 29*b* illustrate an example bonus game with symbol selection.
Figure 29B:
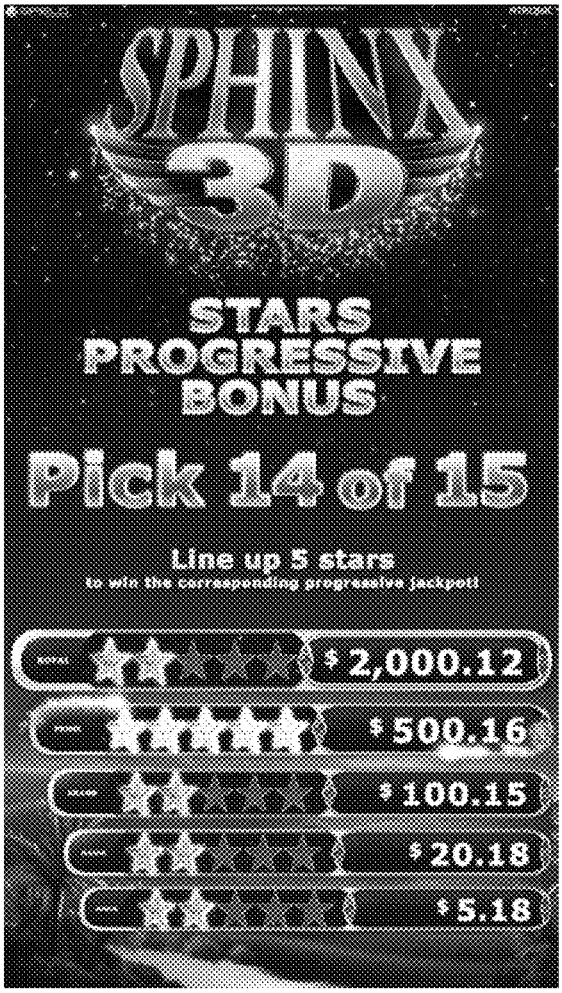

The bonus game may involve a player selecting three-dimensional symbols that may be moving or animated. The bonus game may have a progressive game feature to adjust levels of the bonus game. Each symbol may correspond to a type which may be shown in a particular position of a grid or table. This may be displayed on a separate display screen. If a player selects a symbol it may move to its corresponding position. If the player selects a particular number of types of symbols then the player may win a prize. For example, a player may need to collect five symbols to win a progressive level. A player may need to collect another five symbols to win the next progressive level. After, the last pick the player may be assigned the highest progressive level earned. An example is shown in FIGS. 29*a* and 29*b*.

Figure 30A:
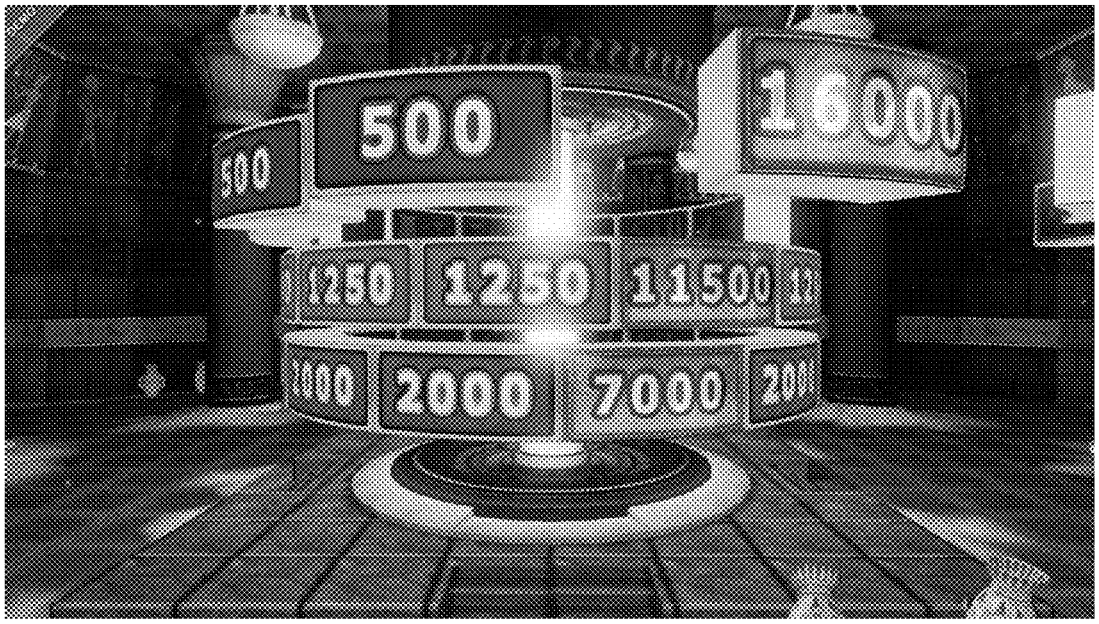
FIGS. 30*a* and 30*b* illustrate an example bonus game with a wheel feature.
Figure 30B:
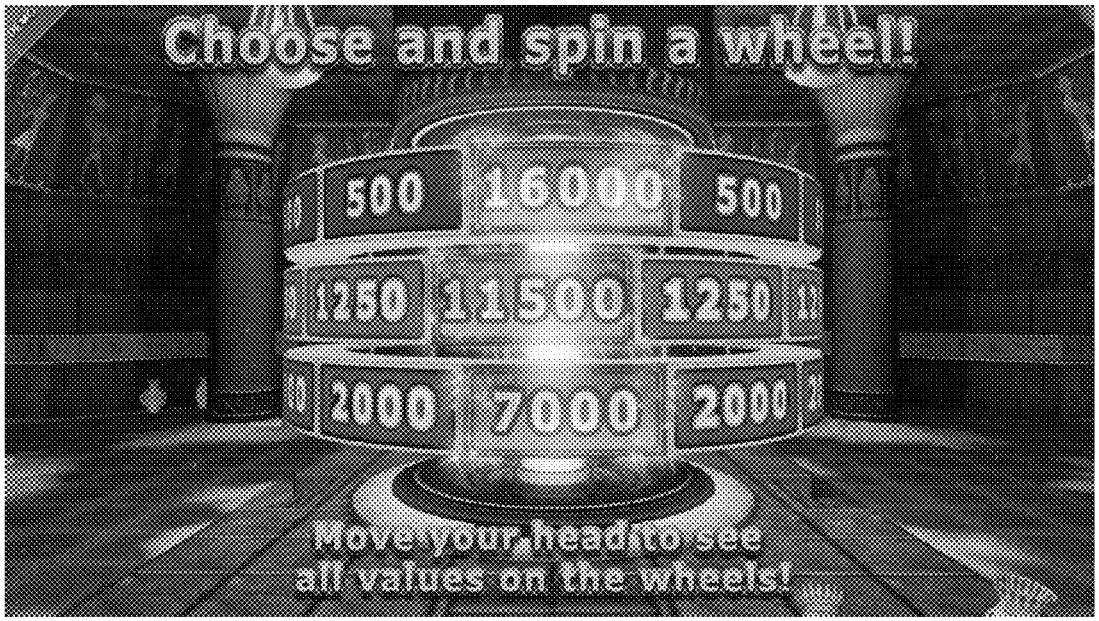

Another bonus game may be a wheel game with different wheels of gaming components stacked on each other. The wheels may spin on an axis and when they stop the player may be awarded an amount based on the symbols of the front facing gaming components. The player may control the strength of the wheel spin using gestures on touchscreen and detected movements, for example, to give the player the impression that they are spinning the wheels. An example is shown in FIGS. 30*a* and 30*b*.

Figure 31A:
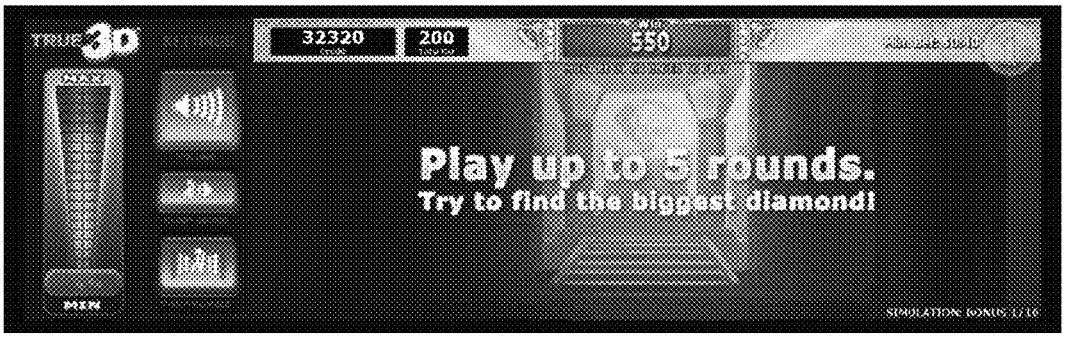
FIGS. 31*a* to 31*c* illustrate an example bonus game with a selection feature.
Figure 31B:
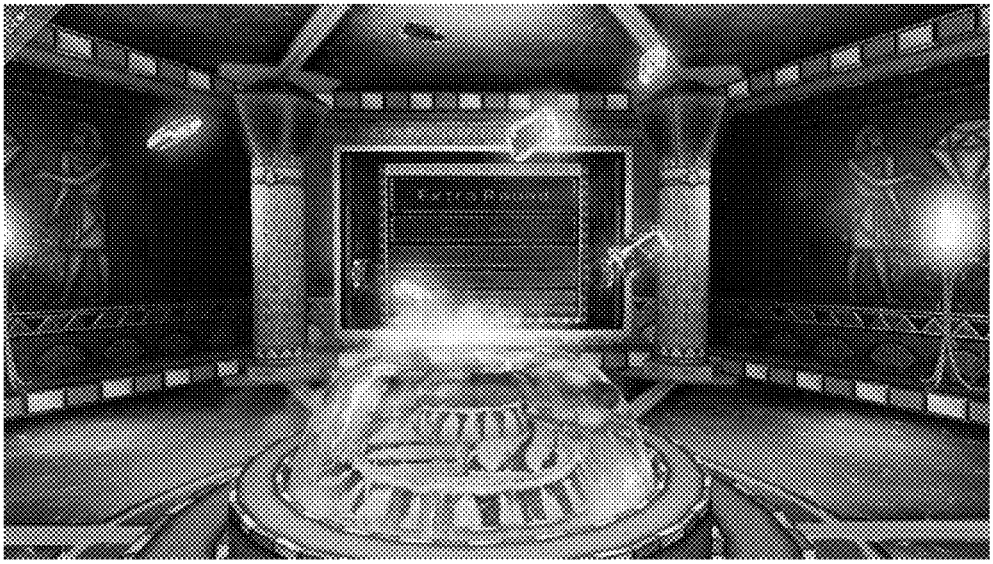
Figure 31C:
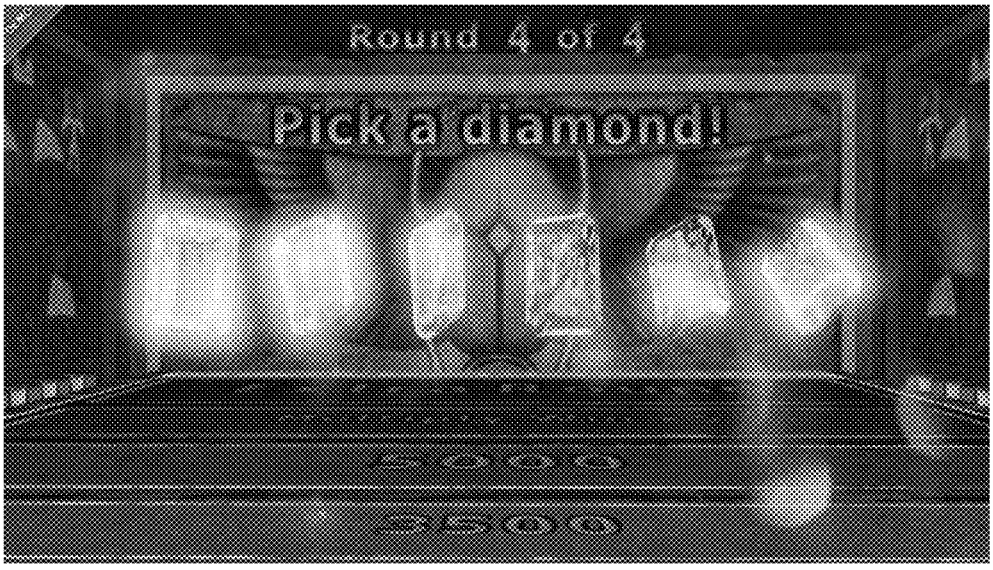

Another bonus game may involve selecting a symbol from multiple symbols, where each is associated with a prize amount. The symbols may be initially shown to be the same size. When a player selects a symbol then each may change via three-dimensional enhancement to their "true" size. The prize amount may be proportional to the true size of the symbol. An example is shown in FIGS. 31*a* to 31*c*.

Another bonus game may involve a stacking three dimensional enhancement. The bonus game may be reel type game, for example, where some of the symbols of the gaming components are wild (e.g. they may be substitute for an adjacent symbols to create a winning line pattern). When a wild appears on the gaming surface (i.e. when the reel has stopped) then all wilds that are not substituted to create a winning line pattern get an additional wild symbol stacked on top. The stacking may be a three-dimensional enhancement. This stacking may be repeated for multiple rounds so that a gaming component may have multiple wilds stacked on top. There may be a maximum limit for stacking. That is, wild stacks on any given reel may grow every spin or round.

When a stacked wild symbol is part of a winning line combination then an award may be provided for each wild in the stack. For example, if there are three wild symbols stacked which form part of a winning line pattern then three awards may be provided to the player. Each award may be the same or may progressively increase. As a wild symbol is counted as part of a winning combination it may be removed to reduce the stack size to its original size (e.g. one wild). Wild stacks on any given reel may grow every spin or round unless a wild is used as part of a winning combination.

Figure 32A:
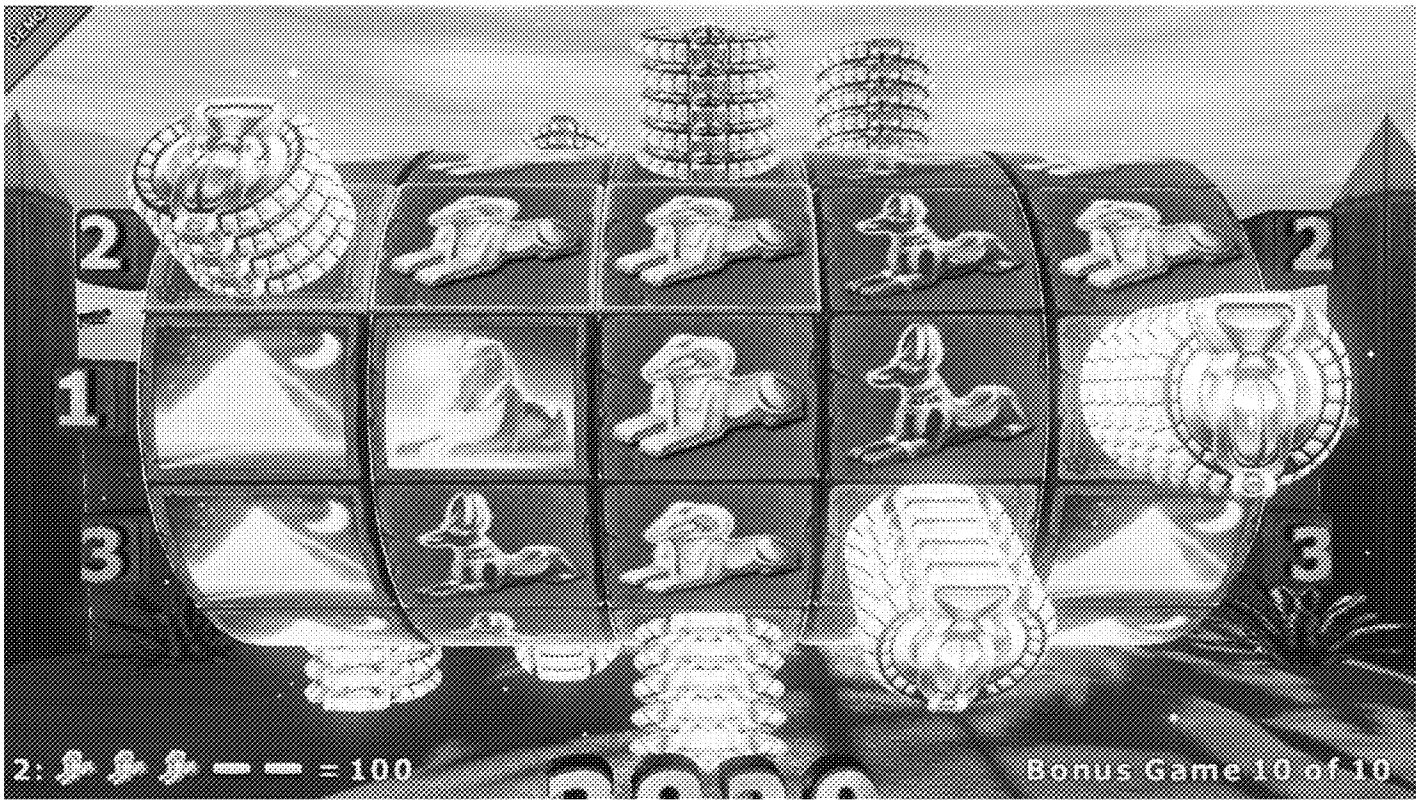
FIGS. 32*a* and 32*b* illustrate example bonus involving stacking wild symbols.
Figure 32B:
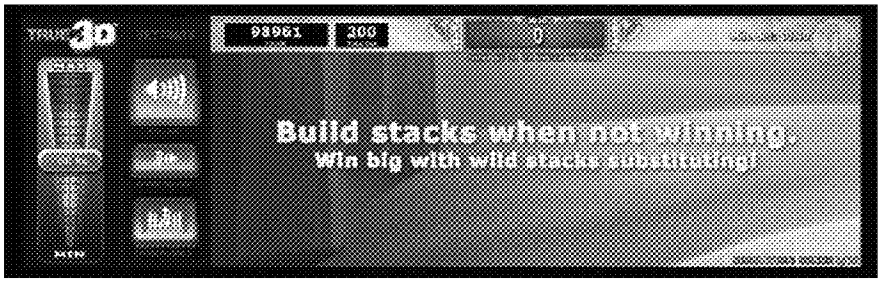

FIGS. 32*a* and 32*b* illustrate an example bonus game where wild symbols may be stacked on other wild symbols. This stacking may occur when a wild symbol in the previous round is not involved in a winning combination of symbols. The stacking of symbols may be a three dimensional enhancement as described herein. When a stack of wild card symbols is part of a winning combination of symbols, then each instance of a wild card symbol may be counted separately to provide multiple wins for the player. For example, if there are three wild card symbols stacked forming part of the winning combination then the winning combination may be counted three times for the total amount awarded to the player. On each count the top wild card may be removed to indicate that it has been counted and so that it may be not be used in the subsequent round to multiply the winnings. The award amount may progressively increase for each wild symbols used as part of the winning combination.

Figure 33A:
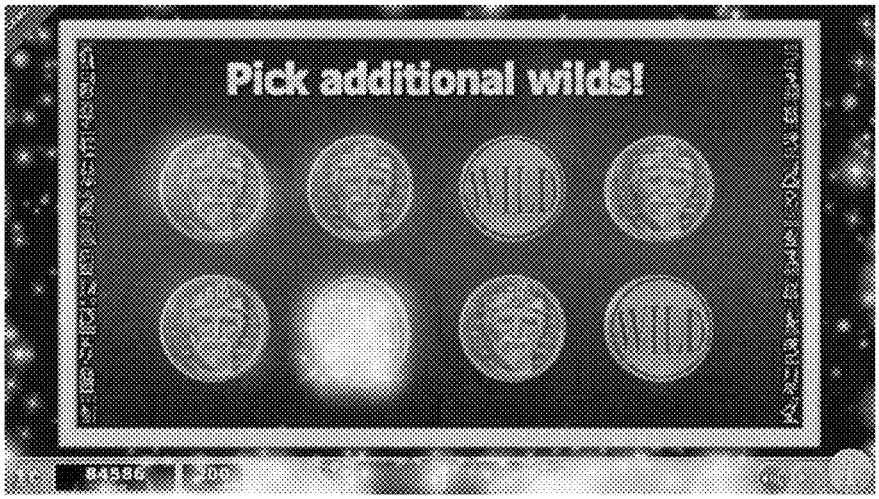
FIGS. 33*a* to 33*c* illustrate example bonus involving wild symbols and coins.
Figure 33B:
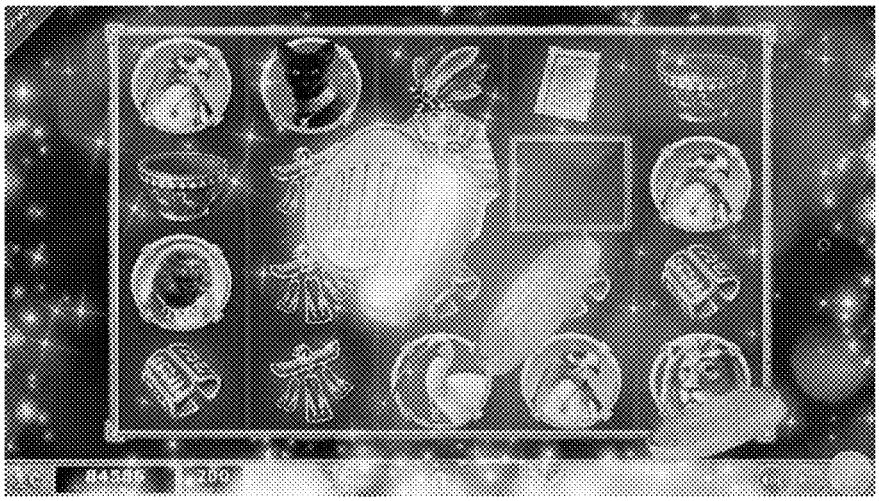
Figure 33C:
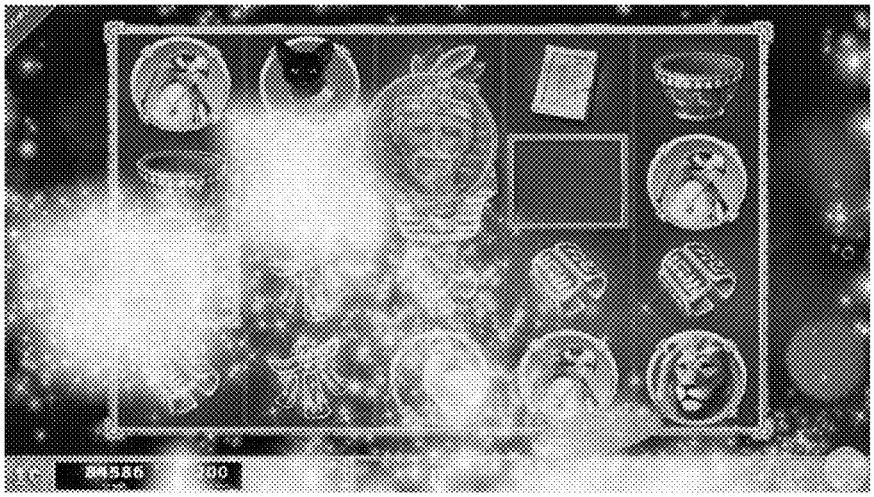

A further bonus game may involve a reel type game that does not involve a traditional spinning reel. Instead, the gaming components may appear to virtually fly in from behind the player to the reel matrix to provide a three dimensional enhancement. FIGS. 33*a* to 33*c* illustrate example involving wild symbols and coins.

The three dimensional enhancement intensity may be dynamically adjusted. The game may include a three dimensional slider bar to dynamically adjust the intensity of the three dimensional enhancement. Users may have different comfort levels for viewing three dimensional images and the adjustment enables customization specific to individual user comfort levels.

As noted, a bonus or base game may include a three dimensional reel, cube or matrix grid where gaming components may stack on top of other gaming components as a three dimensional enhancement. The stacked gaming components may impact payout of the game. The player may be provided with a number of bonus game selections to choose from.

Figure 11:
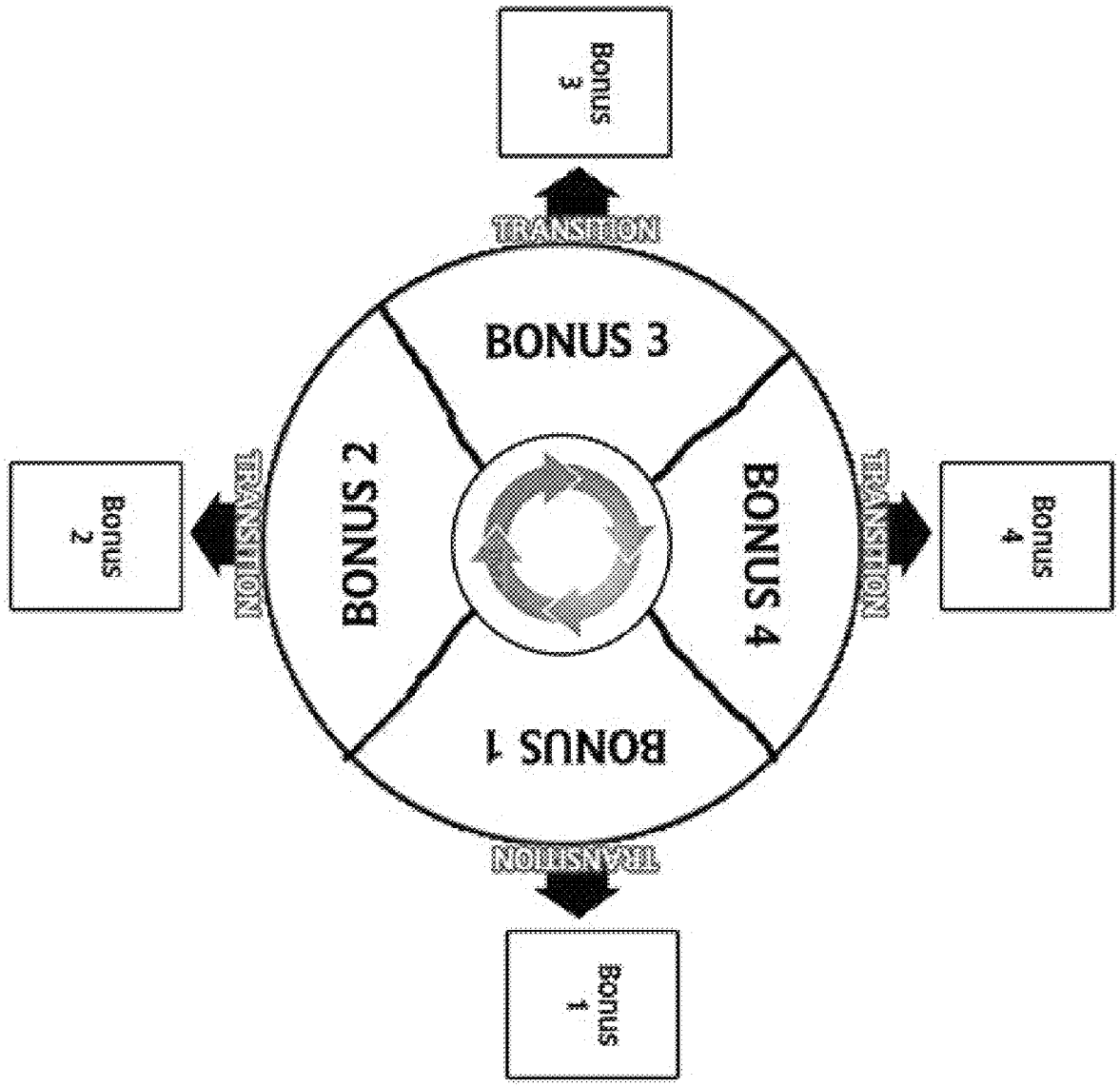
FIG. 11 illustrates an example three dimensional environment for bonus game selection.

The bonus game selections may include a three dimensional enhancement. When a cube is presented on a gaming screen, the player may be transported into the center of the cube. A three dimensional environment may be displayed on the gaming screen. The gaming machine or game may be configured to enable the player to pan around (left to right, right to left, top to bottom, and so on) the three dimensional environment to select which bonus option they would like to play. The player would act as the camera point (in a three dimensional space) and would be able to navigate around the inside of the cube or whatever shape object is being used for the game. FIG. 11 illustrates an example three dimensional environment for bonus game selection.

Figure 12:
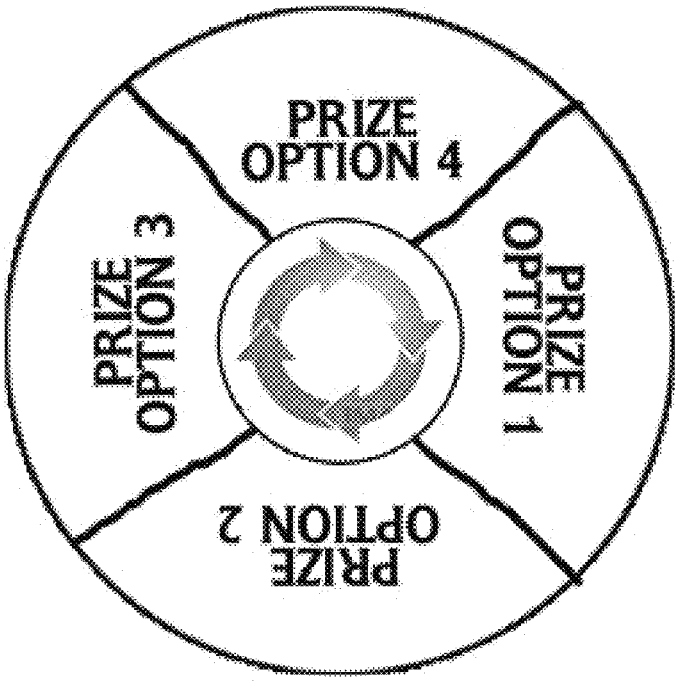
FIG. 12 illustrates an example three dimensional environment for prize selection.

A base game or bonus game may also include a prize selection, where a player can select a prize from a number of prize options. The prize selections may include a three dimensional enhancement. For example, when a three dimensional cube/object is presented on the game screen, the player may be transported into the center of the cube. A three dimensional environment may be displayed on the gaming screen. The gaming machine or game may be configured to enable the player to pan around (left to right, right to left, top to bottom, and so on) the three dimensional environment to view and select a prize (via e.g. touching the touch screen) that will be awarded to them. The player may act as the camera point (in a three dimensional space) and would be able to navigate around the inside of the cube (or whatever shape object is being used). FIG. 12 illustrates an example three dimensional environment for prize selection.

Figure 13:
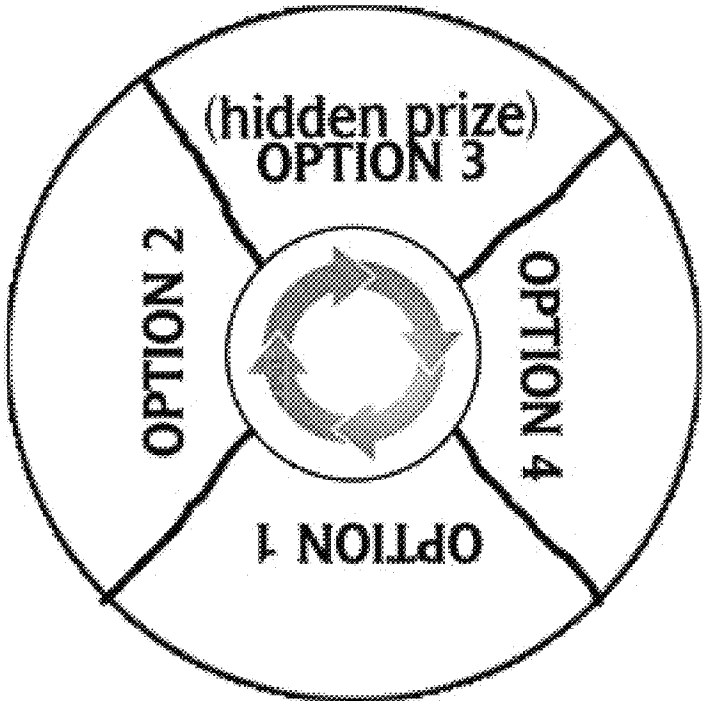
FIG. 13 illustrates an example three dimensional environment for hidden prizes.

Another example three dimensional enhancement may relate to a hidden prize. When a three dimensional cube/object is presented on the game screen, the player may be transported into the center of a cube. A three dimensional environment may be displayed on the gaming screen. The gaming machine or game may be configured to enable the player to pan around (left to right, right to left, top to bottom, and so on) the three dimensional environment. Each of the sides or facets of the object may contain a hidden prize. The player may be asked to then touch a side of the cube/object to eliminate a side of the object. The point would be to eliminate all but one of the object sides and the one remaining would corresponding prize to be awarded to the player. The player may act as the camera point (in a three dimensional space) and would be able to navigate around the inside of the cube (or whatever shape object is being used). Another option to this would be to give the player a number of picks to try and find a hidden object on the facets or sides. FIG. 13 illustrates an example three dimensional environment for hidden prizes.

Figure 14A:
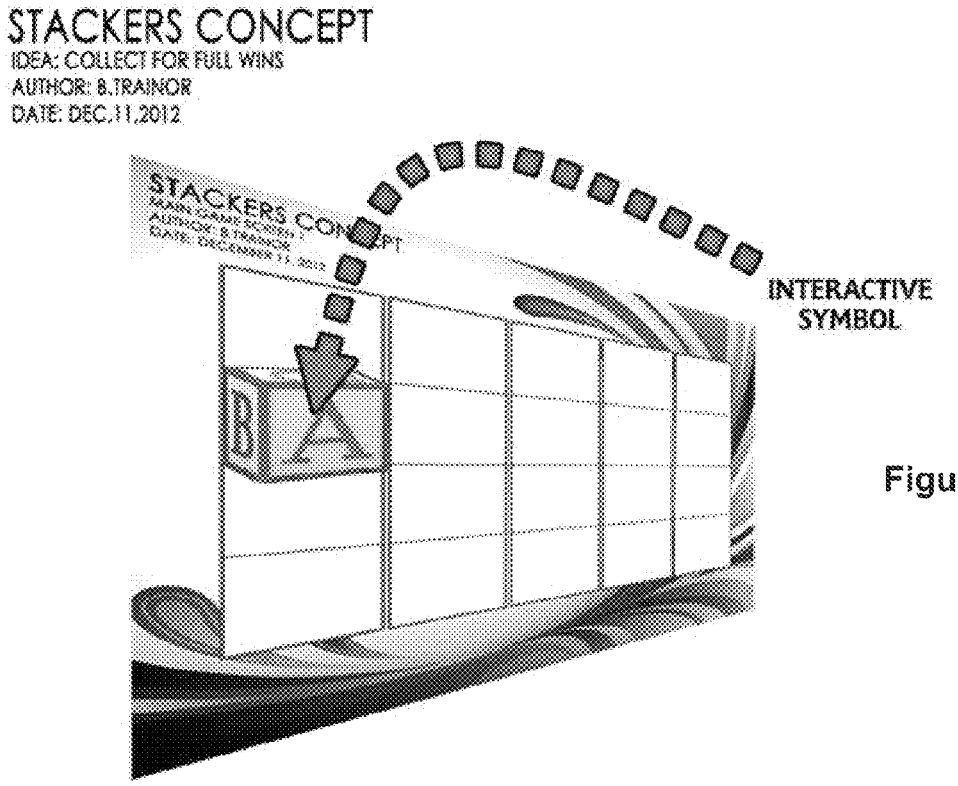
FIGS. 14*a* and 14*b* illustrate example three dimensional environments for theme selection.
Figure 14B:
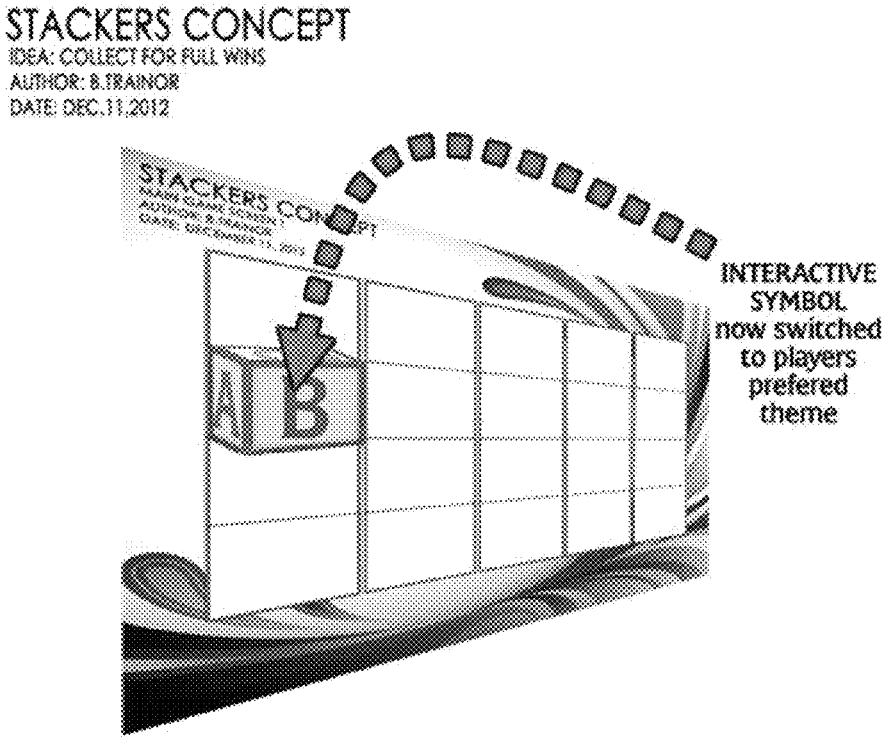

As a further example, three dimensional enhancement a player may be able to select a symbol theme. When a three dimensional cube/object is presented on the game screen, the player may be transported into the center of the cube. A trigger event may launch theme selection. A three dimensional environment may be displayed on the gaming screen. The gaming machine or game may be configured to enable the player to be able to pan around (left to right, right to left, top to bottom, and so on) the environment. Each of the sides or facets of the object may contain a theme for the symbol. The player may be asked to then touch a side of the cube/object to select how they want the symbol to be themed as for their game play. This may also enable the player to choose or select what type of special symbols they want to have in their game (wilds, scatters, multipliers, progressive, and so on). Once the player has selected the theme of the symbol, special symbols, and so on, games subsequently played may show the theme of the symbol until the next time a trigger event happens that allows the player to switch the theme again (if they want to). FIGS. 14*a* and 14*b* illustrate example three dimensional environments for theme selection.

As noted, three dimensional enhancements may be provided in a secondary game. The three dimensional enhancements may provide a variant three dimensional aspect for the secondary game. A secondary may be played continuously over the course of a series of reel-type main games on a gaming device, where the successful outcome of the secondary game may be the initiation of a bonus game. Therefore, the player is enticed to keep playing due to the player's investment in the secondary game and due to the expectation of playing a bonus game at the end of the secondary game.

One illustrative embodiment of the secondary game is as follows. For simplicity, the main game is assumed to be a 3×3 matrix of virtual reels, although the matrix can have any number of rows and columns. At the beginning of a playing session, a colored tile may be located at each of the nine symbol positions and may be visible behind any symbol at that symbol position. The virtual reels are then spun and randomly stopped to display nine random symbols at the symbol positions. It is assumed that the pay lines are three horizontal lines across the three rows and two diagonal lines. If there is a winning combination of symbols, such as three of a kind, the player is given an award from a pay table, and the tiles behind those symbols in the winning combination are extinguished. For example, the tiles may be animated to break and fall downward off the screen. There may be multiple winning combinations for a single spin. The tiles may be shown in three dimensions where the three dimensional tiles may be a variant on the original tiles.

The player then bets again and plays the main game again, while the tiles remain from the previous game. Again, any tiles behind the symbols in a winning combination are extinguished.

The player keeps playing the main games until there are no more tiles left behind the symbols. When all tiles are extinguished, a bonus game may be triggered. In one embodiment, extinguishing all the tiles awards the player an instant prize prior to the bonus game beginning. The bonus game may be any game. The bonus game may include a three dimensional enhancement.

In one embodiment, the bonus game concludes with the player selecting any one of nine tiles in a 3×3 matrix to reveal a hidden award. The hidden award may be a monetary prize or the number of tiles (e.g., 1 to 9) that are to be extinguished during the resetting of the tiles for the next main game. In another embodiment, any type of bonus game may be played with or without player involvement. The bonus game may be very different from the main game, such as a guessing game, or may be a variation of the main game with larger awards or a higher probability of winning. The awards in the bonus game may be proportional to the bet amount used to play the main game.

After the bonus game is over, a new set of tiles may be displayed at the symbol positions, and the process may start again.

If the player changes her bet amount from one main game to the next, a different set of tiles, only associated with that bet amount, may be displayed. The positions of the tiles associated with each bet amount are stored in a memory, so if the player changes the bet, the tiles displayed the last time the player made the same bet are displayed. The tiles associated with different bets may have different colors. This prevents a player from extinguishing most of the tiles during low bet games, and then raising the bet when it is likely that a bonus game will be triggered.

Accordingly, the player is motivated to keep playing as more and more tiles are extinguished since the bonus game becomes more likely to be triggered.

This secondary game may be added to existing games having a main game and a bonus game, since the secondary game does not have to change the bonus game but only triggers it. A three dimensional aspect to the secondary game may be shown as a variant to the original secondary game display, and not limited to a three dimensional version of the secondary game.

The secondary game may replace a triggering technique for a bonus game. The bonus game may also be initiated using more traditional methods, in addition to the secondary game, such as by a special outcome of the main game.

If the main game is a larger matrix, such as a 4×5 matrix, the secondary game may be ongoing for a relatively long time due to more tiles required to be extinguished.

Figure 15:
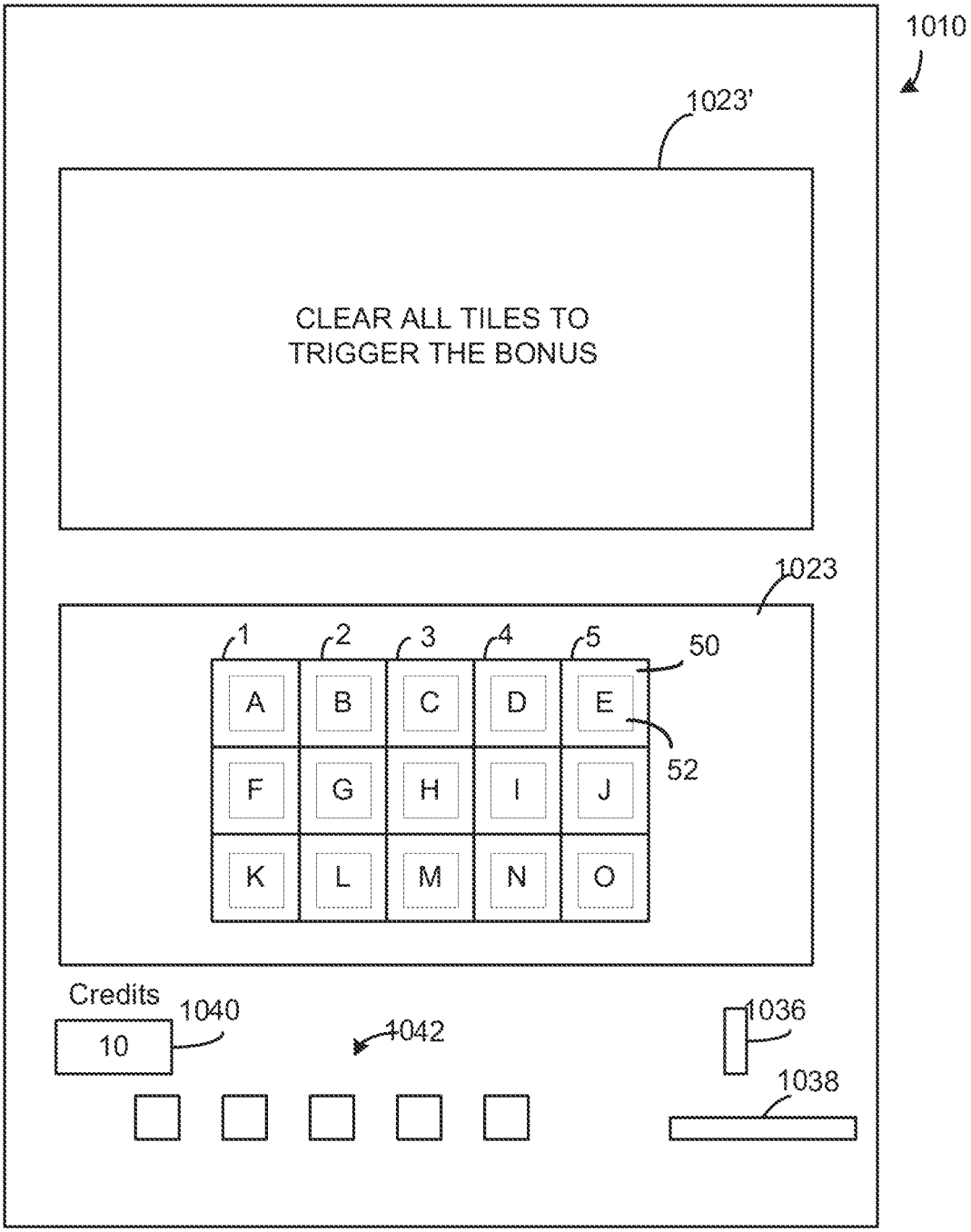
FIG. 15 illustrates more detail of a video gaming device programmed to carry out a secondary game, where the device displays a 3×5 array of symbols with tiles displayed behind the symbols at the start of a playing session.

FIG. 15 illustrates more detail of a video gaming device 1010 programmed to carry out a secondary game, where the device displays a 3×5 array of symbols with tiles displayed behind the symbols at the start of a playing session.

Machine 1010 includes a main display 1023 that may be a thin film transistor (TFT) display, a liquid crystal display (LCD), a cathode ray tube (CRT), or any other type of display.

An optional second display 1023' may provide information, such as an advertisement for the game, the rules of the game, pay tables, pay lines, or other information, or may display a bonus game while the main game and secondary game are displayed on display 1023. In one embodiment, displays 1023 and 1023' have a touch screen feature that enables the player to make selections by touching a displayed icon. The displays 1023 and 1023' may be configured to display three dimensional enhancements as described herein.

A coin slot 1036 accepts coins or tokens in one or more denominations to generate credits within machine 1010 for playing games. A slot 1038 receives bills or machine readable printed tickets and outputs printed tickets for use in cashless gaming. A credit meter 1040 identifies the current credits in the machine 1010.

Player control buttons 1042 include any buttons needed for the play of the particular game or games offered by machine 1010 including, for example, a bet button, a repeat bet button, a spin reels button, a maximum bet button, a side-bet button, a cash-out button, a display pay lines button, a display payout tables button, select icon buttons, and any other suitable button. A touch screen with virtual buttons may be used instead of physical buttons.

The display 1023 shows virtual reels 1-5, displaying a conventional 3×5 array of symbols. There may be an array of 3×3 symbols, an array of 4×5 symbols, or any other arrangement of symbols. Conventional pay lines extend across the five reels. Conventional pay lines include horizontal as well as angled pay lines across all five reels. Sample symbols A-O are shown as the displayed symbols for simplicity. The standard symbol combination game is referred to herein as the main game.

At the beginning of a playing session, such as after a previous player has cashed out and a new player has arrived at the machine 1010, the machine 1010 may be running an attract mode to display aspects of the game to get players' attention. The attract mode may include three dimensional enhancements, sound and so on, as described herein.

When the new player places a bet, a tile 1050, associated with that bet amount, is displayed at all the symbol positions. There may be a different color tile 1050 associated with each bet amount, such as $0.25, $0.50, $0.75, $1.00, etc. There may also be an initial display of symbols 52 at the symbol positions.

The upper display 1023' may include an explanation of the game and payouts to the player, such as "CLEAR ALL TILES TO TRIGGER THE BONUS." The bonus game may be a single bonus game or may be selected from multiple bonus game options, as described herein.

FIGS. 16-21 illustrate a simplified screen display on any form of gaming device carrying out an embodiment of secondary game, where a 3×3 matrix of symbol positions is employed, and where FIGS. 16-21 illustrate the progression of the secondary game over a number of main games. FIG.

22 is a flowchart illustrating steps in of a method involving a secondary game that may be referenced herein.

Figure 16:
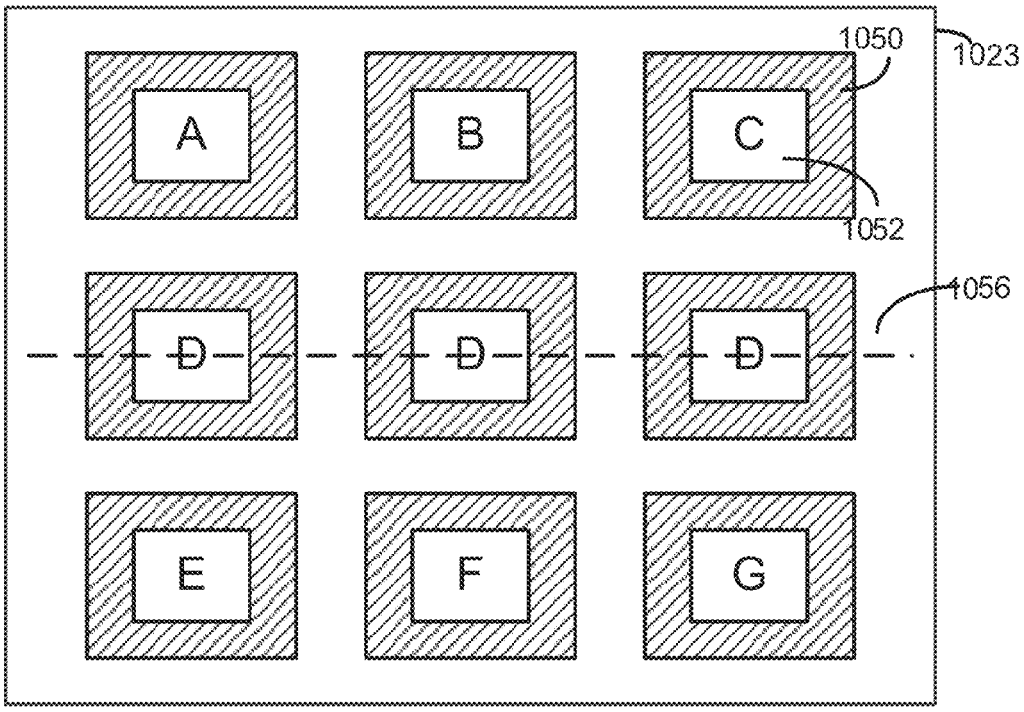
FIGS. 16-21 illustrate a simplified screen display on any form of gaming device carrying out an embodiment of secondary game, where a 3×3 matrix of symbol positions is employed, and where
Figure 22:
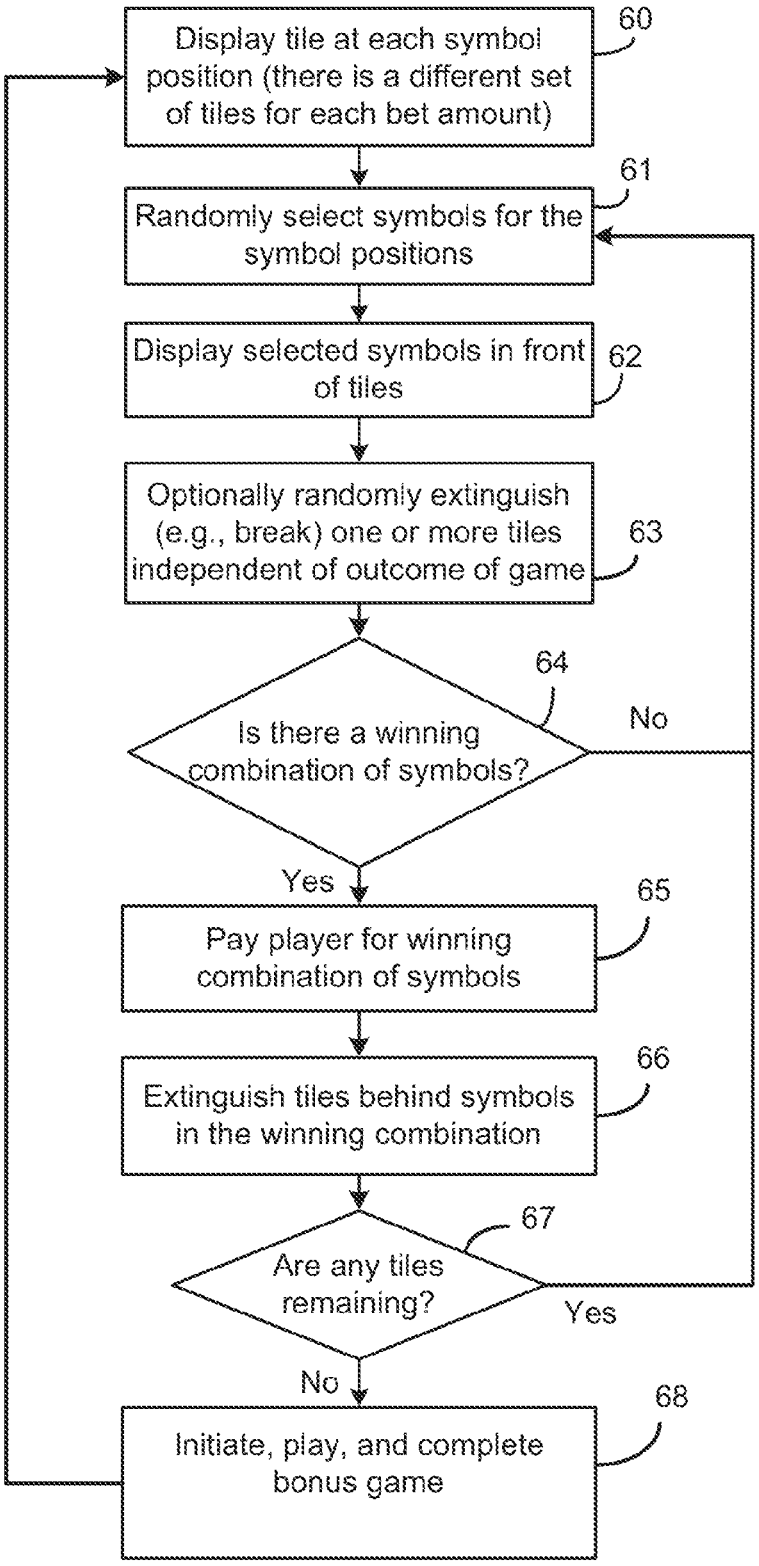
FIG. 22 is a flowchart illustrating steps in of a method involving a secondary game.

FIG. 16 illustrates the screen display after a new player bet and played the first main game. All the tiles 1050 are initially behind the symbols 1052. (Step 60 in FIG. 22) In another embodiment, the tiles or other visual indicator may surround the symbols 1052 or be located anywhere in or near the symbol position so as to be associated with that symbol position. The virtual reels are spun and randomly stopped to display the symbols 1052 in front of the tiles 1050. (Steps 61 and 62 in FIG. 22)

In one embodiment, at some random or predetermined time, one or more of the tiles 1050 may be randomly extinguished. This may occur before or during the spinning of the virtual reels. (Step 63 of FIG. 22)

It is assumed that three of the same symbol across a horizontal or diagonal pay line 1056 is a winning combination. (Step 64 of FIG. 22) In FIG. 16, the three D symbols across the center pay line 1056 grants the player an instant award, such as 10 credits. (Step 65 of FIG. 22) All pay lines must be active in the main game to enable all tiles to be eventually extinguished.

Figure 17:
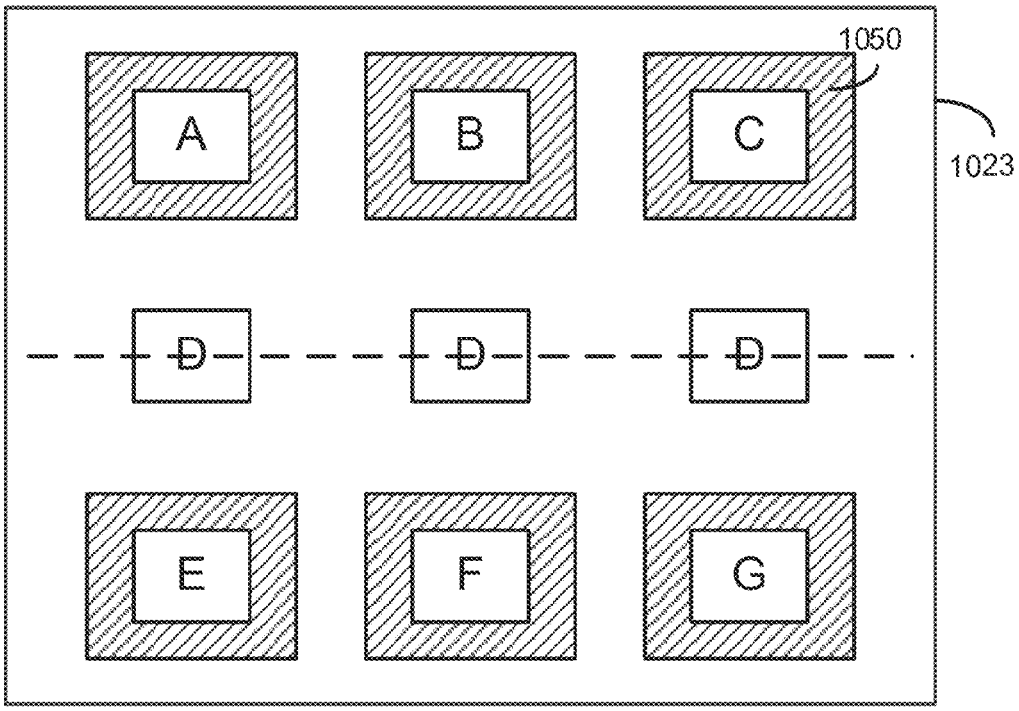

In FIG. 17, prior to or after the instant payout to the player, the three tiles behind the symbols in the winning combination are extinguished. (Step 66 of FIG. 22) This may be done by changing the colors of the three tiles, animating the shattering of the tiles, and showing the broken tiles falling downward. The tiles may be shattered beginning with the leftmost tile and continuing to the right.

The number of tiles 1050 remaining to be extinguished, associated with each bet amount, may be separately displayed to the player, such as on a meter or a totem pole type of display. In this way, the player may be motivated to continue betting the same amount to complete the extinguishing of all tiles associated with that bet amount.

Winning combinations may also include a scatter symbol (a scatter symbol does not have to be on the same pay line as other symbols in a winning combination), so the extinguished tiles after a win need not only be across a single pay line. If special symbols are used, the occurrence of a special symbol may cause the associated tile to be extinguished without that special symbol being part of a winning combination.

Figure 18:
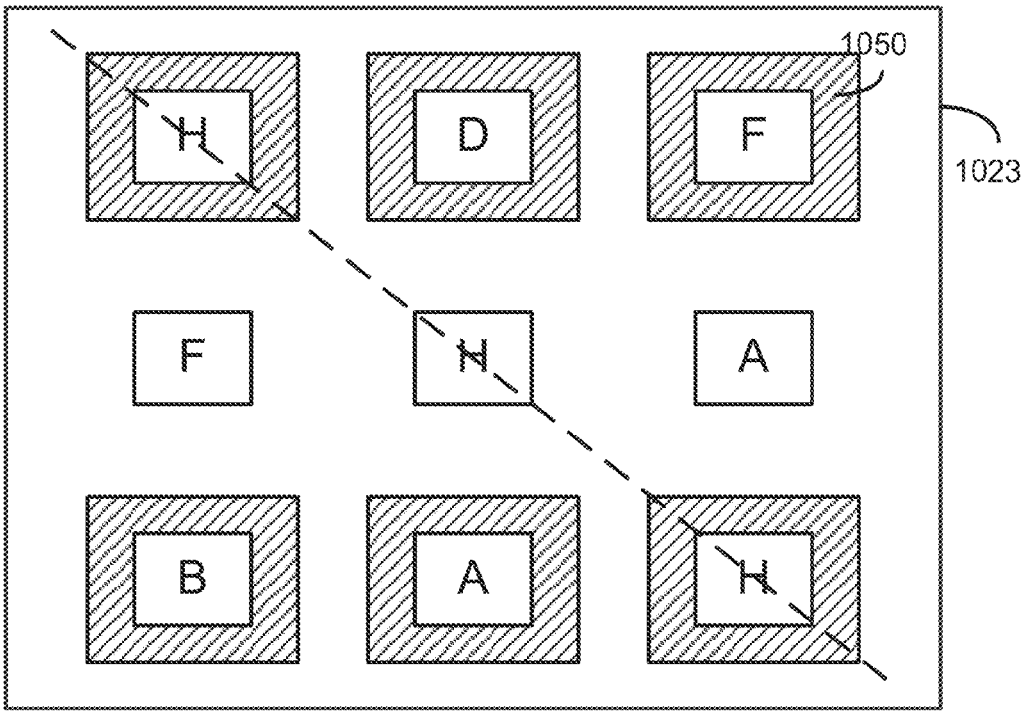

The player then bets and plays another main game, shown in FIG. 18. The tile configuration from the previous game (FIG. 17) is carried over to the next game so that the tile game is a continuous secondary game.

Figure 19:
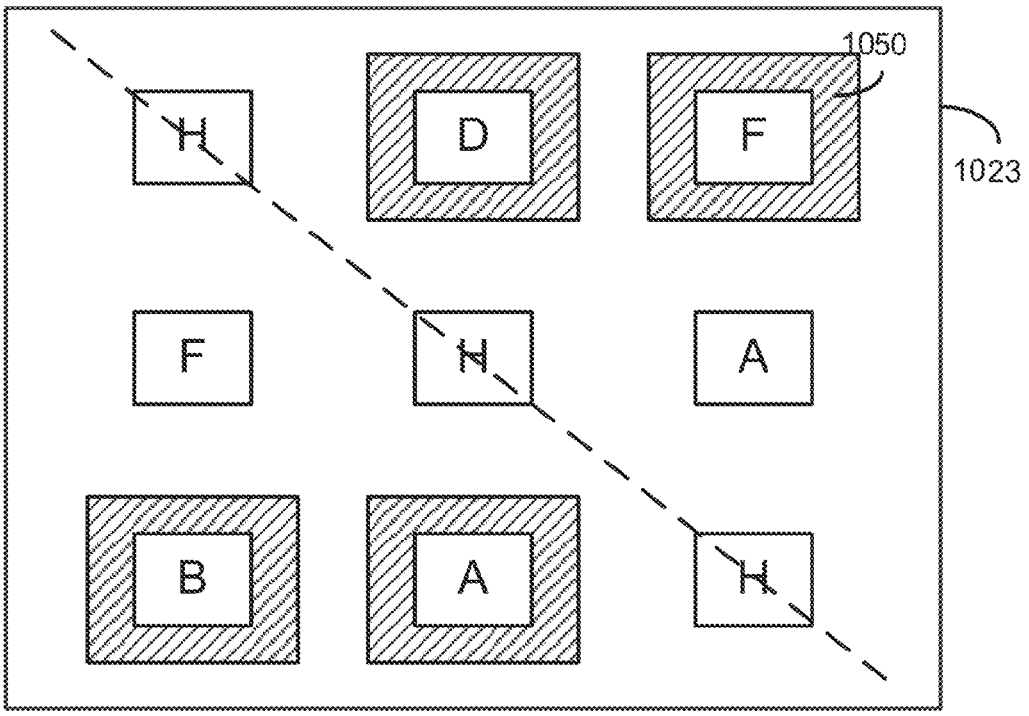

In FIG. 18, the player obtained three H symbols diagonally, so an instant payout is awarded. In FIG. 19, the remaining tiles behind the H symbols in the winning combination are extinguished.

Figure 20:
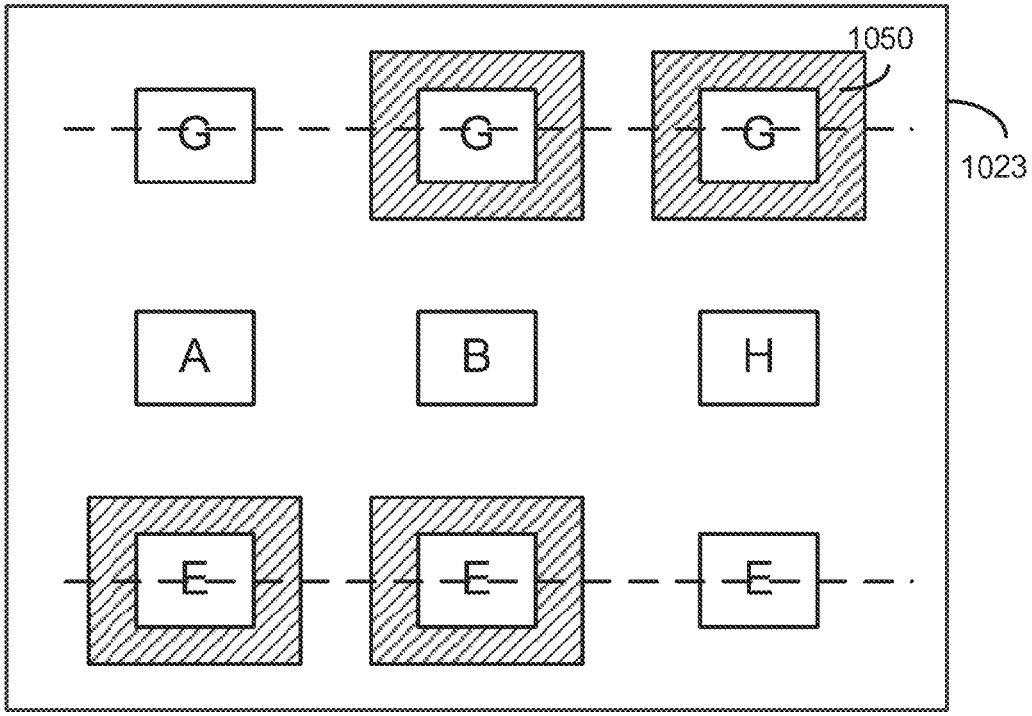
Figure 21:
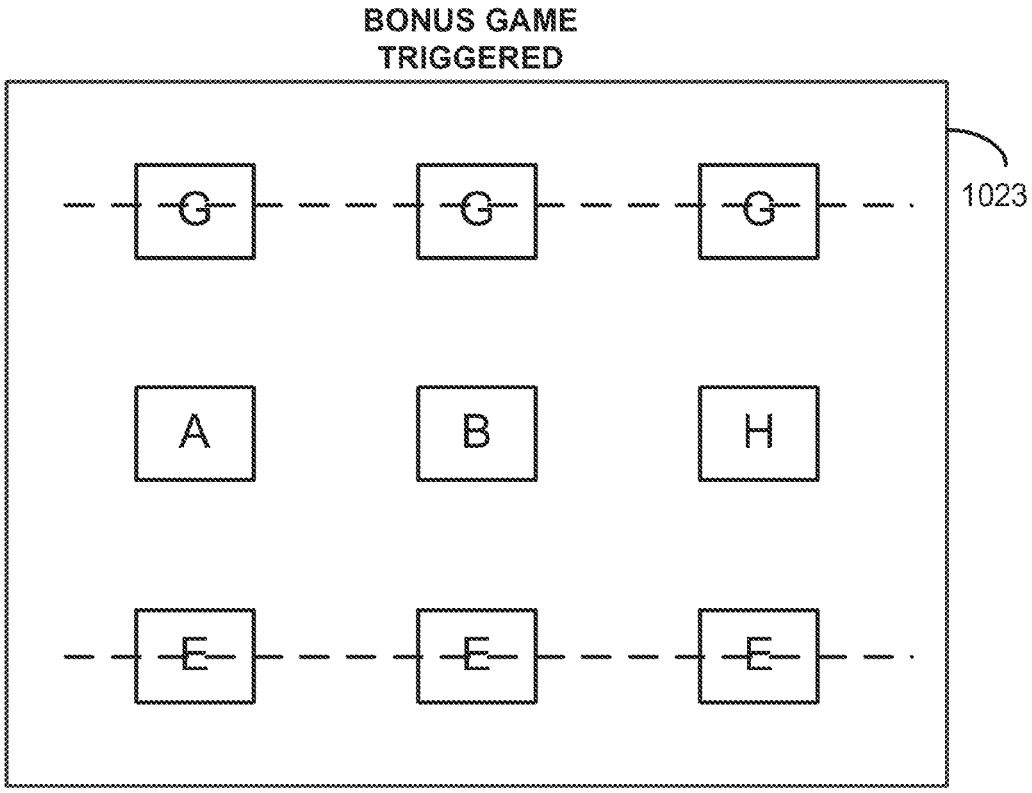

The player bets and plays the next main game in FIG. 20, generating two wins across the upper and lower pay lines, and is awarded an instant payout. In FIG. 21, the tiles behind the symbols in the winning combinations are extinguished, thus causing all tiles on the screen to have been extinguished. (Step 67 of FIG. 22) This triggers a bonus game, which may be initiated with some fanfare. (Step 68 of FIG. 22) Various example bonus games are described herein. There may be one bonus or a selection from multiple bonus games.

In one embodiment, the player may win an instant prize for extinguishing all tiles 1050, or an option to select from prize options, as described herein. The bonus game may be any game. Various example bonus games are described herein. There may be one bonus or a selection from multiple bonus games. The secondary game and the bonus game may include three dimensional enhancements, such as stacked gaming components, as described herein.

In one embodiment, at the end of the bonus game, the player is presented with a screen display where each symbol position has a tile displayed. Behind each tile is a hidden award. The player selects one of the tiles, such as by using a touch screen, and the hidden award is revealed. In another embodiment, the hidden award is the number of tiles (e.g., 1 to 20 for a 4×5 matrix) that will be extinguished during the setup of tiles 1050 for the subsequent series of main games. Other example prize selections may be used.

The bonus game may be played for free without any additional bet. The possible awards in the bonus game may be proportional to the bet used to play the main game. For example, the possible awards in the bonus game after playing the main game with a dollar bet are four times higher than the possible awards after playing the main game with a quarter bet. In one embodiment, the bonus game routine is unrelated to a reel-type game and will usually involve a fanciful animation having different probabilities of winning different awards, including a progressive jackpot.

The tiles 1050 during the main game are associated with a particular bet, such as the tiles being different colors for each bet amount. If the player changes a bet amount from one main game to the next, a new set of tiles is displayed associated with that bet amount. The status of the tiles is stored in a memory, such as in the gaming device or a server, so that if the player changes a bet then goes back to a previous bet, the previous tile status associated with that previous bet will be carried over and displayed. This may prevent a player from extinguishing most of the tiles during low bet games, and then raising the bet when it is likely that a bonus game will be triggered.

If the occurrence of all tiles being extinguished is, on average, too frequent, there may be multiple layers of tiles, where the player must extinguish all layers of tiles before the bonus game is triggered. In one embodiment, a tile in a second layer cannot be extinguished until all tiles in the first layer are extinguished. In another embodiment, tiles of any layer may be extinguished as long as a tile in front has been previously extinguished.

After the bonus game is complete, a new set of tiles 50 may repopulate the screen.

In one embodiment, if the player cashes out, the tile statuses (for all bet amounts) will remain so the next player benefits from the previous player leaving partial sets of tiles. Therefore, a player is motivated to not leave an incomplete set of tiles for the next player, and a new player is motivated to begin playing the game if there is an incomplete set of tiles.

In another embodiment, if the player cashes out, all the tile statuses (for all bet amounts) may be reset so the next player starts with a full set of tiles. In another embodiment, if the player uses a player tracking card, the statuses of the tiles may be saved in a central memory when the player cashes out. When the player resumes play at a participating gaming machine using the player tracking card, the statuses of the tiles will be downloaded to the gaming machine so the player can resume where she left off.

Although the term tile or cell has been used to visually identify the status of a symbol position during the secondary game, any visual indication may be used to identify the status of a symbol position, such as a dot, a color, etc. Further, although it is described that a tile is extinguished after the symbol position was part of a winning combination, the tile (or other indicator) may simply change in other ways to indicate that its associated symbol position was part of a winning combination. This may be by changing color, changing shape, or other indication. Still further, although it is described that the tiles initially populate the symbol positions and are then extinguished, the secondary game may add an indicator (e.g., a tile) to a symbol position after its symbol was involved in a winning combination, so that the bonus game is triggered when all symbol positions are populated with a tile or other indicator. Thus, the displayed indicator for a symbol position involved in a winning combination may be the existence of a visual marker or the lack of a visual marker. The tile may also include three dimensional enhancements.

Although the term randomly has been used for the selection of symbols and other events, the term randomly may also include pseudo-randomly where the randomness is perceived by the player and essentially unpredictable.

In accordance with some embodiments, a video gaming computer system and computer implemented video gaming method may be provided that incorporates winning enhancements, as described herein, into pattern games, as an illustrative example.

A random selector selects on a random basis a first random selection (which may be a set of chance elements or symbols for example). The first random selection may determine the gaming outcome, or may be used to generate the gaming outcome. The winning pattern including the gaming elements constitute a representation of the first random selection, and may be referred to as a "first level winning pattern". The array that displays the gaming elements of the first level winning pattern may be referred to as the "first array".

A pay-out component may store pay-out attributes associated with each random selection. Various pay-out attributes, and mechanisms for presenting these to a user, may be used in the video gaming computer system and computer implemented video gaming methods.

The gaming system and method enables video games of various types that include winning enhancements as described herein that may be thereby more engaging and stimulating.

A mechanism for incorporating winning enhancements into pattern games in a new and innovative manner may be engaging and stimulating for players.

The random generator may be configured to generate a second random selection. The gaming computer system and the computer implemented gaming method may be configured so as to integrate the second random selection into the first random selection so as to potentially modify the first random selection. Modifications to the first random selection may result in a change in the gaming outcome.

In another aspect, the second random selection initiates the gaming computer system to display gaming elements corresponding to the second random selection that are also organized in an arrangement of cells to form a second array, thereby defining a "second level winning pattern".

In another aspect, the second level winning pattern is associated with the first level winning pattern, such that the second level winning pattern is displayed in a way that simulates the second level winning pattern impacting on the outcome(s) associated with the first level winning pattern.

In another aspect, the gaming computer system is configured to display the gaming elements of the second level winning pattern as an overlay to the first level winning pattern.

In another aspect, one or more cells for the first array include one or more cells of the second array, thereby displaying an integrated winning pattern based on interrelationships or interactions between first array gaming elements (or "first set of gaming elements") and second array gaming elements (or "second set of gaming elements").

In another aspect, the interaction between the first set of gaming elements and second set of gaming elements displayed by the video gaming computer system simulates physical interactions between the first set of gaming elements and the second set of gaming elements.

As an illustrative example, in addition to or as part of providing three dimensional enhancements, the gaming computer system may define an overlay that is applied to the first array to provide the second array; the second set of gaming elements may be depicted as appearing on the display, moving on the display, and achieving a resting position on the overlay relative to the first array, in which the second set of gaming elements are situated on one or more cells, which may be disposed within cells of the first array; the position of the second set of gaming elements on the overlay is related to the position of the first set of gaming elements in the underlying cells; and one or more rules are applied to determine the modifications ("modification rules"), if any, that result from the second set of gaming elements being situated in portions of the overlay that overlap with the underlying cells of the first array.

In one aspect, the overlay consists of a second array in which each cell is divided into a plurality of smaller second array portions or cells, wherein each of the second set of gaming elements is disposed in a smaller second array portion.

In another aspect, the overlay is a grid overlay. In another aspect, the interactions between the first set of gaming elements and the second set of gaming elements occur through the grid overlay only, as opposed to direct interaction in the same interface component between the first set of gaming elements and the second set of gaming elements. Therefore the interactions between the first set of gaming elements and the second set of gaming elements in one aspect may be indirect.

In a further possible implementation, the interactions between the first set of gaming elements and the second set of gaming elements may be direct, or may include direct interactions.

In another aspect, the video gaming computer system includes a physical attribute simulator. In another aspect, the physical attribute simulator is operable to simulate: the second set of gaming elements (or gaming components) falling on the display; the second set of gaming elements interacting physically with first set of gaming elements in way that simulates how a physical object represented by the second set of gaming elements (such as a ball or dice) would interact with a physical object represented by the first gaming elements, including based on any movements by the first set of gaming elements, as represented by the video gaming computer system in connection with movements of the first set of gaming elements associated with the first set of gaming elements achieving a resting pattern, if any.

In another aspect, the grid overlay includes a number of cells that may vary, including based on the reel configuration. The number of cells for the grid overlay may also vary for the same reel configuration.

In one aspect, any one or more of the second set of gaming elements may fall in a particular cell of the grid overlay, and this may trigger an interaction through the grid overlay of one or more of the first set of gaming elements, depending for example on the position of the second set of gaming elements. For example, where the second set of gaming elements consist of balls, a ball may fall in a cell in way that it "touches" or overlaps with one or more neighbouring gaming elements. The interactions may depend on a number of factors. For example a ball may enhance identical or associated elements of the first set of gaming elements to provide further enhancements.

The gaming outcome may be modified in a number of ways. For example, the second level winning patterns may produce a multiplier that is applied to a winning combination.

The host system (e.g., the casino's system, the gaming site, or a portal) may be implemented in a number of different ways. In one aspect: (A) the second set of gaming elements consist of ball graphics that are dropped on a plurality of spinning reels that include symbols providing the first set of gaming elements, the balls are shown to interact via the grid overlay with the spinning reels, the reels come to a stop, the balls settle into their final position, and a +1× multiplier for example is applied for any of the first set of gaming elements that are touched by the second set of gaming elements.

Embodiments described herein may be carried out using any type of computer, including portable devices, such as smart phones, that can access a gaming site or a portal (which may access a plurality of gaming sites) via the internet or other communication path (e.g., a LAN or WAN). The invention can also be carried out using an electronic gaming machine (EGM) in a casino. One type of EGM is described with respect to FIG. 1. Display 14 may be configured to display three dimensional enhancements as described herein. Display 14 may be configured to may provide information, such as an advertisement for the game, the rules of the game, pay tables, pay lines, or other information, or may even display the main game, secondary game or a bonus game along with display 12.

Figure 23:
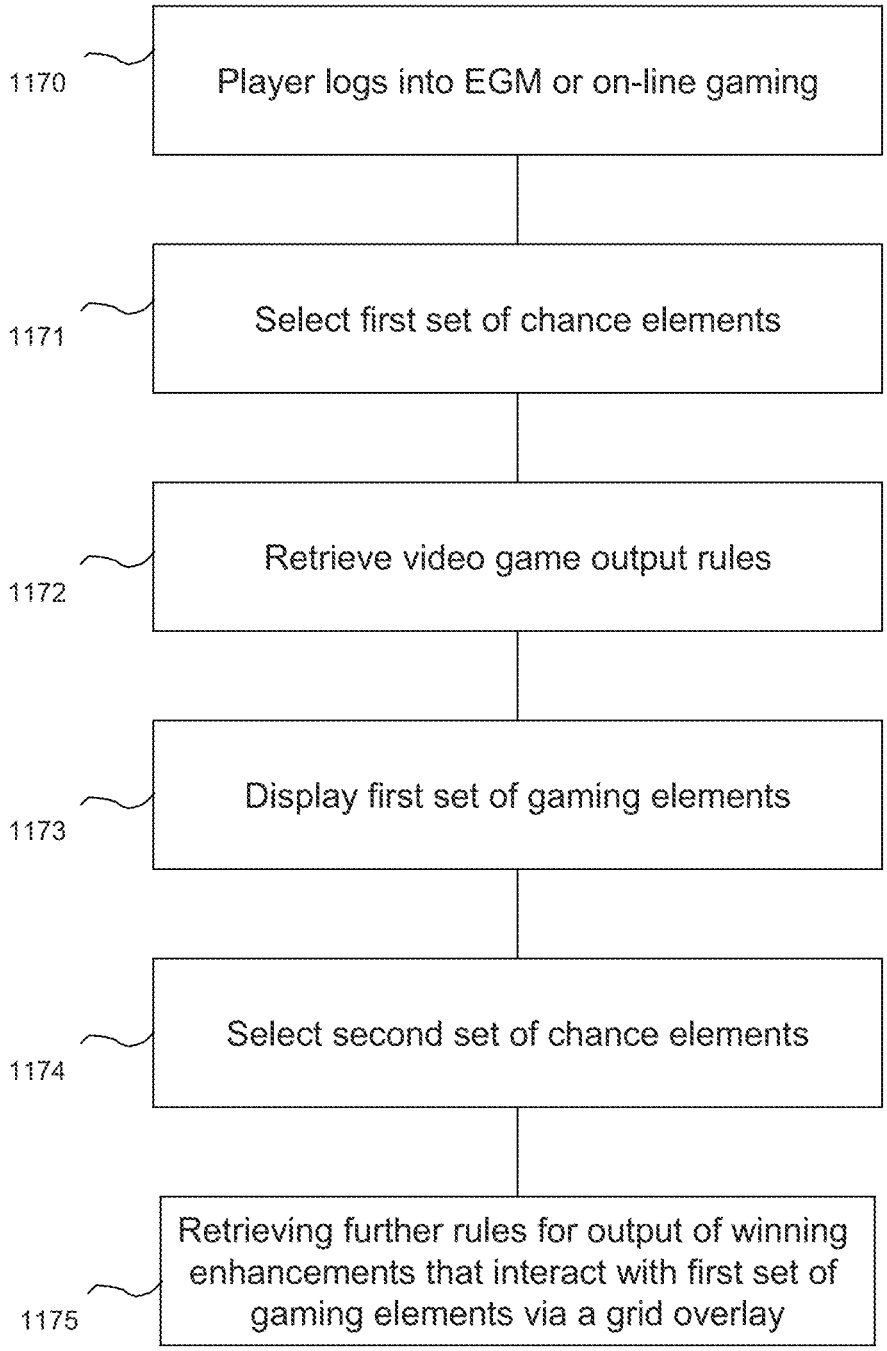
FIG. 23 is a flowchart showing steps performed by a gaming system implementing an embodiment of winning enhancements.

FIG. 23 is a flowchart showing steps performed by a gaming system implementing an embodiment of winning enhancements. The gaming system may be a casino system communicating with an EGM or an on-line gaming system where the player accesses a gaming site via the internet using a generic computer.

As shown in FIG. 23, in one implementation, the player logs into the EGM or on-line gaming portal at 1170; the system selects a first set of chance elements at 1171; the system retrieves applicable video game output rules at 1172; the associated gaming elements are retrieved and displayed at 1173; the system selects a second set of chance elements at 1174; and the system retrieves applicable winning enhancement rules, and displays the second set of chance elements as interacting with the first set of chance elements via the grid overlay at 1175.

In one aspect, a video gaming computer system or gaming system is provided that incorporates the winning enhancements described herein. The gaming system may include a computer program, configured to implement the winning enhancements in addition to or as part of three dimensional enhancements.

Figure 24:
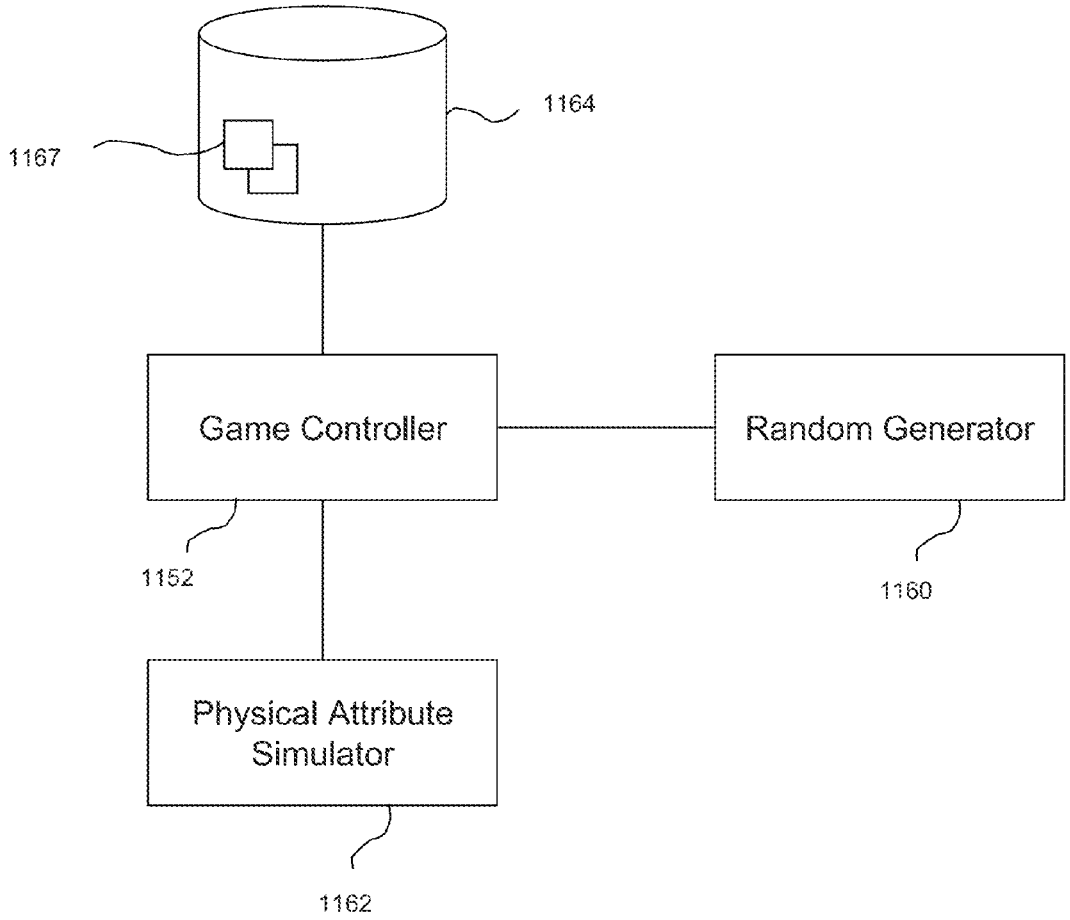
FIG. 24 is a system and program architecture diagram for implementing an embodiment of winning enhancements.

A representative video gaming computer system and video gaming computer program architecture in accordance with the present invention is shown in FIG. 24, and may include: a game controller 1152, and a random generator module 1152. The game controller 1152 may embody the various gaming rules 61 associated with pattern games including rules of play (including pay-out rules) and game display rules (including the winning enhancements and three dimensional enhancements). Alternatively, the game controller 1152 may be connected to a gaming rule repository 1164.

A random selector may be implemented by the random generator module 1160. The random generator module 1160 generates random selections, as part of the gaming rules, thereby producing gaming outcomes. The video gaming computer system, using the gaming controller 1152, generates gaming output for presentation to the user. Embodiments include in such gaming output the winning enhancements and three dimensional enhancements described herein, which may provide a more engaging and stimulating game.

The gaming output may include audio, video, three dimensional images and video, and possibly smell as well.

The gaming controller 1152 generates and displays a first level winning pattern (corresponding to a first random selection of the random generator module 1160) and a second level winning pattern (corresponding to the first random selection), in a way that the second level winning pattern is presented to the user as impacting on the outcome(s) associated with the first level winning pattern.

In one implementation the gaming controller 1152 is operable to generate and to present on a display (such as a screen) the first array, and the second array as an overlay on the first array, which may be shown as a three dimensional enhancement.

The gaming controller 1152 may embody one or more rules that are applied to determine the gaming output modifications ("modification rules"), if any, that result from the second set of gaming elements being situated in portions of the overlay that overlap with the underlying cells. The gaming controller 1152 may include a physical attribute simulator 1162.

In another aspect, the physical attribute simulator 1162 is operable to simulate: the second set of gaming elements falling on the display, which may be shown as a three dimensional enhancement; and the second set of gaming elements interacting physically with first set of gaming elements in way that simulates how the physical object(s) represented or simulated by the second set of gaming elements would interact with the physical object(s) represented or simulated by the first gaming elements, including based on any movements by the first set of gaming elements, as represented by the video gaming computer system in connection with movements of the first set of gaming elements associated with the first set of gaming elements achieving the resting pattern, if any.

Many possible gaming output presentations are possible, such as the three dimensional enhancements described herein. The winning enhancements may apply to a main or base game, secondary game, bonus game, and so on. Gaming output, incorporating winning enhancements may include a first set of gaming elements and an overlay of a second set of gaming elements, where the first set of gaming elements are at least visible in part despite the display of the second set of gaming elements. The second set of gaming elements therefore do not generally replace the first set of gaming elements, but rather the second set of gaming elements enhance the first set of gaming elements, thereby providing a more engaging and stimulating game. Also, the gaming controller may generate the gaming output in a way that simulates physical interactions between the first set of gaming elements and the second set of gaming elements.

For example the first set of gaming elements may include spinning reels, and the second set of gaming elements may include balls that interact physically with the spinning reels in that the gaming controller simulates that the balls are dropped over the spinning reels, this results in the display of the balls bouncing in a manner that is similar to the motions that would be produced if rubber balls were dropped over mechanical spinning reels. The simulation may include the reels and the balls eventually achieving a stationary state and depending on the locations of the balls in their stationary state relative to patterns on the wheels, a winning pattern based on both the spinning reels and the balls may be simulated.

Various examples are provided herein.

Figure 25A:
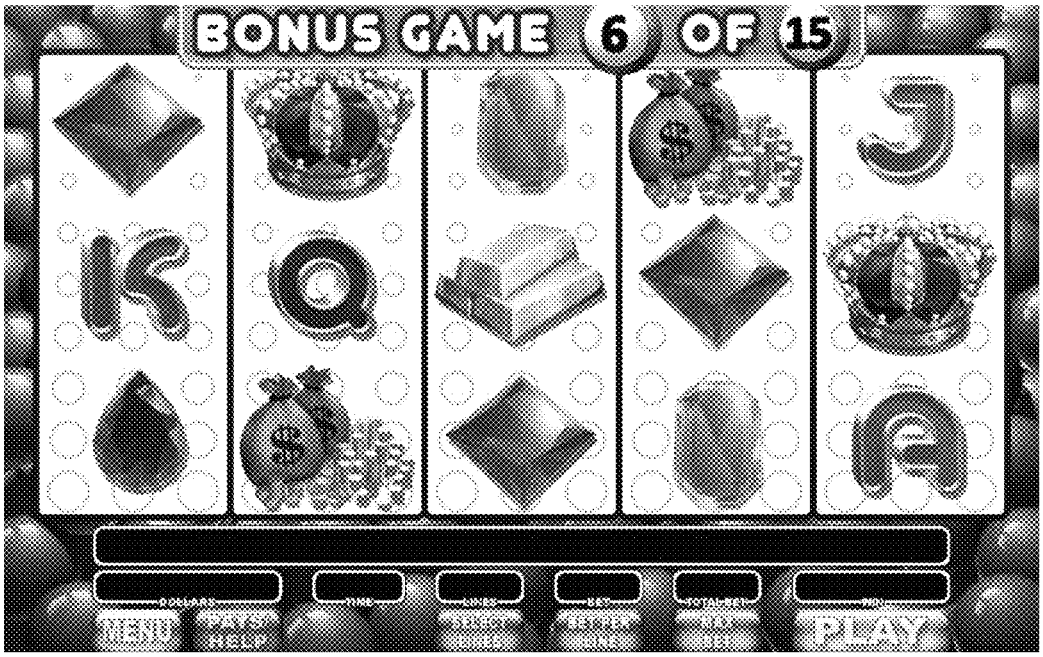
FIG. 25*a* illustrates a representative gaming output in accordance with embodiments.

In one possible implementation, a new and innovative spinning reel type game is provided with new functions and gaming output. In one implementation, in addition to a plurality of reels including gaming elements spinning to match the gaming elements, a random number of representations of physical objects (such as balls, dice or other such objects) may be "dropped" every spin of the reels. These representations of physical objects interact physically with the reels, for example they may tumble around and settle into place over top of a gaming element array or matrix such as a 3×S symbol array as shown in FIG. 25*a*.

The rules associated with the game may define one or more outcomes based on associations between the gaming elements and the representations of physical objects. The random generator may determine whether there is a winning outcome or not, and then based on the rules the video gaming computer system controls the display to lead to the winning outcome or not, based on the display of a set of stimulating and engaging interactions. The contribution of the invention is the winning enhancements and a series of possible graphical user interfaces for their display, as described herein, in order to provide more engaging and stimulating games. More specifically, visually the games described herein are may be more stimulating than known games.

In one aspect, the winning enhancements do not replace the gaming elements, but rather they are displayed in a way that still enables the user to see the gaming elements (at least in part) with which the representations of physical objects interact, thereby providing the winning enhancements.

In one implementation, the representations of the physical objects are displayed using an overlay (e.g. a three dimensional overlay), the physical arrangements being arranged by the video gaming computer system on the overlay in a manner that allows a user to see the underlying gaming elements in whole or in part.

Figure 25B:
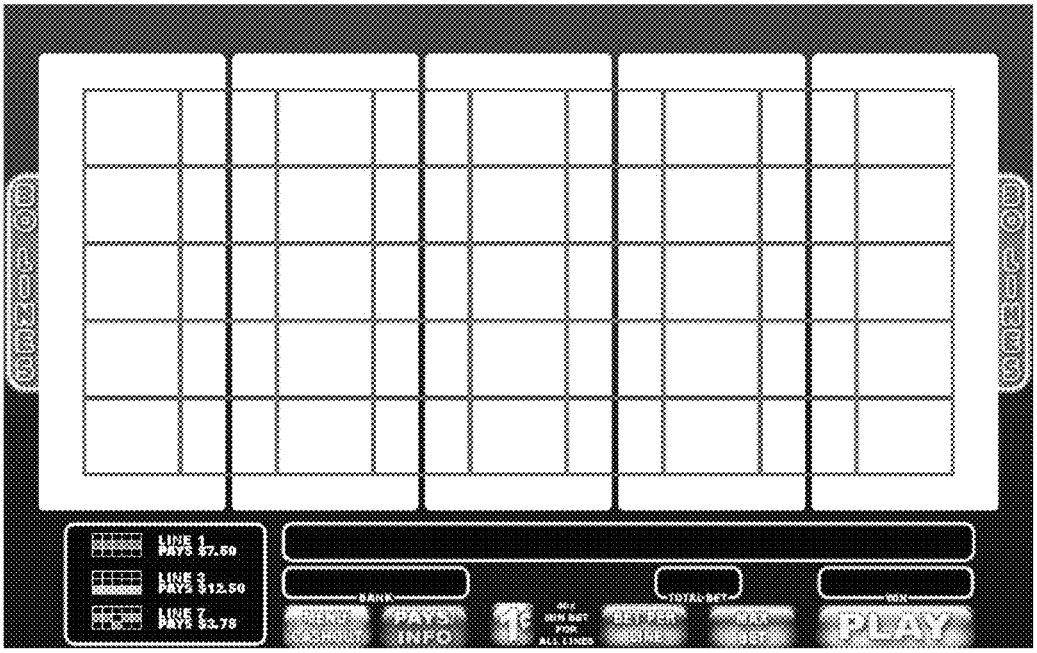
FIGS. 25*b* and 25*c* illustrate representative embodiments of the first/second arrays in accordance with embodiments.
Figure 25C:
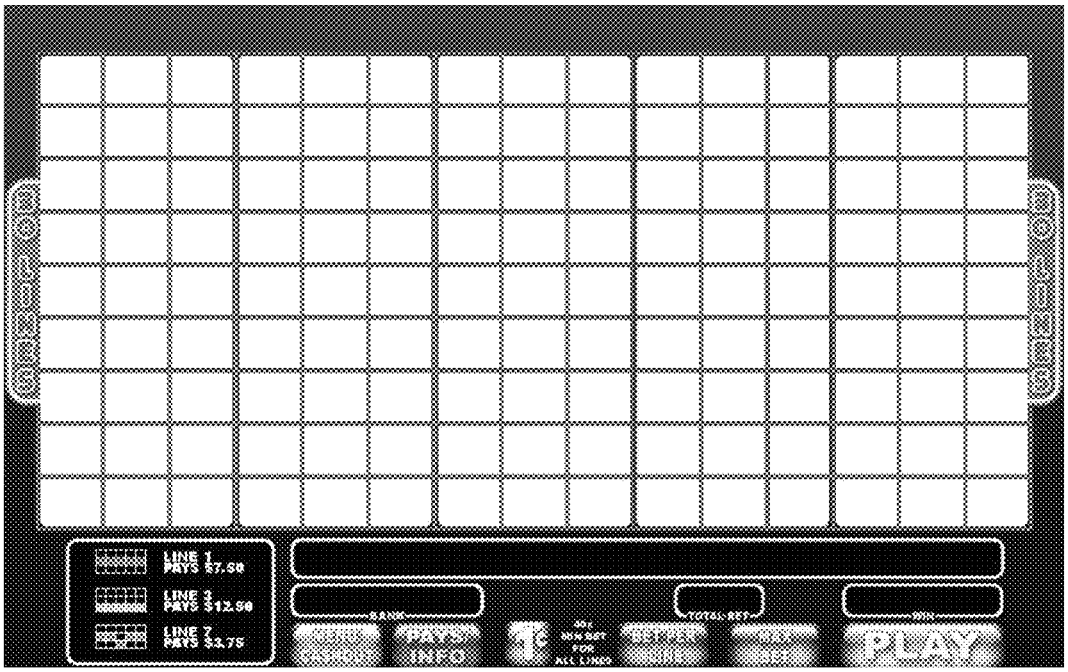
Figure 25D:
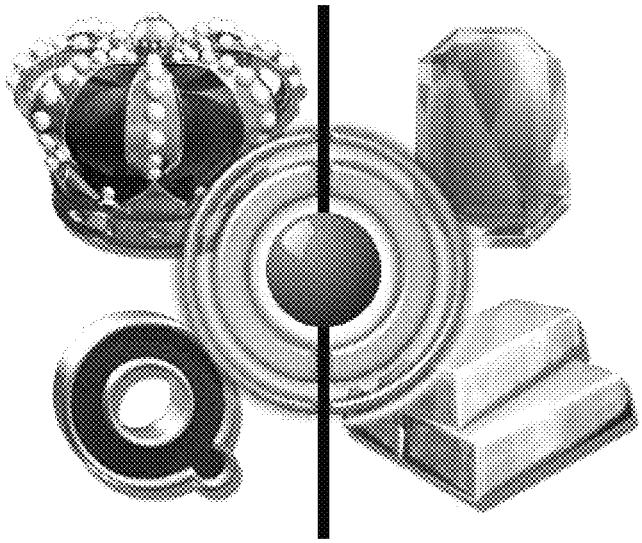
FIGS. 25*d* to 25*g* illustrate representative embodiments of the winning enhancements aspects of gaming output in accordance with embodiments.

FIG. 25*b* illustrates a possible overlay for receiving representations of the physical objects, namely a landing position grid for balls on top of the matrix shown for example in FIG. 25*a*. FIG. 25*c* illustrates a possible overlay.

Multiple overlays may be used (e.g. three dimensional overlays), and used by the video gaming computer system to manage various arrangements of winning enhancements. One possible implementation with at least a first and second overlay for providing winning enhancements is provided herein.

Generally speaking the physical object representations may move independently of the reels, and tumble while the reels spin, and then settle on the underlying gaming elements shown on the reels. Various play rules may be defined displaying a series of events that will result in a display associated with a winning combination. Also various physical interaction rules may determine the manner in which the physical object representations are shown to move, and the manner in which they interact physically with the underlying gaming elements.

For example the physical object representations may take the form of balls of different colours, each colour having different physical interaction rules and play attributes. In one representative implementation, and a possible gaming output, representations of balls may be used, and these may be of different colours such as PURPLE or BLUE balls, and these may have for example a multiplier effect depending on the gaming element or component on which they land (based on the cell in the applicable array on which they land). If these balls are involved in a winning combination for example, the video gaming computer system may tally the results, including any first array wining combinations and any multiplier effects of the PURPLE or BLUE balls depending on the gaming element on which they may have landed.

In one representative implementation, PURPLE balls may add a +1 multiplier to the corresponding win and the BLUE balls may add a +5 multiplier. There may also be GREEN balls which may for example be slightly larger than PURPLE or BLUE balls, and may be placed in a different overlay or invisible grid, for example as shown in FIGS. 25*d* to 25*g*.

In one implementation, once the balls stop moving and are shown to have reached a resting position, the gaming computer system presents the outcomes associated with application of the play rules. For example, the display presents messaging indicating that a multiplier ball adds a particular multiplier to a win, and this may trigger one or more animated sequences to indicate its multiplication value. For example, the animation may make the ball look like its turning to show text on the ball. The text may for example show the text "+Sx".

In one possible implementation, the GREEN ball may animate to cover any overlapping symbols and turn them into wild symbols, for example as shown in FIGS. 25*d* to 25*g*. In one aspect, the winning enhancements may provide bonus trigger gaming elements such that when the reels begin spinning, the bonus trigger gaming elements animate to create an illusion of a pile of balls beginning to fall downward. The pile may 15 appear to stretch out and separate to take up more vertical space, possibly to around double the original size of the height of the original graphic. The animated frame showing the balls at their most separated/expanded may remain visible throughout the entire time the reels are spinning. The animation may continue when the reels come to a stop and the balls will appear to collapse back into place as they were before the animation began. In one implementation, the animation is programmed to create a fluid effect. The animation may be part of a three dimensional enhancement and may be three dimensional animation.

In one implementation, when the reels stop, if three or more bonus trigger gaming elements are visible, this is a trigger for each of the bonus trigger gaming elements to appear as if a pile of balls explodes into the air toward the player's vantage point, then disappears off screen.

Different play rules may apply to different winning enhancements. Various other play rules are possible. For example a +5× multiplier ball may only drop during particular game spins for example during certain game spins. Various additional gaming features are possible such as different types of matrices, different line counts, different directional pays, different denominations, different volatility values, different hit/win frequencies, double-up or extended play features.

The game may incorporate localization features that permit the localization of a video gaming computer system for local requirements such as language (audio and video), currency, time display, and possibly other cultural requirements.

Different types of players, including for example players from different countries or regions may have different expectations of games of this nature. The video gaming computer system may incorporate features that enable an administrative user, for example using an administration utility, to determine one or more settings, for example relating to localization. These settings may also enable the administrative user to tune operation of the games in accordance with expectations of local users.

Various betting strategies may be applied. In one implementation of, a plurality of gaming elements is provided. For example there may be different types of gaming elements, and one or more additional gaming elements trigger the winning enhancements. The additional gaming elements may be shown as special animated objects, for example, a bonus trigger gaming element, and also three different types of balls that land on gaming elements to enhance wins.

In one implementation, gaming elements (excluding winning enhancements) may be associated with one or more animated effects such as a panning highlight or shine, and thus may be modeled. This may be used such that when the reels are spinning and the gaming elements pass through one or more designated areas, they may appear to shine. This aspect may be used for example to initiate celebration animations if the winning enhancements result in a winning combination for example.

In one particular implementation, the gaming elements may be associated with attributes, and these may be hierarchical.

In one aspect, the impact of bonus trigger gaming elements may depend on where these gaming elements "land" and settle on a cell of the first array. In one particular implementation of the present invention: a GREEN ball may land on a single gaming element, land between two vertical gaming elements, land between two horizontal gaming elements, or land between four gaming elements. If a GREEN ball contributes to a win, the GREEN ball may contribute to the win and initiate one of four possible animations, depending on the position of the ball.

Figure 25E:
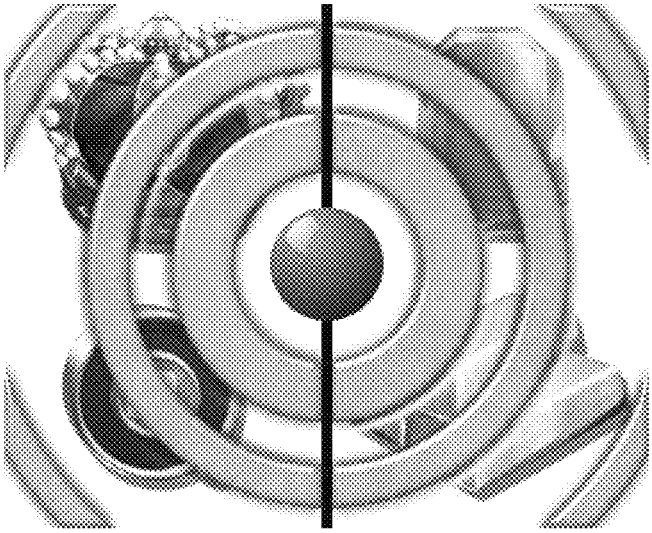
Figure 25F:
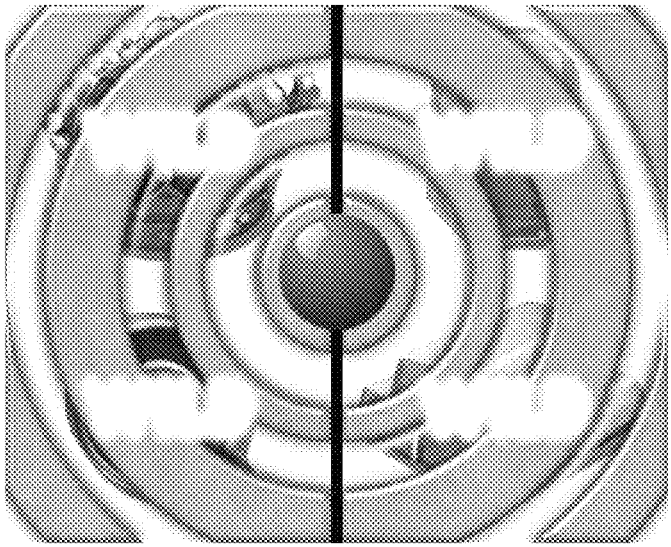
Figure 25G:
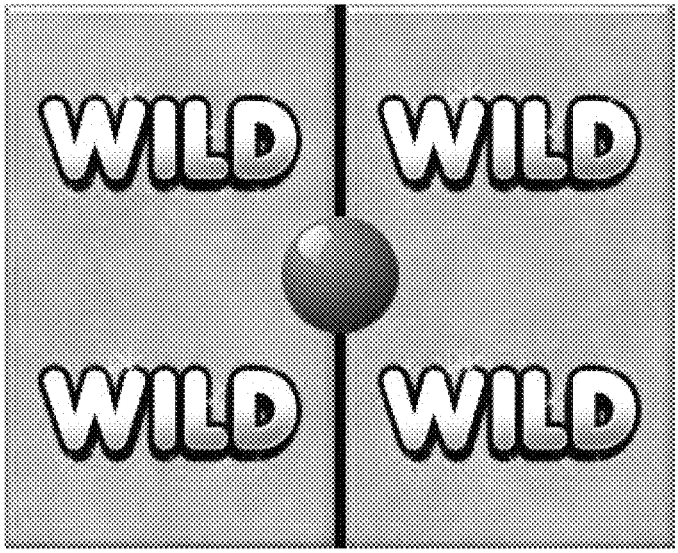

Once all reels have stopped and all balls have landed, any wild balls may begin to animate to display a rippling ring effect radiating outwards from the ball, to cover all overlapping symbols, as shown in FIG. 25*e*. This animation may be displayed regardless of whether the wild balls contribute to a win or not. As shown in FIG. 25*e*, because the GREEN ball landed in between four gaming elements, the rings radiate toward all four gaming elements, and turn each of these to four symbols and turn each overlapping symbol green. Optionally, if there is a winning combination overlapping gaming elements may be turned green.

Various marketing messages may be displayed in conjunction with the gaming output. Some of the marketing messages will not always be visible. When a marketing message is displayed, a message window for displaying animated marketing messages may animate one or more marketing message. Various arrangements are possible.

In another possible implementation, the gaming output may include bonus trigger anticipation features that may involve slowing down of any spinning reels which could potentially deliver a third, fourth or fifth bonus trigger symbol. In addition to this effect, trigger symbols will also involve an animated effect to heighten anticipation.

In one implementation, when the reels begin spinning, any bonus trigger gaming elements on screen animate to appear as if the pile of balls in the element graphic begin to drop. This creates the appearance that all balls gradually start to fall and separate, causing the trigger symbol graphic to increase to the size of 2 vertical symbols. The increased size will cause the symbol to be more visible while the reels are spinning.

In one implementation, a "Greenball Bonus" may be triggered by 3, 4, or 5 scattered bonus trigger gaming elements anywhere on reels 1 to 5. For example, 10, 15, and 20 Free Games may be awarded for 3, 4, or 5 scattered bonus trigger gaming elements respectively. Multiplier balls and Wild balls will still drop during the Bonus game. At least one Greenball (Wild Ball) may be guaranteed to drop every spin during the Bonus. The player can also retrigger the Bonus to a maximum of 150 games, in one example implementation.

In one implementation, the game includes an exit strategy that includes a Free Spin, after which the Bonus game transitions back to the main game by displaying a popup window over top of the reels to tally the player's entire bonus winnings. Then the entire screen (including the popup) fades out to reveal the main game screen as it was when the bonus was triggered.

The video gaming computer system may include a dashboard to enable users to access different features of the present invention, such as selection between different collections of gaming elements.

Various other animated features are possible. In addition various accompanying sound features may also be implemented by the invention. These features may depend on gaming outcomes.

The user interfaces, computer implemented methods, and computer system components described may be used in connection with a variety of different games that are pattern games or that include pattern game components. The winning enhancements (including three dimensional enhancements) may be used not only for reel-type games but also for a wide variety of other types of games such as poker games, keno games, lottery games or any other type of games.

Various functions or features described in this disclosure may be implemented as part of different gaming systems. For example: The winning or three dimensional enhancements may be implemented as part of a game to system (G2S) system, 3D gaming system and so on.

As previously stated, the user interfaces, computer implemented methods, and computer system components described herein may be used by an EGM. In the event the game is a lottery game, the game computer may be an in store gaming system or a gaming kiosk. For lottery games including the winning enhancements or three dimensional enhancements, the host system may be controlled by a government agency.

The game may be played on a standalone video gaming machine, a gaming console, on a general purpose computer connected to the Internet, on a smart phone, or using any other type of gaming device. The video gaming system may include multiplayer gaming features.

The game may be played on a social media platform, such as Facebook™. The video gaming computer system may also connect to a one or more social media platforms, for example to include social features. For example, the video gaming computer system may enable the posting of results as part of social feeds. In some applications, no monetary award is granted for wins, such as in some on-line games. For playing on social media platforms, non-monetary credits may be used for bets and an award may comprise similar non-monetary credits that can be used for further play or to have access to bonus features of a game. All processing may be performed remotely, such as by a server, while a player interface (computer, smart phone, etc.) displays the game to the player.

Those skilled in the art may write the appropriate software to carry out the enhancements to the game components without undue experimentation. The functionality described herein may also be accessed as an Internet service, for example by accessing the functions or features described from any manner of computer device, by the computer device accessing a server computer, a server farm or cloud service configured to implement said functions or features.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. A processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including an EGM, A Web TV, a Personal Digital Assistant (PDA), a smart phone, a tablet or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards and pointing devices, such as mice, touch pads, and digitizing tablets. As another example, a computer may receive input information through speech recognition or in other audible formats.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the enhancements to game components may be embodied as a tangible, non-transitory computer readable storage medium (or multiple computer readable storage media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other non-transitory, tangible computer-readable storage media) encoded with one or more programs that, when executed on one or more computers or other processors, perform methods that implement the various embodiments discussed above. The computer readable medium or media can be transportable, such that the program or programs stored thereon can be loaded onto one or more different computers or other processors to implement various aspects as discussed above. As used herein, the term "non-transitory computer-readable storage medium" encompasses only a computer-readable medium that can be considered to be a manufacture (i.e., article of manufacture) or a machine.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods as described herein need not reside on a single computer or processor, but may be distributed in a modular fashion amongst a number of different computers or processors to implement various aspects.

Computer-executable instructions may be in many forms, such as program modules, executed by one or more computers or other devices. Generally, program modules include routines, programs, objects, components, data structures, etc, that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present game enhancements may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While particular embodiments have been shown and described, it will be obvious to those skilled in the art that changes and modifications may be made to embodiments described herein.

The invention claimed is:

1. An electronic gaming system for enhancing virtual game components comprising:

at least one gaming device processor;

at least one gaming device memory device storing a plurality of gaming device instructions;

a display device connected to the at least one gaming device processor;

a plurality of input devices, including: an acceptor of a first physical item associated with a first monetary value and a validator configured to identify the first physical item;

a cashout button actuatable to cause an initiation of a payout associated with a credit balance;

a game controller board connected to the display device, the at least one gaming device memory device storing the plurality of gaming device instructions, and the at least one graphics processor, the game controller board configured to receive input data from the plurality of input devices to interface with a host system to identify the user account;

a display controller board connected to the three dimensional graphics processor;

wherein the game controller board is further configured to control the display controller board to render, on the display device a virtual three dimensional reel space defined by a plurality of rows and columns of the virtual game components arranged as a surface of a virtual cylinder in accordance with a set of game rules for a given game, each one of the virtual game components having an original symbol associated thereto, the virtual three dimensional reel space having a virtual rotational axis; and wherein the game controller board is further configured to select at least one of the virtual game components for three dimensional enhancement and to generate an animation effect on the display device using the display controller board to render a three dimensional stack of virtual bonus game components along a stacking axis perpendicular to the virtual rotational axis of the virtual three dimensional reel space, the three-dimensional stack extending from the at least one additional symbol on the surface of the cylinder as part of the three dimensional enhancement and to render a virtual rotation of the virtual three dimensional reel space and the three dimensional stack of virtual bonus game components around the virtual rotational axis on the display device; and to integrate the at least one additional symbol into the given game to trigger transfer of virtual credits to the user account by actuating the cashout button to cause the payout associated with the credit balance.

2. The system of claim 1, further comprising a camera configured for player head motion tracking to detect a head position and trigger the display controller to update a view of the virtual three dimensional reel space on the display using the graphics controller based on the head position.

3. The system of claim 2, wherein the plurality of three dimensional stacks of bonus game components are of varying depths.

4. The system of claim 1, wherein selecting at least one of the virtual game components for enhancement comprises selecting a plurality of virtual game components, and expanding selected ones comprises generating a plurality of virtual three dimensional stacks of bonus game components.

5. The system of claim 1, wherein the bonus game components are wild components and the processor updates the three dimensional stack of bonus game components over a sequence of rounds to generate another animation effect on the display device using the display controller to add and remove a portion of the wild components from the stack.

6. The system of claim 1, further comprise a three dimensional adjustment interface to receive player input to trigger the graphics processor to dynamically update the three dimensional enhancement.

7. The system of claim 1, wherein the display controller board provides the three dimensional stack by providing the at least one additional symbol at least one of parallel, perpendicular, and at an angle with the original symbol.

8. The system of claim 1, wherein the given game is a base game, and wherein the processor is further configured to detect a trigger event to launch a bonus game using the three dimensional stack, wherein the three dimensional stack impacts payout of additional rounds of the bonus game to the card reader and a variant game with the three dimensional enhancement.

9. The system of claim 1, wherein the at least one gamine device processor is further configured to detect that a prize event occurs and upon detection, to launch a plurality of prize game selections using the three dimensional enhancement, and to determine a selected prize from the plurality of prize selections after the remaining prizes from the plurality of prize selections are eliminated.

10. The system of claim 1, wherein the processor is further configured to display a visual indicator at a symbol position of the three dimensional stack when a symbol at that symbol position is involved in a winning combination of symbols at the end of a main game, and remove the symbol from the three dimensional stack using the graphical animation effect.

11. The system of claim 10, wherein the visual indicator is configured to modify an image from a symbol position by at least one of: adding an image to a symbol position when a symbol at that symbol position is involved in a winning combination of symbols at the end of the main game, subtracting an image from a symbol position when a symbol at that symbol position is involved in a winning combination of symbols at the end of the main game, and changing an image at a symbol position when a symbol at that symbol position is involved in a winning combination of symbols at the end of the main game, and displaying the visual indicator as a tile that appears behind a symbol, where the tile is extinguished when a symbol at that symbol position is involved in a winning combination of symbols at the end of the main game.

12. The system of claim 11, wherein there are multiple layers of visual indicators and a bonus game is initiated when all visual indicators in all the layers indicate that all symbol positions in a matrix have had a symbol involved in a winning combination.

13. The system of claim 10, wherein the processor is further configured to receive a plurality of different bets prior to each main game, and provide a secondary game by:

associating different bet amounts with different visual indicators;

using only the visual indicators at the symbol positions during a main game associated with the particular bet amount for that main game;

saving in a memory a status of the visual indicators associated with a previous bet amount when the player changes the bet amount for a new main game; and playing the secondary game with the set of visual indicators associated with the bet amount for the new main game.

14. The system of claim 1, wherein the virtual three dimensional reel space includes a matrix of symbol representations, each symbol representation corresponding to a symbol position and storing a corresponding symbol for rendering by the display controller board.

15. The system of claim 14, wherein the virtual bonus game components include a hidden award corresponding to a position within the matrix of symbol representations, the virtual bonus game triggered by the game controller board to conclude when a user reveals the hidden award.

16. The system of claim 1, wherein the acceptor is configured to receive one or more types of physical cards including at least one of machine-readable printable tickets, smart cards, and magnetic stripe cards.

17. The system of claim 1, further comprising a physical hopper configured to dispense coins or tokens responsive to the triggered transfer of virtual credits to the user account by actuation of the cashout button.

18. A non-transitory computer-readable storage medium storing one or more sequences of machine-readable instructions which, when executed by one or more gaming device processors, causes the one or more processors to perform a method for enhancing game components in an electronic gaming system having at least one display device, a plurality of input devices including at least an acceptor of a first physical item associated with a first monetary value and a validator configured to identify the first physical item, and a cashout button actuatable to cause an initiation of a payout associated with a credit balance, the method comprising:

receiving input data from the acceptor;

interfacing, by the validator, with a host system to identify a user account;

rendering using a display controller connected to the one or more gaming device processors, a virtual three dimensional reel space defined by a plurality of rows and columns of the virtual game components arranged as a surface of a cylinder in accordance with a set of game rules for a given game, each one of the virtual game components having an original symbol associated thereto, the virtual three dimensional reel space having a virtual rotational axis;

selecting at least one of the virtual game components for three dimensional enhancement;

generating an animation effect on the display device using a display controller to provide a three dimensional stack of bonus game components along a stacking axis perpendicular to the virtual rotational axis of the virtual three dimensional reel space, the stack extending from the at least one additional symbol on the surface of the cylinder as part of the three dimensional enhancement and rotating the three dimensional reel space and the three dimensional stack of bonus game components around the virtual rotational axis on the display device; and integrating the at least one additional symbol into the given game to trigger transfer of virtual credits to the user account by actuating the cashout button to cause the payout associated with the credit balance.

19. A gaming system for enhancing game components in a gaming system comprising:

a display device;

a plurality of input devices, including an acceptor of a first physical item associated with a first monetary value, and a validator configured to identify the first physical item;

a cashout button actuatable to cause an initiation of a payout associated with a credit balance;

a camera configured for player head motion tracking to detect a head position relative to the display device as a view guide;

at least one gaming device processor coupled to the display device, the plurality of input devices, and at least one gaming device memory storing one or more sequences of instructions which, when executed by the one or more gaming device processors, causes the one or more gaming device processors to:

display, on the display device using a display controller connected to the graphics processor, a virtual three dimensional reel space with the virtual game components arranged as a surface of a virtual cylinder, each one of the virtual game components having an original symbol associated thereto, the virtual three dimensional reel space having a virtual rotational axis and displayed based on the view guide;

select at least one of the game components for three dimensional enhancement;

generate an animation effect on the display device using a display controller to provide a three dimensional stack of bonus game components along a stacking axis perpendicular to the rotational axis of the three dimensional reel space, the three dimensional stack extending from the at least one additional symbol on the surface of the cylinder as part of the three dimensional enhancement and rotate the three dimensional reel space and the three dimensional stack of bonus game components around the rotational axis on the display device; and integrate the at least one additional symbol into the given game to trigger a value transfer to a user account.

20. The system of claim 19, further comprising a three dimensional adjustment interface to receive player input to trigger the gaming device processor to dynamically update the three dimensional enhancement.

* * * * *